US012085330B2

(12) United States Patent
Jung et al.

(10) Patent No.: US 12,085,330 B2
(45) Date of Patent: Sep. 10, 2024

(54) VACUUM ADIABATIC BODY AND REFRIGERATOR

(71) Applicant: LG ELECTRONICS INC., Seoul (KR)

(72) Inventors: Wonyeong Jung, Seoul (KR); Daewoong Kim, Seoul (KR); Chanho Chun, Seoul (KR); Sungsub Lee, Seoul (KR); Jangseok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 335 days.

(21) Appl. No.: 17/620,054

(22) PCT Filed: Jul. 9, 2020

(86) PCT No.: PCT/KR2020/008971
§ 371 (c)(1),
(2) Date: Dec. 16, 2021

(87) PCT Pub. No.: WO2021/006642
PCT Pub. Date: Jan. 14, 2021

(65) Prior Publication Data

US 2022/0307758 A1 Sep. 29, 2022

(30) Foreign Application Priority Data

Jul. 9, 2019 (KR) ..... 10-2019-0082635

(51) Int. Cl.
*F25D 23/06* (2006.01)
*F25D 11/02* (2006.01)
(Continued)

(52) U.S. Cl.
CPC ..... *F25D 23/063* (2013.01); *F25D 11/02* (2013.01); *F25D 23/028* (2013.01);
(Continued)

(58) Field of Classification Search
CPC ..... F25D 23/063; F25D 11/02; F25D 23/028; F25D 23/065; F25D 23/087;
(Continued)

(56) References Cited

U.S. PATENT DOCUMENTS 1,898,977 A * 2/1933 Comstock ..... F25D 23/062 220/592.27
2,065,608 A * 12/1936 Munters ..... F25D 23/062 62/DIG. 13
(Continued)

FOREIGN PATENT DOCUMENTS

AU 2018215766 A1 * 8/2019 ..... B60H 1/00
CN 102971571 3/2013
(Continued)

OTHER PUBLICATIONS

Chinese Office Action dated Sep. 24, 2023 issued in Application No. 202080050238.9.
(Continued)

*Primary Examiner* — Hanh V Tran
(74) *Attorney, Agent, or Firm* — KED & ASSOCIATES, LLP

(57) ABSTRACT

Provided is a vacuum adiabatic body. The vacuum adiabatic body includes a conductive resistance sheet configured to connect the first plate to the second plate so as to reduce a heat transfer amount between the first plate and the second plate and a cover assembly configured to cover the conductive resistance sheet. The cover assembly includes an inner cover configured to protect an inside, an outer cover configured to protect an outside, and a front cover configured to protect a front side. The front cover is thicker than the plate. The protection of the conductive resistance sheet and the improvement of the adiabatic effect may be obtained.

18 Claims, 41 Drawing Sheets

(51) Int. Cl.
*F25D 23/02* (2006.01)
*F25D 23/08* (2006.01)

(52) U.S. Cl.
CPC ..... *F25D 23/065* (2013.01); *F25D 23/087* (2013.01); *F25D 2201/14* (2013.01)

(58) Field of Classification Search
CPC .... F25D 2201/14; F25D 23/085; F25D 21/08; F25D 23/006; F25D 23/021; F25D 2323/022; F25D 2400/02; F16L 59/065; F16L 59/12
See application file for complete search history.

(56) References Cited

U.S. PATENT DOCUMENTS 2,464,526 A * 3/1949 Palmer ..... F25D 23/082 220/592.08
2,855,636 A * 10/1958 Donnelly ..... F25D 23/085 52/794.1
2,989,156 A * 6/1961 Brooks ..... F25D 23/06 220/592.27
3,632,011 A * 1/1972 Kitson ..... F25D 23/064 220/592.06
4,150,518 A * 4/1979 Truesdell ..... F25D 23/02 220/592.08
4,732,432 A * 3/1988 Keil ..... F25D 23/082 220/592.06
6,269,608 B1 * 8/2001 Porter ..... E04B 1/14 52/459
11,493,261 B2 * 11/2022 Nam ..... F25D 23/082
11,692,764 B2 * 7/2023 Kang ..... B32B 15/20 62/268
11,725,768 B2 * 8/2023 Nam ..... F16L 59/02 312/406
11,788,784 B2 * 10/2023 Jung ..... F25D 23/066 312/406
11,835,168 B2 * 12/2023 Ki ..... F25D 21/04
2002/0041134 A1 * 4/2002 Wolf ..... F25D 23/062 312/400
2002/0100250 A1 * 8/2002 Hirath ..... F25D 23/062 52/800.12
2004/0226956 A1 11/2004 Brooks
2012/0104923 A1 * 5/2012 Jung ..... F25D 23/066 312/406
2015/0030800 A1 1/2015 Jung et al.
2016/0258671 A1 * 9/2016 Allard ..... F25D 23/085
2017/0292776 A1 * 10/2017 Kim ..... F25D 23/062
2018/0238610 A1 8/2018 Jung et al.
2019/0078829 A1 * 3/2019 Okazaki ..... F25D 23/066

FOREIGN PATENT DOCUMENTS

CN 103069235 4/2013
CN 103733007 4/2014
CN 104019606 9/2014
CN 107614991 1/2018
CN 107850377 3/2018
CN 107850381 3/2018
CN 107923699 4/2018
CN 108302004 7/2018
CN 108332002 7/2018
JP H10318657 A * 12/1998
KR 20-2000-0013045 7/2000
KR 10-0343719 7/2002
KR 10-2015-0012712 2/2015
KR 10-2017-0016187 2/2017
WO WO 2019/117601 6/2019
WO WO-2019117601 A1 * 6/2019 ..... F16L 59/02

OTHER PUBLICATIONS

Chinese Office Action dated Apr. 21, 2023 issued in Application No. 202080050238.9.
Extended European Search Report dated Jun. 15, 2023 issued in Application No. 20836556.9.
International Search Report and Written Opinion dated Oct. 6, 2020 issued in PCT Application No. PCT/KR2020/008971.

* cited by examiner

VACUUM ADIABATIC BODY AND REFRIGERATOR

CROSS-REFERENCE TO RELATED PATENT APPLICATIONS

This application is a U.S. National Stage Application under 35 U.S.C. § 371 of PCT Application No. PCT/KR2020/008971, filed Jul. 9, 2020, which claims priority to Korean Patent Application No. 10-2019-0082635, filed Jul. 9, 2019, whose entire disclosures are hereby incorporated by reference.

TECHNICAL FIELD

The present disclosure relates to a vacuum adiabatic body and a refrigerator.

BACKGROUND ART

A vacuum adiabatic body is a product for suppressing heat transfer by vacuuming the inside of a main body thereof. The vacuum adiabatic body may reduce heat transfer by convection and conduction, and hence is applied to heating apparatuses and refrigerating apparatuses. In a typical adiabatic method applied to a refrigerator, although it is differently applied in refrigeration and freezing, a foam urethane adiabatic wall having a thickness of about 30 cm or more is generally provided. However, the internal volume of the refrigerator is therefore reduced.

In order to increase the internal volume of a refrigerator, there is an attempt to apply a vacuum adiabatic body to the refrigerator.

First, Korean Patent No. 10-0343719 (Reference Document 1) of the present applicant has been disclosed. According to Reference Document 1, there is disclosed a method in which a vacuum adiabatic panel is prepared and then built in walls of a refrigerator, and the outside of the vacuum adiabatic panel is finished with a separate molding as Styrofoam. According to the method, additional foaming is not required, and the adiabatic performance of the refrigerator is improved. However, fabrication cost increases, and a fabrication method is complicated.

As another example, a technique of providing walls using a vacuum adiabatic material and additionally providing adiabatic walls using a foam filling material has been disclosed in Korean Patent Publication No. 10-2015-0012712 (Reference Document 2). Also, fabrication cost increases, and a fabrication method is complicated.

As further another example, there is an attempt to fabricate all walls of a refrigerator using a vacuum adiabatic body that is a single product. For example, a technique of providing an adiabatic structure of a refrigerator to be in a vacuum state has been disclosed in U.S. Patent Laid-Open Publication No. US2004/0226956A1 (Reference Document 3). However, it is difficult to obtain a practical level of an adiabatic effect by providing a wall of the refrigerator with sufficient vacuum. In detail, there are limitations that it is difficult to prevent a heat transfer phenomenon at a contact portion between an outer case and an inner case having different temperatures, it is difficult to maintain a stable vacuum state, and it is difficult to prevent deformation of a case due to a negative pressure of the vacuum state. Due to these limitations, the technology disclosed in Reference Document 3 is limited to a cryogenic refrigerator, and does not provide a level of technology applicable to general households.

Alternatively, the present applicant has applied for Korean Patent Publication No. 10-2017-0016187 that discloses a vacuum adiabatic body and a refrigerator. According to the present disclosure, both the door and the main body of the refrigerator are provided as a vacuum adiabatic body, and a large adiabatic material is added to the edge of the door to prevent cool air from leaking from the edge of the main body and the door. However, there is a limitation in that the fabrication is complicated, and an internal volume of the refrigerator is greatly reduced.

Also, since the inner space of the vacuum adiabatic body is empty in a vacuum state, there is a limitation that deformation such as bending or buckling occurs due to weak strength when compared to an article filled with a resin material such as polyurethane according to the related art.

DISCLOSURE OF INVENTION

Technical Problem

Embodiments provide a refrigerator in which cool air is prevented from leaking through a contact portion between a main body and a door.

Embodiments also provide a refrigerator in which a sealing interval is secured to be narrowed by a vacuum adiabatic body.

Embodiments also provide a refrigerator in which an internal volume increases.

Embodiments also provide a refrigerator in which a weakness of a conductive resistance sheet that is vulnerable to an external impact by being thinly provided to resist to external conduction heat transfer is reinforced.

Embodiments also provide a refrigerator in which various components required for a natural operation of a device are installed without affecting adiabatic performance of a vacuum adiabatic body.

Embodiments also provide a refrigerator which is conveniently fabricated using a vacuum adiabatic body by a worker.

Solution to Problem

In one embodiment, a vacuum adiabatic body includes: a conductive resistance sheet configured to connect the first plate to the second plate; and a cover assembly configured to cover the conductive resistance sheet, wherein the cover assembly includes an inner cover configured to protect an inside, an outer cover configured to protect an outside, and a front cover configured to protect a front side, wherein the front cover is thicker than the plate. According to this structure, weak edges of the conductive resistance sheet and the vacuum adiabatic body may be thermally insulated and protected.

A heat transfer amount between the inner cover and the outer cover may be greater than that between an inside and an outside of the front cover. Heat that does not pass through the conductive resistance sheet may not pass through the front cover to further reduce the thermal conduction amount between the plates.

The conductive resistance sheet may have a thickness equal to or less than that of each of the outer cover and the inner cover, and the inner cover may have a thickness equal to or less than that of the plate. Thus, the thermal conduction resistance of the thin conductive resistance sheet may be sufficiently performed, and the installation of the cover assembly by the inner and outer covers may be performed.

The plate may have a thickness equal to or less than that of the front cover, or three times the thickness of the inner cover or the outer cover may be equal to or less than the thickness of the front cover. The protection of the conductive resistance sheet by the front cover may be performed.

The inner cover and the outer cover may be sealed with the plate, for example, may be welded to the plate. Thus, even if the vacuum by the conductive resistance sheet is broken, the vacuum destruction may be prevented. Thus, reliability with respect to the maintain of the vacuum of the vacuum adiabatic body may be improved.

A portion of an arm that is a magnetic body may be disposed inside the front cover, a portion of the arm that is the magnetic body may be disposed on at least one surface of a front surface or a rear surface of the front cover, at least a portion of the plate that is a magnetic body may be disposed behind the front cover, or at least a portion of the conductive resistance sheet that is made of a magnetic material may be disposed behind the front cover. Thus, the door may be in close contact with the main body to reduce a cool air loss within the main body.

The front cover may have an elastic modulus (N/m) greater than that of the inner cover or the outer cover. Thus, the cover assembly may be smoothly coupled to the plate by the inner and outer covers that are allowable in deformation.

The front cover may have yield strength (N/m^2) less than that of the inner cover or the outer cover. Thus, the front cover may perform the protection of the conductive resistance sheet.

The front cover may include a cover adiabatic material made of a resin and at least a portion of a pair of arms made of a metal material, which are coupled to the cover adiabatic material. Thus, the adiabatic operation of the front cover, the protection operation of the conductive resistance sheet, and the coupling stabilization operation by the arm made of the metal material may be performed together.

The pair of arms may extend to the inside and outside of the vacuum adiabatic body to provide at least a portion of the inner cover or the outer cover. The arms may be reliably coupled to an edge of the vacuum adiabatic body, and stability with respect to the coupling operation in a small volume by using metallic properties may be improved.

The pair of arms may be spaced a predetermined distance from each other to prevent thermal conduction between the arms and reduce an adiabatic loss by the cover assembly.

In another embodiment, a refrigerator includes a cover assembly provided on an edge of the opening of a main body, wherein the cover assembly includes at least one of: a front cover made of a nonmetal material, which is configured to cover the opening; and at least one of an inner cover made of a metal material, which extends from the front cover and extends along an inner surface of the main body, or an outer cover made of a metal material, which extends from the front cover and extends along an outer surface of the main body. In the refrigerator, the adiabatic operation by the front cover and the protection operation of the front surface of the edge of the opening may be performed. A magnet provided in the door may be fixed through magnetic force by the portion having a metallic property, which is provided on each of the inner cover and the outer cover.

At least a portion of the front cover is provided as a magnetic body so that the magnet is in further close contact with the front cover, thereby preventing the cool air within the refrigerator from leaking.

The front cover may have a thickness greater than that of each of the inner cover and the outer cover. Thus, the edge of the refrigerator may be more safely protected, and when a hot line is installed, an accommodation space for the hot line may be provided.

The main body may be provided as the vacuum adiabatic body, and the vacuum adiabatic body may include a conductive resistance sheet configured to connect the first plate to the second plate, wherein the front cover may be configured to cover the conductive resistance sheet. Thus, the front cover may safely protect the conductive resistance sheet. The conductive resistance sheet may be provided as a thin film plate to reduce the thermal conduction.

At least one of the inner cover or the outer cover may be sealed on the main body, preferably, be adhered or welded. In this case, the sealing may be repeated in series. Even though the inner seal is broken, the vacuum destruction may be prevented. Thus, product reliability of the vacuum adiabatic body and the refrigerator may be more improved.

The magnet may be in well contact with the front cover so that at least one of the plates is disposed behind the front cover.

In further another embodiment, a refrigerator includes a cover assembly configured to cover the conductive resistance sheet, wherein the cover assembly includes: a cover adiabatic material made of a resin material, which is configured to thermally insulate the conductive resistance sheet; and at least one of a first arm made of a metal material, which extends from the cover adiabatic material along the wall of the first plate or a second arm made of a metal material, which extends from the cover adiabatic material along the wall of the second plate. The adiabatic operation and the protection operation of the conductive resistance sheet may be performed by using the adiabatic material made of a resin material, and the coupling force between the plate and the arm may be secured by the arm made of a metal material, and convenient coupling performance may be achieved by the arm.

The cover adiabatic material may be provided in a multilayered structure, and the cover coupling portion may connect the layers to each other. Thus, the cover adiabatic material may be adjusted in thickness to variously adjust degrees of the reinforcement and protection of the front surface.

The cover coupling portion may hold at least one of the first arm or the second arm. Thus, the coupling between the portions may be conveniently performed.

Advantageous Effects of Invention

According to the embodiment, in the apparatus such as the refrigerator that is capable of being freely opened and closed by applying the vacuum adiabatic body, the leakage of the cool air through the contact portion between the main body and the door may be prevented to improve the energy use efficiency of the apparatus.

According to the embodiment, the vacuum adiabatic body may be applied to increase in internal capacity of the apparatus, and the sealing interval between the main body and the door may increase to achieve the operations.

According to the embodiment, the external access of the conductive resistance sheet may be prevented to improve the reliability of the apparatus using the vacuum adiabatic body.

According to the embodiment, the space for installing the components required for the operation of the apparatus such as the refrigerator may be secured, regardless of the adiabatic performance of the vacuum adiabatic body.

According to the embodiment, the worker may conveniently fabricate the refrigerator using the vacuum adiabatic body to improve the productivity of the product.

BRIEF DESCRIPTION OF DRAWINGS

FIGS. 13 and 14 are partial cutaway perspective views of an inner surface, wherein FIG. 13 illustrates in a state in which coupling is completed, and FIG. 14 illustrates a coupling process.

FIGS. 16 and 17 are views illustrating one end of the sealing frame, wherein FIG. 16 illustrates a state before a door hinge is installed, and FIG. 17 illustrates a state in which the door hinge is installed.

MODE FOR THE INVENTION

Hereinafter, exemplary embodiments will be described with reference to the accompanying drawings. The invention may, however, be embodied in many different forms and should not be construed as being limited to the embodiments set forth herein, and a person of ordinary skill in the art, who understands the spirit of the present invention, may readily implement other embodiments included within the scope of the same concept by adding, changing, deleting, and adding components; rather, it will be understood that they are also included within the scope of the present invention.

Hereinafter, for description of embodiments, the drawings shown below may be displayed differently from the actual product, or exaggerated or simple or detailed parts may be deleted, but this is intended to facilitate understanding of the technical idea of the present invention. It should not be construed as limited. However, it will try to show the actual shape as much as possible.

The following embodiments may be applied to the description of another embodiment unless the other embodiment does not collide with each other, and some configurations of any one of the embodiments may be modified in a state in which only a specific portion is modified in another configuration may be applied.

In the following description, the vacuum pressure means any pressure state lower than the atmospheric pressure. In addition, the expression that a vacuum degree of A is higher than that of B means that a vacuum pressure of A is lower than that of B.

Figure 1:
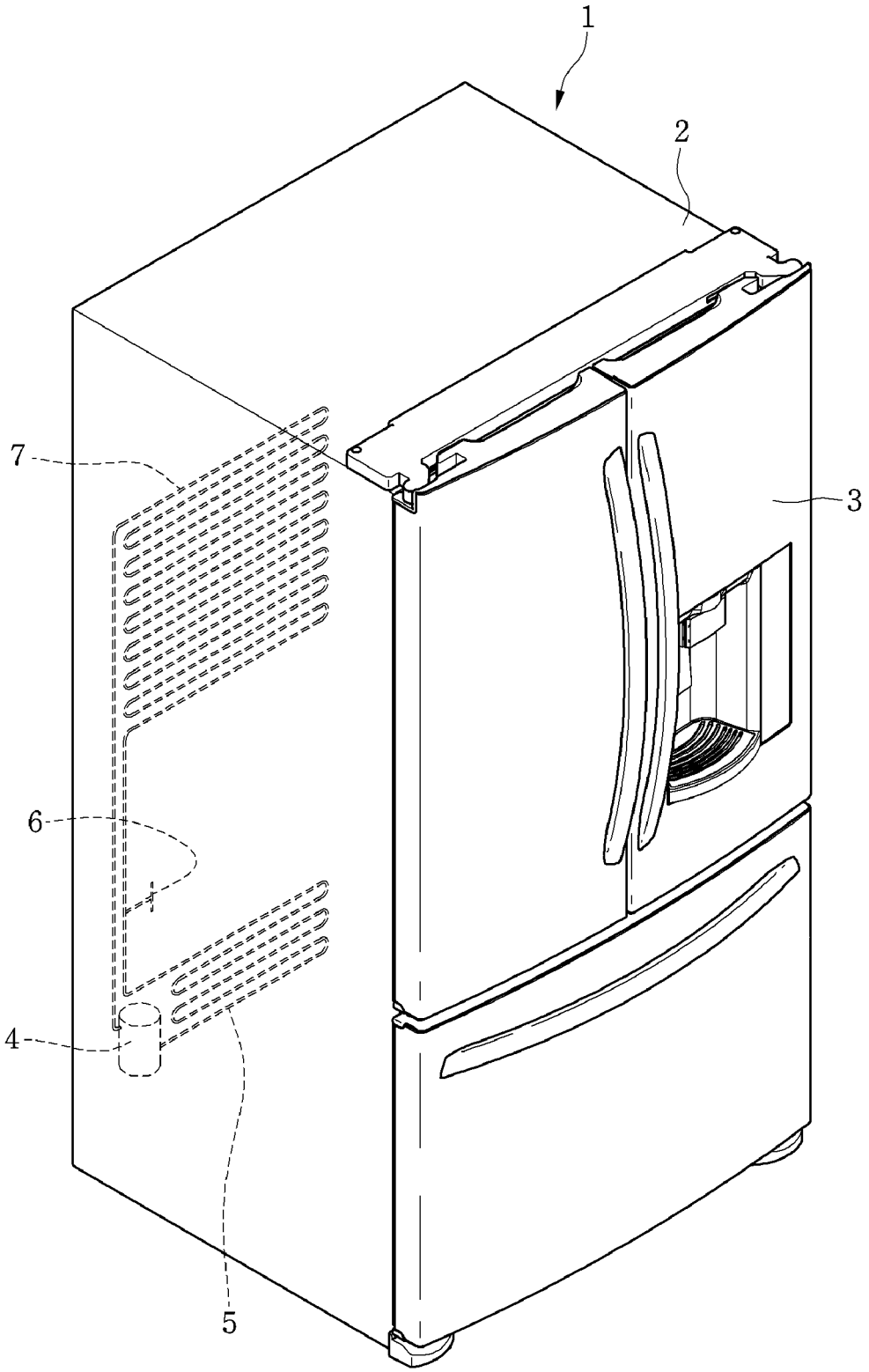
FIG. 1 is a perspective view of a refrigerator according to an embodiment.

FIG. 1 is a perspective view of a refrigerator according to an embodiment.

Referring to FIG. 1, the refrigerator 1 includes a main body 2 provided with a cavity 9 capable of storing storage goods and a door 3 provided to open and close the main body 2. The door 3 may be rotatably or slidably movably disposed to open/close the cavity 9. The cavity 9 may provide at least one of a refrigerating compartment and a freezing compartment.

Components constituting a refrigeration cycle in which cool air is supplied into the cavity 9. In detail, the components include a compressor 4 for compressing a refrigerant, a condenser 5 for condensing the compressed refrigerant, an expander 6 for expanding the condensed refrigerant, and an evaporator 7 for evaporating the expanded refrigerant to take heat. As a typical structure, a fan may be installed at a position adjacent to the evaporator 7, and a fluid blown from the fan may pass through the evaporator 7 and then be blown into the cavity 9. A freezing load is controlled by adjusting the blowing amount and blowing direction by the fan, adjusting the amount of a circulated refrigerant, or adjusting the compression rate of the compressor, so that it is possible to control a refrigerating space or a freezing space.

Figure 2:
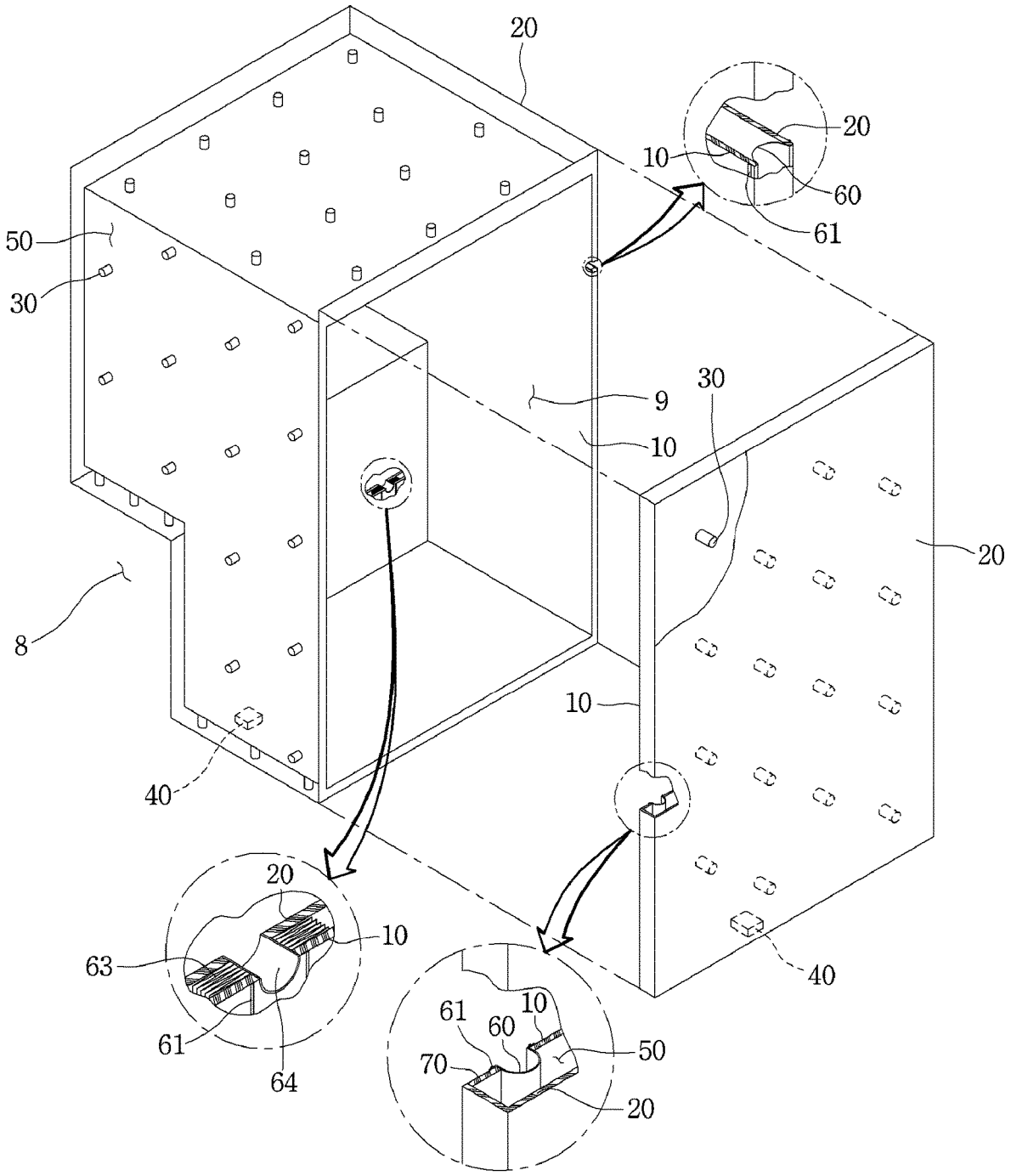
FIG. 2 is a view schematically illustrating a vacuum adiabatic body used in a main body and a door of the refrigerator.

FIG. 2 is a view schematically illustrating a vacuum adiabatic body used in the main body and the door of the refrigerator. In FIG. 2, a main body-side vacuum adiabatic body is illustrated in a state in which walls of top and side surfaces are removed, and a door-side vacuum adiabatic body is illustrated in a state in which a portion of a wall of a front surface is removed. In addition, sections of portions at conductive resistance sheets are provided are schematically illustrated for convenience of understanding.

Referring to FIG. 2, the vacuum adiabatic body includes a first plate 10 for providing a wall of a low-temperature space, a second plate 20 for providing a wall of a high-temperature space, a vacuum space 50 defined as a gap between the first and second plates 10 and 20. Also, the vacuum adiabatic body includes the conductive resistance sheets 60 and 63 for preventing thermal conduction between the first and second plates 10 and 20. A seal 61 for sealing the first and second plates 10 and 20 is provided so that the vacuum space 50 is in a sealing state. When the vacuum adiabatic body is applied to a refrigerator or a heating cabinet, the first plate 10 may be referred to as an inner case, and the second plate 20 may be referred to as an outer case. A machine room 8 in which components providing a refrigeration cycle are accommodated is placed at a lower rear side of the main body-side vacuum adiabatic body, and an exhaust port 40 for forming a vacuum state by exhausting air in the vacuum space 50 is provided at any one side of the vacuum adiabatic body. In addition, a pipeline 64 passing through the vacuum space 50 may be further installed so as to install a defrosting water line and electric wires.

The first plate 10 may define at least a portion of a wall for a first space provided thereto. The second plate 20 may define at least a portion of a wall for a second space provided thereto. The first space and the second space may be defined as spaces having different temperatures. Here, the wall for each space may serve as not only a wall directly contacting the space but also a wall not contacting the space. For example, the vacuum adiabatic body of the embodiment may also be applied to a product further having a separate wall contacting each space.

Factors of heat transfer, which cause loss of the adiabatic effect of the vacuum adiabatic body, are thermal conduction between the first and second plates 10 and 20, heat radiation between the first and second plates 10 and 20, and gas conduction of the vacuum space 50.

Hereinafter, a heat resistance unit provided to reduce adiabatic loss related to the factors of the heat transfer will be provided. Meanwhile, the vacuum adiabatic body and the refrigerator of the embodiment do not exclude that another adiabatic means is further provided to at least one side of the vacuum adiabatic body. Therefore, an adiabatic means using foaming or the like may be further provided to another side of the vacuum adiabatic body.

Figure 3:
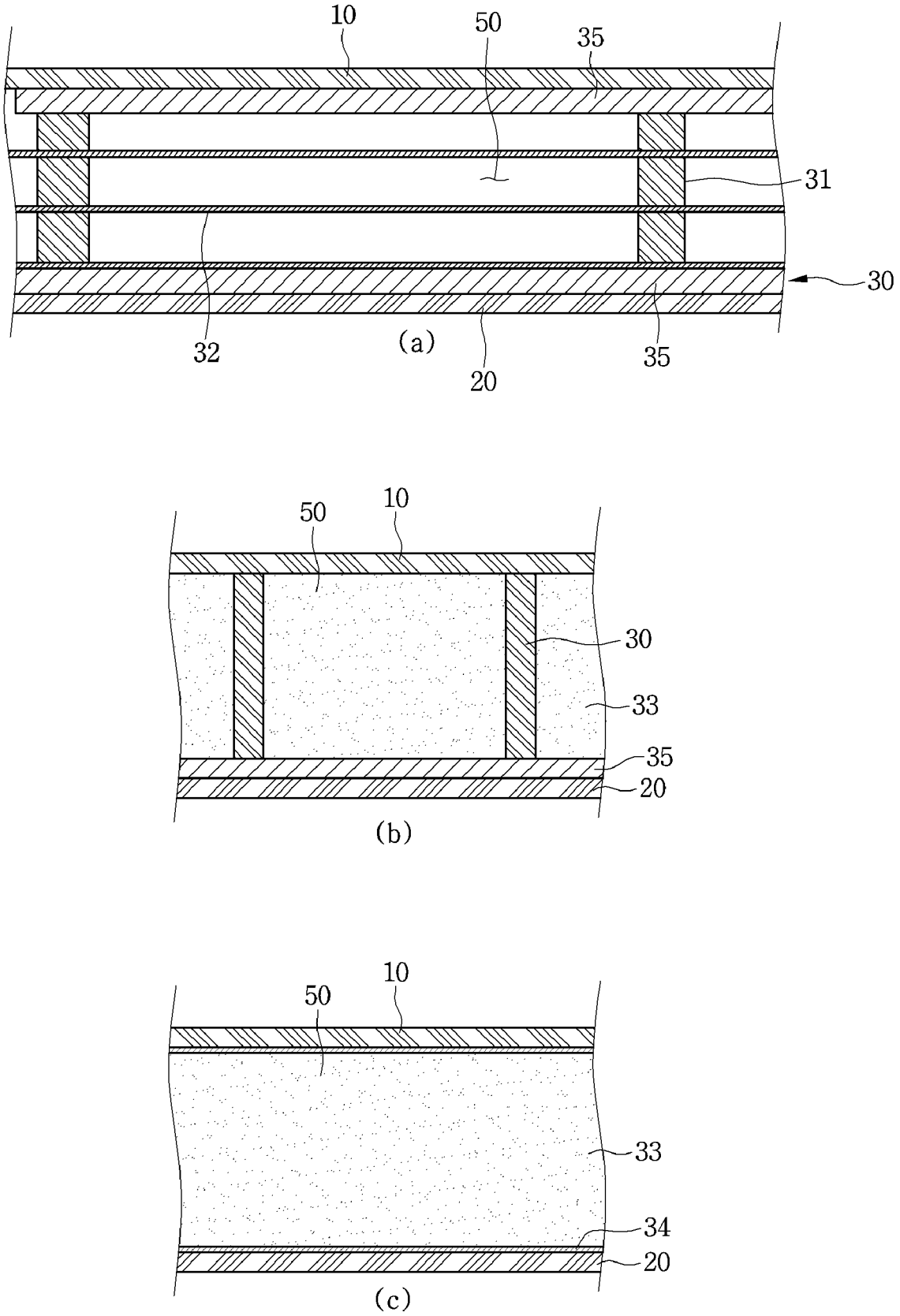
FIG. 3 is a view illustrating an internal configuration of a vacuum space according to various embodiments.

FIG. 3 is a view illustrating an internal configuration of the vacuum space according to various embodiments.

First, referring to FIG. 3A, the vacuum space 50 may be provided in a third space having a pressure different from that of each of the first and second spaces, preferably, a vacuum state, thereby reducing an adiabatic loss. The third space may be provided at a temperature between the temperature of the first space and the temperature of the second space. Since the third space is provided as a space in the vacuum state, the first and second plates 10 and 20 receive a force contracting in a direction in which they approach each other due to a force corresponding to a pressure difference between the first and second spaces. Therefore, the vacuum space 50 may be deformed in a direction in which the vacuum space 50 is reduced in volume. In this case, the adiabatic loss may be caused due to an increase in amount of heat radiation, caused by the contraction of the vacuum space 50, and an increase in amount of thermal conduction, which is caused by contact between the plates 10 and 20.

The support 30 may be provided to reduce the deformation of the vacuum space 50. The support 30 includes a bar 31. The bar 31 may extend in a substantially vertical direction with respect to the plates to support a distance between the first plate and the second plate. A support plate 35 may be additionally provided on at least any one end of the bar 31. The support plate 35 may connect at least two or more bars 31 to each other to extend in a horizontal direction with respect to the first and second plates 10 and 20. The support plate 35 may be provided in a plate shape or may be provided in a lattice shape so that an area of the support plate contacting the first or second plate 10 or 20 decreases, thereby reducing heat transfer. The bars 31 and the support plate 35 are fixed to each other at at least a portion so as to be inserted together between the first and second plates 10 and 20. The support plate 35 contacts at least one of the first and second plates 10 and 20, thereby preventing the deformation of the first and second plates 10 and 20. In addition, based on the extension direction of the bars 31, a total sectional area of the support plate 35 is provided to be greater than that of the bars 31, so that heat transferred through the bars 31 may be diffused through the support plate 35.

The support 30 may be made of a resin selected from PC, glass fiber PC, low outgassing PC, PPS, and LCP to obtain high compressive strength, a low outgassing and water absorption rate, low thermal conductivity, high compressive strength at a high temperature, and superior processability.

A radiation resistance sheet 32 for reducing heat radiation between the first and second plates 10 and 20 through the vacuum space 50 will be described. The first and second plates 10 and 20 may be made of a stainless material capable of preventing corrosion and providing a sufficient strength. Since the stainless material has a relatively high emissivity of 0.16, a large amount of radiation heat may be transferred. In addition, the support 30 made of the resin has a lower emissivity than the plates, and is not entirely provided to inner surfaces of the first and second plates 10 and 20. Thus, the support 30 does not have great influence on the radiation heat. Therefore, the radiation resistance sheet 32 may be provided in a plate shape over a majority of the area of the vacuum space 50 so as to concentrate on reduction of radiation heat transferred between the first and second plates 10 and 20. A product having a low emissivity may be used as the material of the radiation resistance sheet 32. In an embodiment, an aluminum foil having an emissivity of 0.02 may be used as the radiation resistance sheet 32. Also, since the transfer of radiation heat may not be sufficiently blocked using one radiation resistance sheet, at least two radiation resistance sheets 32 may be provided at a certain distance so as not to contact each other. Also, at least one radiation resistance sheet may be provided in a state of contacting the inner surface of the first or second plate 10 or 20.

Referring back FIG. 3*b*, the distance between the plates is maintained by the support 30, and a porous material 33 may be filled in the vacuum space 50. The porous material 33 may have a higher emissivity than that of the stainless material of the first and second plates 10 and 20. However, since the porous material 33 is filled in the vacuum space 50, the porous material 33 has a high efficiency for resisting the radiation heat transfer.

In this embodiment, the vacuum adiabatic body may be fabricated without the radiation resistance sheet 32.

Referring to FIG. 3*c*, the support 30 for maintaining the vacuum space 50 may not be provided. A porous material 333 may be provided to be surrounded by a film 34 instead of the support 30. Here, the porous material 33 may be provided in a state of being compressed so that the gap of the vacuum space is maintained. The film 34 made of, for example, a PE material may be provided in a state in which a hole is punched in the film 34.

In this embodiment, the vacuum adiabatic body may be fabricated without the support 30. That is to say, the porous material 33 may perform the function of the radiation resistance sheet 32 and the function of the support 30 together.

Figure 4:
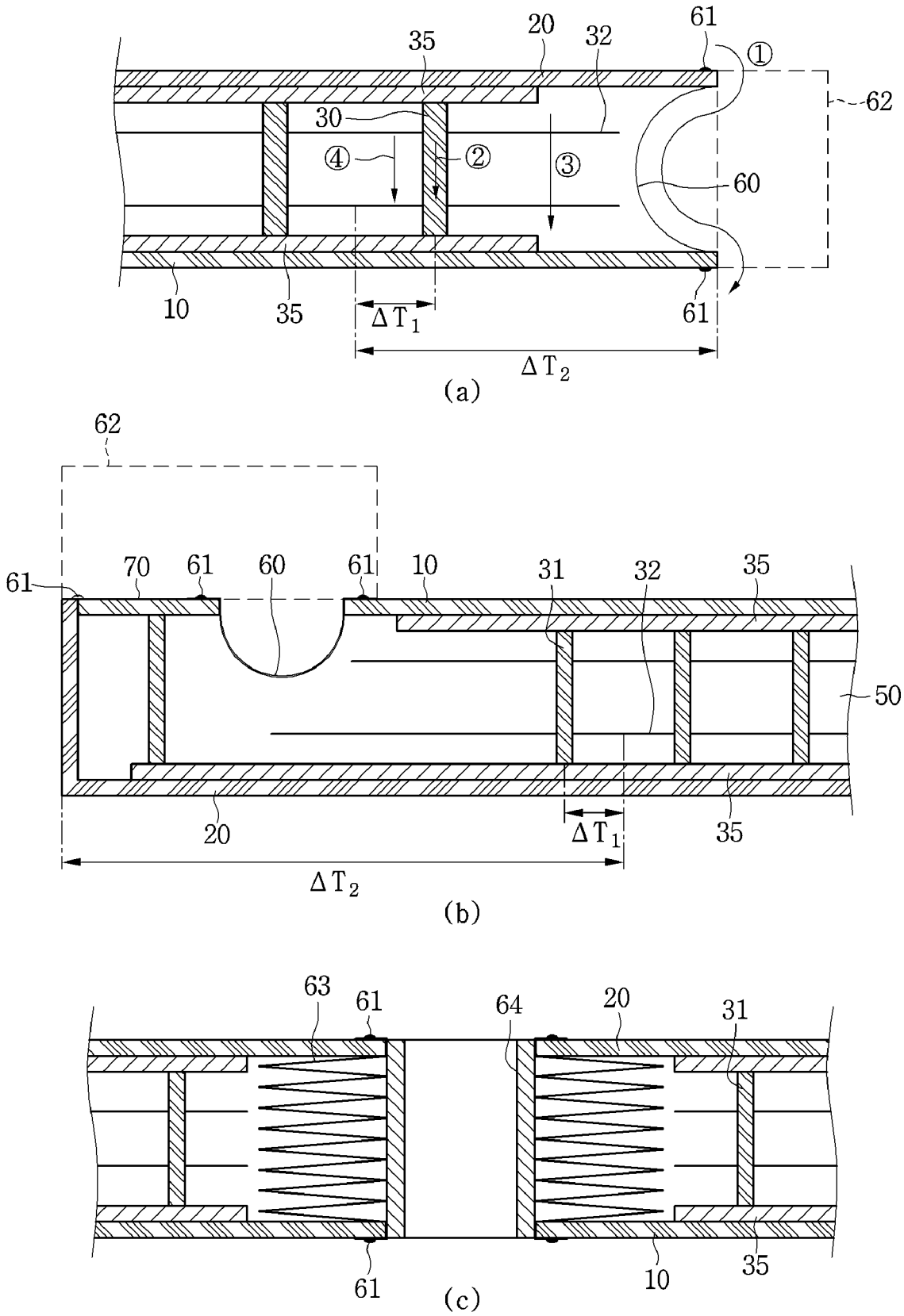
FIG. 4 is a view illustrating a conductive resistance sheet and a peripheral portion thereof according to various embodiments.

FIG. 4 is a view illustrating the conductive resistance sheet and the peripheral portion thereof according to various embodiments. A structure of each of the conductive resistance sheets are briefly illustrated in FIG. 2, but will be understood in detail with reference to the drawings.

First, a conductive resistance sheet proposed in FIG. 4*a* may be applied to the main body-side vacuum adiabatic body. Specifically, the first and second plates 10 and 20 are to be sealed so as to vacuum the inside of the vacuum adiabatic body. In this case, since the two plates have different temperatures from each other, heat transfer may occur between the two plates. A conductive resistance sheet 60 is provided to prevent thermal conduction between different two kinds of plates.

The conductive resistance sheet 60 may be provided with the seal 61 at which both ends of the conductive resistance sheet 60 are sealed to define at least a portion of the wall for the third space and maintain the vacuum state. The conductive resistance sheet 60 may be provided as a thin foil in unit of micrometer so as to reduce the amount of heat conducted along the wall for the third space. The seals 610 may be provided as a weld. That is, the conductive resistance sheet 60 and the plates 10 and 20 may be fused to each other. To cause a fusing operation between the conductive resistance sheet 60 and the plates 10 and 20, the conductive resistance sheet 60 and the plates 10 and 20 may be made of the same material, and a stainless material may be used as the material. The seal 610 may not be limited to the weld and may be provided through a process such as cocking. The conductive resistance sheet 60 may be provided in a curved shape. Thus, a thermal conduction distance of the conductive resistance sheet 60 is provided longer than a linear distance of each of the plates so that an amount of thermal conduction is further reduced.

A change in temperature occurs along the conductive resistance sheet 60. Therefore, to block the heat transfer to the outside of the conductive resistance sheet 60, a shield 62 may be provided at the outside of the conductive resistance sheet 60 so that an adiabatic operation occurs. In other words, in case of the refrigerator, the second plate 20 has a high temperature, and the first plate 10 has a low temperature. In addition, thermal conduction from high temperature to low temperature occurs in the conductive resistance sheet 60, and thus the temperature of the conductive resistance sheet 60 is suddenly changed. Therefore, when the conductive resistance sheet 60 is opened with respect to the outside thereof, the heat transfer through the opened place may seriously occur. To reduce the heat loss, the shield 62 is provided outside the conductive resistance sheet 60. For example, when the conductive resistance sheet 60 is exposed to any one of the low-temperature space and the high-temperature space, the conductive resistance sheet 60 does not serve as a conductive resistor as well as the exposed portion thereof, which is not preferable.

The shield 62 may be provided as a porous material contacting an outer surface of the conductive resistance sheet 60. The shield 62 may be provided as an adiabatic structure, e.g., a separate gasket, which is placed at the outside of the conductive resistance sheet 60. The shield 62 may be provided as a portion of the vacuum adiabatic body, which is provided at a position facing a corresponding conductive resistance sheet 60 when the main body-side vacuum adiabatic body is closed with respect to the door-side vacuum adiabatic body. To reduce the heat loss even when the main body and the door are opened, the shield 62 may be provided as a porous material or a separate adiabatic structure.

A conductive resistance sheet proposed in FIG. 4*b* may be applied to the door-side vacuum adiabatic body. In FIG. 4*b*, portions different from those of FIG. 4*a* are described in detail, and the same description is applied to portions identical to those of FIG. 4*a*. A side frame 70 is further provided outside the conductive resistance sheet 60. A component for the sealing between the door and the main body, an exhaust port necessary for an exhaust process, a getter port for vacuum maintenance, and the like may be placed on the side frame 70. This is because the mounting of components is convenient in the main body-side vacuum adiabatic body, but the mounting positions of components are limited in the door-side vacuum adiabatic body.

In the door-side vacuum adiabatic body, it is difficult to place the conductive resistance sheet 60 on a front end of the vacuum space, i.e., an edge side surface of the vacuum space. This is because, unlike the main body, a corner edge of the door is exposed to the outside. In more detail, if the conductive resistance sheet 60 is placed on the front end of the vacuum space, the corner edge of the door is exposed to the outside, and hence there is a disadvantage in that a separate adiabatic portion has to be configured so as to thermally insulate the conductive resistance sheet 60.

A conductive resistance sheet proposed in FIG. 4*c* may be installed in the pipeline passing through the vacuum space. In FIG. 4*c*, portions different from those of FIGS. 4*a* and 4*b* are described in detail, and the same description is applied to portions identical to those of FIGS. 4*a* and 4*b*. A conductive resistance sheet having the same shape as that of FIG. 4*a*, preferably, a wrinkled conductive resistance sheet 63 may be provided at a peripheral portion of the pipeline 64. Accordingly, a heat transfer path may be lengthened, and deformation caused by a pressure difference may be prevented. In addition, a separate shield may be provided to improve the adiabatic performance of the conductive resistance sheet.

A heat transfer path between the first and second plates 10 and 20 will be described with reference back to FIG. 4*a*. Heat passing through the vacuum adiabatic body may be divided into surface conduction heat ① conducted along a surface of the vacuum adiabatic body, more specifically, the conductive resistance sheet 60, support conduction heat ② conducted along the support 30 provided inside the vacuum adiabatic body, gas conduction heat ③ conducted through an internal gas in the vacuum space, and radiation transfer heat ④ transferred through the vacuum space.

The transfer heat may be changed depending on various depending on various design dimensions. For example, the support may be changed so that the first and second plates 10 and 20 may endure a vacuum pressure without being deformed, the vacuum pressure may be changed, the distance between the plates may be changed, and the length of the conductive resistance sheet may be changed. The transfer heat may be changed depending on a difference in temperature between the spaces (the first and second spaces) respectively provided by the plates. In the embodiment, a preferred configuration of the vacuum adiabatic body has been found by considering that its total heat transfer amount is smaller than that of a typical adiabatic structure formed by foaming polyurethane. In a typical refrigerator including the adiabatic structure formed by foaming the polyurethane, an effective heat transfer coefficient may be proposed as 19.6 mW/mK.

By performing a relative analysis on heat transfer amounts of the vacuum adiabatic body of the embodiment, a heat transfer amount by the gas conduction heat ③ may become the smallest. For example, the heat transfer amount by the gas conduction heat ③ may be controlled to be equal to or smaller than 4% of the total heat transfer amount. A heat transfer amount by solid conduction heat defined as a sum of the surface conduction heat ① and the support conduction heat ② is the largest. For example, the heat transfer amount by the solid conduction heat may reach 75% of the total heat transfer amount. A heat transfer amount by the radiation transfer heat ③ is smaller than the heat transfer amount by the solid conduction heat but larger than the heat transfer amount of the gas conduction heat. For example, the heat transfer amount by the radiation transfer heat ③ may occupy about 20% of the total heat transfer amount.

According to the heat transfer distribution, effective heat transfer coefficients (eK: effective K) (W/mK) of the surface conduction heat ①, the support conduction heat ②, the gas conduction heat ③, and the radiation transfer heat ④ may have an order of Math Equation 1 when comparing the transfer heat ①, ②, ③, and ④.

$$eK_{solid\ conduction\ heat} > eK_{radiation\ conduction\ heat} > eK_{gas\ conduction\ heat} \quad \text{[Equation 1]}$$

Here, the effective heat transfer coefficient (eK) is a value that may be measured using a shape and temperature differences of a target product. The effective heat transfer coefficient (eK) is a value that may be obtained by measuring a total heat transfer amount and a temperature at least one portion at which heat is transferred. For example, a calorific value (W) is measured using a heating source that may be quantitatively measured in the refrigerator, a temperature distribution (K) of the door is measured using heats respectively transferred through a main body and an edge of the door of the refrigerator, and a path through which heat is transferred is calculated as a conversion value (m), thereby evaluating an effective heat transfer coefficient.

The effective heat transfer coefficient (eK) of the entire vacuum adiabatic body is a value given by $k=QL/A\Delta T$. Here, Q denotes a calorific value (W) and may be obtained using a calorific value of a heater. A denotes a sectional area ($m^2$) of the vacuum adiabatic body, L denotes a thickness (m) of the vacuum adiabatic body, and ΔT denotes a temperature difference.

For the surface conduction heat, a conductive calorific value may be obtained through a temperature difference ΔT between an entrance and an exit of the conductive resistance sheet 60 or 63, a sectional area A of the conductive resistance sheet, a length L of the conductive resistance sheet, and a thermal conductivity (k) of the conductive resistance sheet (the thermal conductivity of the conductive resistance sheet is a material property of a material and may be obtained in advance). For the support conduction heat, a conductive calorific value may be obtained through a temperature difference ΔT between an entrance and an exit of the support 30, a sectional area A of the support, a length L of the support, and a thermal conductivity (k) of the support. Here, the thermal conductivity of the support may be a material property of a material and may be obtained in advance. The sum of the gas conduction heat ③, and the radiation transfer heat ④ may be obtained by subtracting the surface conduction heat and the support conduction heat from the heat transfer amount of the entire vacuum adiabatic body. A ratio of the gas conduction heat ③, and the radiation transfer heat ④ may be obtained by evaluating radiation transfer heat when no gas conduction heat exists by remarkably lowering a vacuum degree of the vacuum space 50.

When a porous material is provided inside the vacuum space 50, porous material conduction heat ⑤ may be a sum of the support conduction heat 2 and the radiation transfer heat ④. The porous material conduction heat may be changed depending on various variables including a kind, an amount, and the like of the porous material.

According to an embodiment, a temperature difference $\Delta T_1$ between a geometric center formed by adjacent bars 31 and a point at which each of the bars 31 is located may be provided to be less than 0.5° C. Also, a temperature difference $\Delta T_2$ between the geometric center formed by the adjacent bars 31 and an edge of the vacuum adiabatic body may be provided to be less than 0.5° C. In the second plate 20, a temperature difference between an average temperature of the second plate and a temperature at a point at which a heat transfer path passing through the conductive resistance sheet 60 or 63 meets the second plate may be the largest. For example, when the second space is a region hotter than the first space, the temperature at the point at which the heat transfer path passing through the conductive resistance sheet meets the second plate becomes lowest. Similarly, when the second space is a region colder than the first space, the temperature at the point at which the heat transfer path passing through the conductive resistance sheet meets the second plate becomes highest.

This means that the amount of heat transferred through other points except the surface conduction heat passing through the conductive resistance sheet should be controlled, and the entire heat transfer amount satisfying the vacuum adiabatic body may be achieved only when the surface conduction heat occupies the largest heat transfer amount. For this, a temperature variation of the conductive resistance sheet may be controlled to be larger than that of the plate.

Physical characteristics of the components constituting the vacuum adiabatic body will be described. In the vacuum adiabatic body, force due to a vacuum pressure is applied to all of the components. Therefore, a material having a strength ($N/m^2$) of a certain level may be used.

Under such circumferences, the plates 10 and 20 and the side frame 70 may be made of a material having sufficient strength with which the plates 10 and 20 are not damaged by even the vacuum pressure. For example, when the number of bars 31 decreases to limit the support conduction heat, the deformation of each of the plates occurs due to the vacuum pressure, which may bad influence on an outer appearance of the refrigerator. The radiation resistance sheet 32 may be made of a material that has a low emissivity and may be easily subjected to thin film processing. Also, the radiation resistance sheet 32 has to ensure strength enough without being deformed by an external impact. The support 30 is provided to strength that is enough to support the force by the vacuum pressure and endure the external impact, and is to have processability. The conductive resistance sheet 60 may be made of a material that has a thin plate shape and may endure the vacuum pressure.

In an embodiment, the plate, the side frame, and the conductive resistance sheet may be made of stainless materials having the same strength. The radiation resistance sheet may be made of aluminum having weaker strength than that of each of the stainless materials. The support may be made of a resin having weaker strength than that of the aluminum.

Unlike the strength from the point of view of the materials, an analysis from the point of view of stiffness is required. The stiffness (N/m) may be a property that is not be easily deformed. Thus, although the same material is used, its stiffness may vary depending on its shape. The conductive resistance sheets 60 or 63 may be made of a material having strength, but the stiffness of the material may be low so as to increase in heat resistance and minimize the radiation heat as the conductive resistance sheet is uniformly spread without any roughness when the vacuum pressure is applied. The radiation resistance sheet 32 requires stiffness having a certain level so as not to contact another component due to deformation. Particularly, an edge of the radiation resistance sheet may generate the conduction heat due to drooping caused by the self-load of the radiation resistance sheet. Therefore, the stiffness having the certain level is required. The support 30 requires a stiffness enough to endure compressive stress from the plate and the external impact.

In an embodiment, the plate and the side frame may have the highest stiffness so as to prevent the deformation caused by the vacuum pressure. The support, particularly, the bar may have the second highest stiffness. The radiation resistance sheet may have stiffness that is lower than that of the support but higher than that of the conductive resistance sheet. Lastly, the conductive resistance sheet may be made of a material that is easily deformed by the vacuum pressure and has the lowest stiffness.

Even when the porous material 33 is filled in the vacuum space 50, the conductive resistance sheet may have the lowest stiffness, and each of the plate and the side frame may have the highest stiffness.

Hereinafter, the vacuum pressure may be determined depending on internal states of the vacuum adiabatic body. As already described above, a vacuum pressure is to be maintained inside the vacuum adiabatic body so as to reduce heat transfer. Here, it will be easily expected that the vacuum pressure is maintained as low as possible so as to reduce the heat transfer.

The vacuum space may resist to heat transfer by only the support 30. Here, a porous material 33 may be filled with the support inside the vacuum space 50 to resist to the heat transfer. The heat transfer to the porous material may resist without applying the support.

The case in which only the support is applied will be described.

Figure 5:
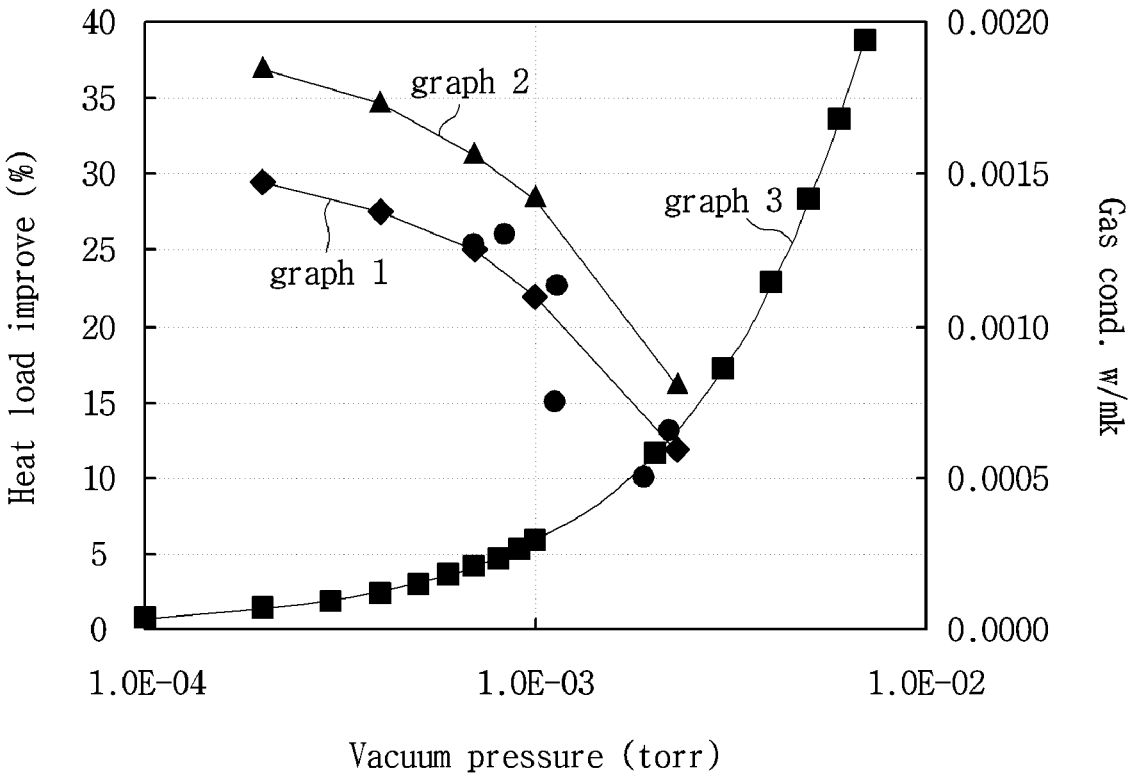
FIG. 5 is a graph illustrating a variation in adiabatic performance and a variation in gas conductivity according to a vacuum pressure by applying a simulation.

FIG. 5 is a graph illustrating a variation in adiabatic performance and a variation in gas conductivity according to the vacuum pressure by applying a simulation.

Referring to FIG. 5, it may be seen that, as the vacuum pressure decreases, i.e., as the vacuum degree increases, a heat load in the case of only the main body (Graph 1) or in the case in which the main body and the door are combined together (Graph 2) decreases as compared to that in the case of the typical product formed by foaming polyurethane, thereby improving the adiabatic performance. However, it may be seen that the degree of improvement of the adiabatic performance is gradually lowered. Also, it may be seen that, as the vacuum pressure decreases, the gas conductivity (Graph 3) decreases. However, it may be seen that, although the vacuum pressure decreases, a ratio at which the adiabatic performance and the gas conductivity are improved is gradually lowered. Therefore, it is preferable that the vacuum pressure decreases as low as possible. However, it takes long time to obtain an excessive vacuum pressure, and much cost is consumed due to an excessive use of the getter. In the embodiment, an optimal vacuum pressure is proposed from the above-described point of view.

Figure 6:
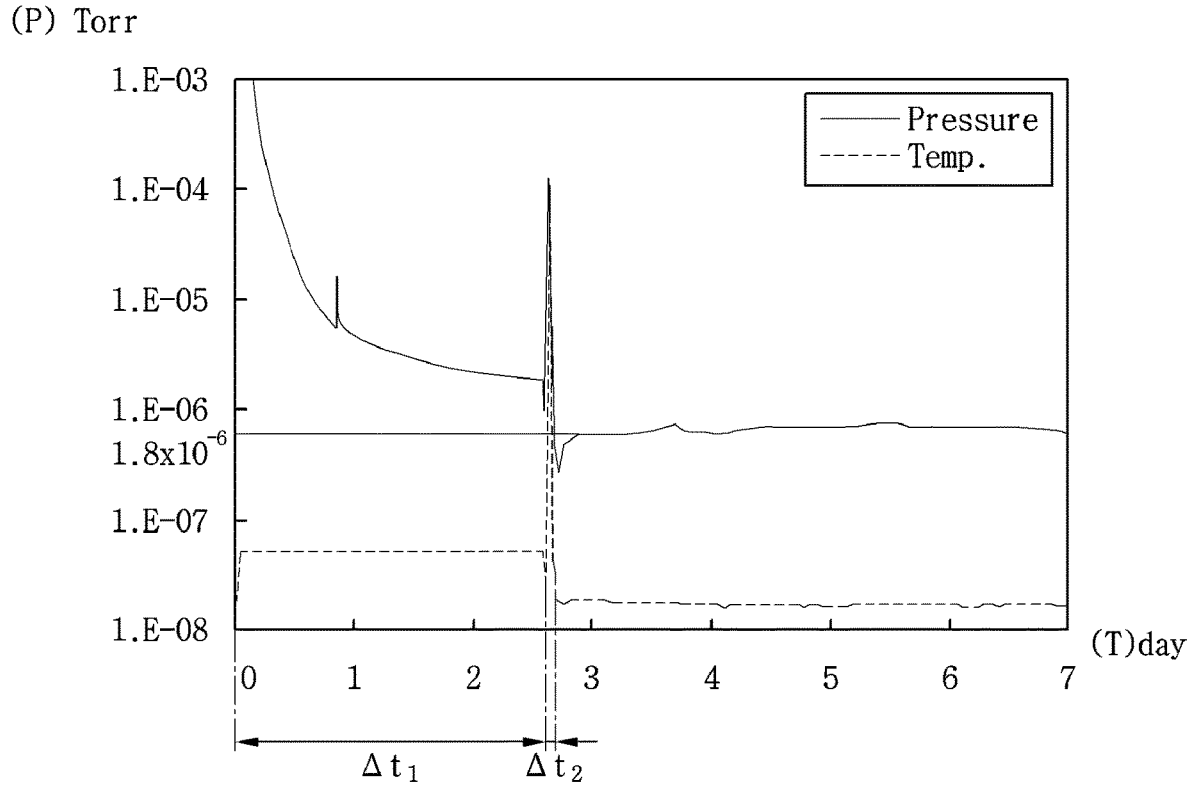
FIG. 6 is a graph illustrating results obtained by observing a time and a pressure in a process of exhausting the inside of the vacuum adiabatic body when a support is used.

FIG. 6 is a graph illustrating results obtained by observing a time and a pressure in a process of exhausting the inside of the vacuum adiabatic body when the support is used.

Referring to FIG. 6, to create the vacuum space 50 to be in the vacuum state, a gas in the vacuum space 50 is exhausted by a vacuum pump while evaporating a latent gas remaining in the components of the vacuum space 50 through baking. However, if the vacuum pressure reaches a certain level or more, there exists a point at which the level of the vacuum pressure does not increase any more ($\Delta t_1$). Thereafter, the getter is activated by disconnecting the vacuum space 50 from the vacuum pump and applying heat to the vacuum space 50 ($\Delta t_2$). If the getter is activated, the pressure in the vacuum space 50 decreases for a certain period of time, but then normalized to maintain a vacuum pressure having a certain level. The vacuum pressure that maintains the certain level after the activation of the getter is approximately $1.8\times10^{-6}$ Torr.

In the embodiment, a point at which the vacuum pressure does not substantially decrease any more even though the gas is exhausted by operating the vacuum pump is set to the lowest limit of the vacuum pressure used in the vacuum adiabatic body, thereby setting the minimum internal pressure of the vacuum space 50 to $1.8\times10^{-6}$ Torr.

Figure 7:
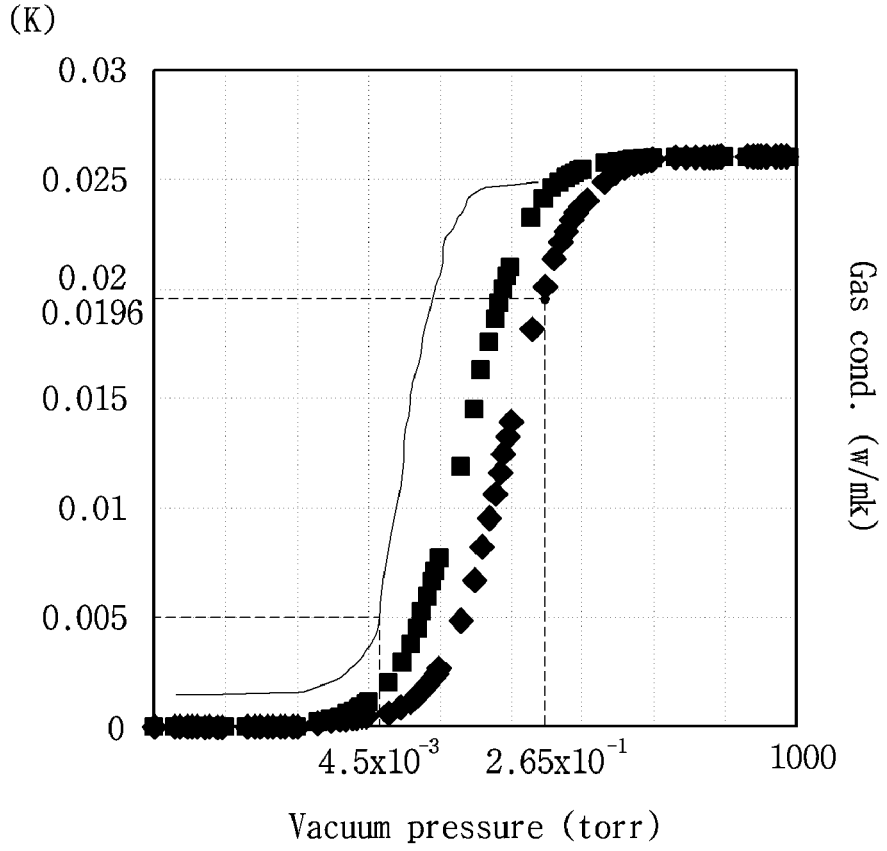
FIG. 7 is a graph illustrating results obtained by comparing a vacuum pressure to gas conductivity.

FIG. 7 is a graph illustrating results obtained by comparing the vacuum pressure with gas conductivity.

Referring to FIG. 7, gas conductivity with respect to the vacuum pressure depending on a size of the gap in the vacuum space 50 was represented as a graph of effective heat transfer coefficient (eK). The effective heat transfer coefficient (eK) was measured when the gap in the vacuum space 50 has three sizes of 2.76 mm, 6.5 mm, and 12.5 mm. The gap in the vacuum space 50 is defined as follows. When the radiation resistance sheet 32 exists inside vacuum space 50, the gap is a distance between the radiation resistance sheet 32 and the plate adjacent thereto. When the radiation resistance sheet 32 does not exist inside vacuum space 50, the gap is a distance between the first and second plates.

It was seen that, since the size of the gap is small at a point corresponding to a typical effective heat transfer coefficient of 0.0196 W/mK, which is provided to an adiabatic material formed by foaming polyurethane, the vacuum pressure is $2.65\times10^{-1}$ Torr even when the size of the gap is 2.76 mm. Meanwhile, it was seen that the point at which reduction in adiabatic effect caused by the gas conduction heat is saturated even though the vacuum pressure decreases is a point at which the vacuum pressure is approximately $4.5\times10^{-3}$ Torr. The vacuum pressure of $4.5\times10^{-3}$ Torr may be defined as the point at which the reduction in adiabatic effect caused by the gas conduction heat is saturated. Also, when the effective heat transfer coefficient is 0.1 W/mK, the vacuum pressure is $1.2\times10^{-2}$ Torr.

When the vacuum space 50 is not provided with the support but provided with the porous material, the size of the gap ranges from a few micrometers to a few hundreds of micrometers. In this case, the amount of radiation heat transfer is small due to the porous material even when the vacuum pressure is relatively high, i.e., when the vacuum degree is low. Therefore, an appropriate vacuum pump is used to adjust the vacuum pressure. The vacuum pressure appropriate to the corresponding vacuum pump is approximately $2.0\times10^{-4}$ Torr. Also, the vacuum pressure at the point at which the reduction in adiabatic effect caused by the gas conduction heat is saturated is approximately $4.7\times10^{-2}$ Torr. Also, the pressure where the reduction in adiabatic effect caused by gas conduction heat reaches the typical effective heat transfer coefficient of 0.0196 W/mK is 730 Torr.

When the support and the porous material are provided together in the vacuum space, a vacuum pressure may be created and used, which is middle between the vacuum pressure when only the support is used and the vacuum pressure when only the porous material is used. When only the porous material is used, the lowest vacuum pressure may be used.

The vacuum adiabatic body includes a first plate defining at least a portion of a wall for the first space and a second plate defining at least a portion of a wall for the second space and having a temperature different from the first space. The first plate may include a plurality of layers. The second plate may include a plurality of layers The vacuum adiabatic body may further include a seal configured to seal the first plate and the second plate so as to provide a third space that is in a vacuum state and has a temperature between a temperature of the first space and a temperature of the second space.

When one of the first plate and the second plate is disposed in an inner space of the third space, the plate may be represented as an inner plate. When the other one of the first plate and the second plate is disposed in an outer space of the third space, the plate may be represented as an outer plate. For example, the inner space of the third space may be a storage room of the refrigerator. The outer space of the third space may be an outer space of the refrigerator.

The vacuum adiabatic body may further include a support that maintains the third space.

The vacuum adiabatic body may further include a conductive resistance sheet connecting the first plate to the second plate to reduce an amount of heat transferred between the first plate and the second plate.

At least a portion of the conductive resistance sheet may be disposed to face the third space. The conductive resistance sheet may be disposed between an edge of the first plate and an edge of the second plate. The conductive resistance sheet may be disposed between a surface on which the first plate faces the first space and a surface on which the second plate faces the second space. The conductive resistance sheet may be disposed between a side surface of the first plate and a side surface of the second plate.

At least a portion of the conductive resistance sheet may extend in a direction that is substantially the same as the direction in which the first plate extends.

A thickness of the conductive resistance sheet may be thinner than at least one of the first plate or the second plate. The more the conductive resistance sheet decreases in thickness, the more heat transfer may decrease between the first plate and the second plate.

The more the conductive resistance sheet decreases in thickness, the more it may be difficult to couple the conductive resistance sheet between the first plate and the second plate.

One end of the conductive resistance sheet may be disposed to overlap at least a portion of the first plate. This is to provide a space for coupling one end of the conductive resistance sheet to the first plate. Here, the coupling method may include welding.

The other end of the conductive resistance sheet may be arranged to overlap at least a portion of the second plate. This is to provide a space for coupling the other end of the conductive resistance sheet to the second plate. Here, the coupling method may include welding.

As another embodiment of replacing the conductive resistance sheet, the conductive resistance sheet may be deleted, and one of the first plate and the second plate may be thinner than the other. In this case, any thickness may be greater than that of the conductive resistance sheet. In this case, any length may be greater than that of the conductive resistance sheet. With this configuration, it is possible to reduce the increase in heat transfer by deleting the conductive resistance sheet. Also, this configuration may reduce difficulty in coupling the first plate to the second plate.

At least a portion of the first plate and at least a portion of the second plate may be disposed to overlap each other. This is to provide a space for coupling the first plate to the second plate. An additional cover may be disposed on any one of the first plate and the second plate, which has a thin thickness. This is to protect the thin plate.

The vacuum adiabatic body may further include an exhaust port for discharging a gas in the vacuum space.

The vacuum adiabatic body may further include a decor disposed outside the conductive resistance sheet.

Here, the decor may be represented as a sealing frame 200 in FIGS. 8 to 24. The decor may be represented as a cover assembly 400 described in FIGS. 25 to 45.

Figure 8:
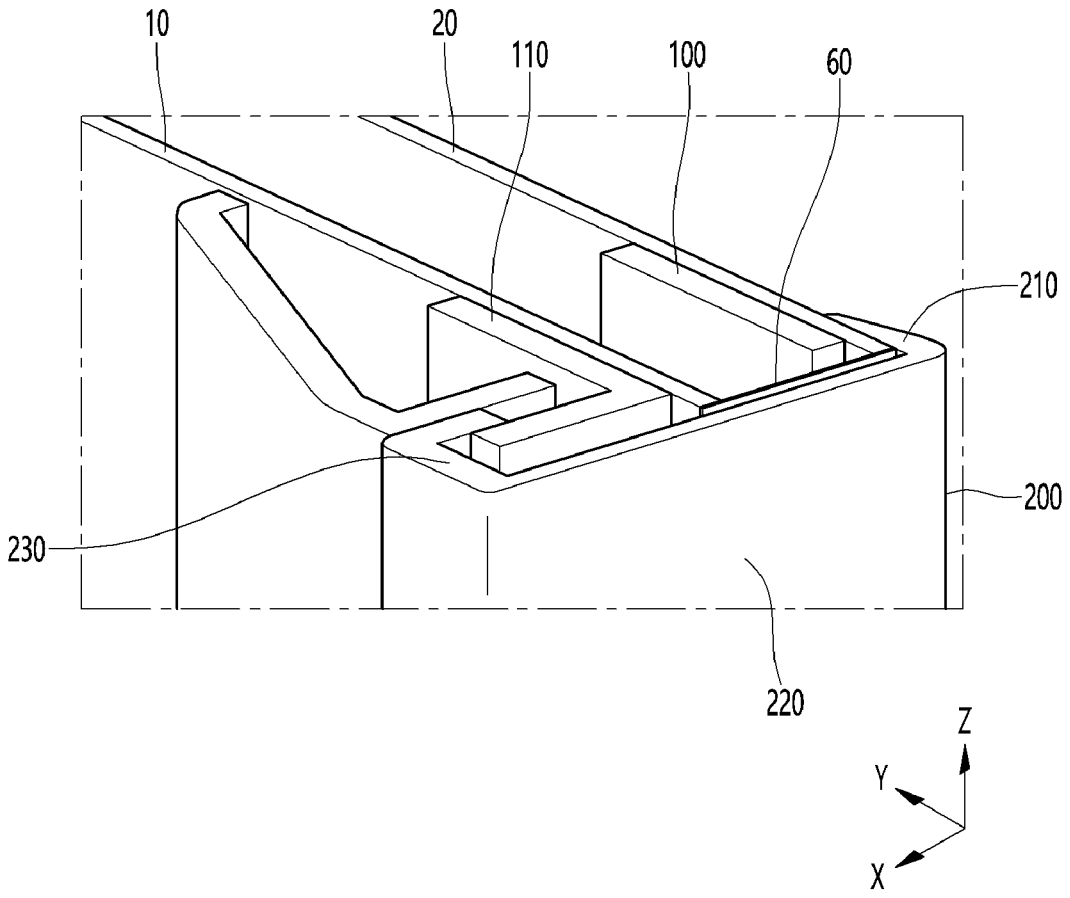
FIG. 8 is a cross-sectional perspective view of an edge of the vacuum adiabatic body.

FIG. 8 is a cross-sectional perspective view of an edge of the vacuum adiabatic body.

Referring to FIG. 8, a first plate 10, a second plate 20, and a conductive resistance sheet 60 are provided. The conductive resistance sheet 60 may be provided as a thin plate to resist to thermal conduction between the plates 10 and 20. Although the conductive resistance sheet 60 is provided in a flat plane shape as a thin plate, the conductive resistance sheet 60 may have a curved shape by being pulled inward when vacuum is applied to the vacuum space 50.

Since the conductive resistance sheet 60 has the thin plate shape and low strength, the conductive resistance sheet 60 may be damaged by even an external small impact. As a result, when the conductive resistance sheet 60 is damaged, the vacuum of the vacuum space may be broken, and thus, performance of the vacuum adiabatic body may not be properly exerted. To solve this limitation, a sealing frame 200 may be disposed on an outer surface of the conductive resistance sheet 60. According to the sealing frame 200, components of the door 3 or other components may not directly contact the conductive resistance sheet 60 but indirectly contact the conductive resistance sheet 60 through the sealing frame 200 to prevent the conductive resistance sheet 60 from being damaged. To allow the sealing frame 200 to prevent an impact from being applied to the conductive resistance sheet 60, the two portions may be spaced apart from each other, and a buffer may be interposed between the two portions.

To reinforce the strength of the vacuum adiabatic body, a reinforcement may be provided on each of the plates 10 and 20. For example, the reinforcement may include a first reinforcement 100 coupled to an edge of the second plate 10 and a second reinforcement 110 coupled to an edge of the first plate 10. To improve the strength of the vacuum adiabatic body, a portion having a thickness and strength greater than that of the plate 10 may be applied to the reinforcements 100 and 110. The first reinforcement 100 may be provided in an inner space of the vacuum space 50, and the second reinforcement 110 may be provided on an inner surface of the main body 2.

The conductive resistance sheet 60 may not contact the reinforcements 100 and 110. This is done because thermal conductive resistance characteristics generated in the conductive resistance sheet 60 is destroyed by the reinforcements. That is to say, a width of a narrow heat bridge (heat bridge) that resists to the thermal conduction is greatly expanded by the reinforcement, and the narrow heat bridge characteristics are destroyed.

Since the width of the inner space of the vacuum space 50 is narrow, the first reinforcement 100 may be provided in a flat plate shape in cross-section. The second reinforcement 110 provided on the inner surface of the main body 2 may be provided in a shape of which a cross-section is bent.

The sealing frame 200 may include an inner surface 230 disposed in the inner space of the main body 2 and supported by the first plate 10, an outer surface 210 disposed in the external space of the main body 2 and supported by the second plate 20, and a side surface 220 disposed on a side surface of the edge of the vacuum adiabatic body constituting the main body 2 to cover the conductive resistance sheet 60 and connect the inner surface 230 to the outer surface 210.

The sealing frame 200 may be made of a resin material that is slightly deformable. A mounted position of the sealing frame 200 may be maintained by an interaction between the inner surface 230 and the outer surface 210, i.e., by a holding operation. That is to say, the set position may not be separated.

The position fixing of the sealing frame 200 will be described in detail.

First, movement of the plates 10 and 20 in the extension direction (a y-axis direction in FIG. 8) on the plane may be fixed by being supported by the inner surface 230 by being hooked on the second reinforcement 110. In more detail, the sealing frame 200 may move out of the vacuum adiabatic body by interfering with the inner surface 230 of the second reinforcement 110. On the other hand, the movement of the sealing frame 200 to the inside of the vacuum adiabatic body may be interrupted by at least one operation of a first operation in which the inner surface 230 is hooked to be supported by the second reinforcement 110 (this operation may act in both directions in addition to elastic restoring force of the sealing frame made of a resin), a second operation in which the side surface 220 is stopped with respect to the plate 10, or a third operation in which the inner surface 230 prevents the first plate 10 from moving in the y-axis direction.

The movement of the sealing frame 200 in the vertical extension direction (an x-axis direction in FIG. 8) with respect to the cross-section of the plates 10 and 20 may be fixed by hooking and supporting the outer surface 210 to the second plate 20. In the auxiliary operation, the movement of the sealing frame 200 in the x-axis direction may be interrupted by the operation of hooking the second reinforcement 110 and the folding operation.

The movement of the sealing frame 200 in the extension direction (a z-axis direction in FIG. 8) may be stopped by at least one of a first operation in which the inner surface 230 of one sealing frame 200 contacts the inner surface of the other sealing frame 200 or a second operation in which the inner surface 230 of one sealing frame 200 contacts a mullion 300.

Figure 9:
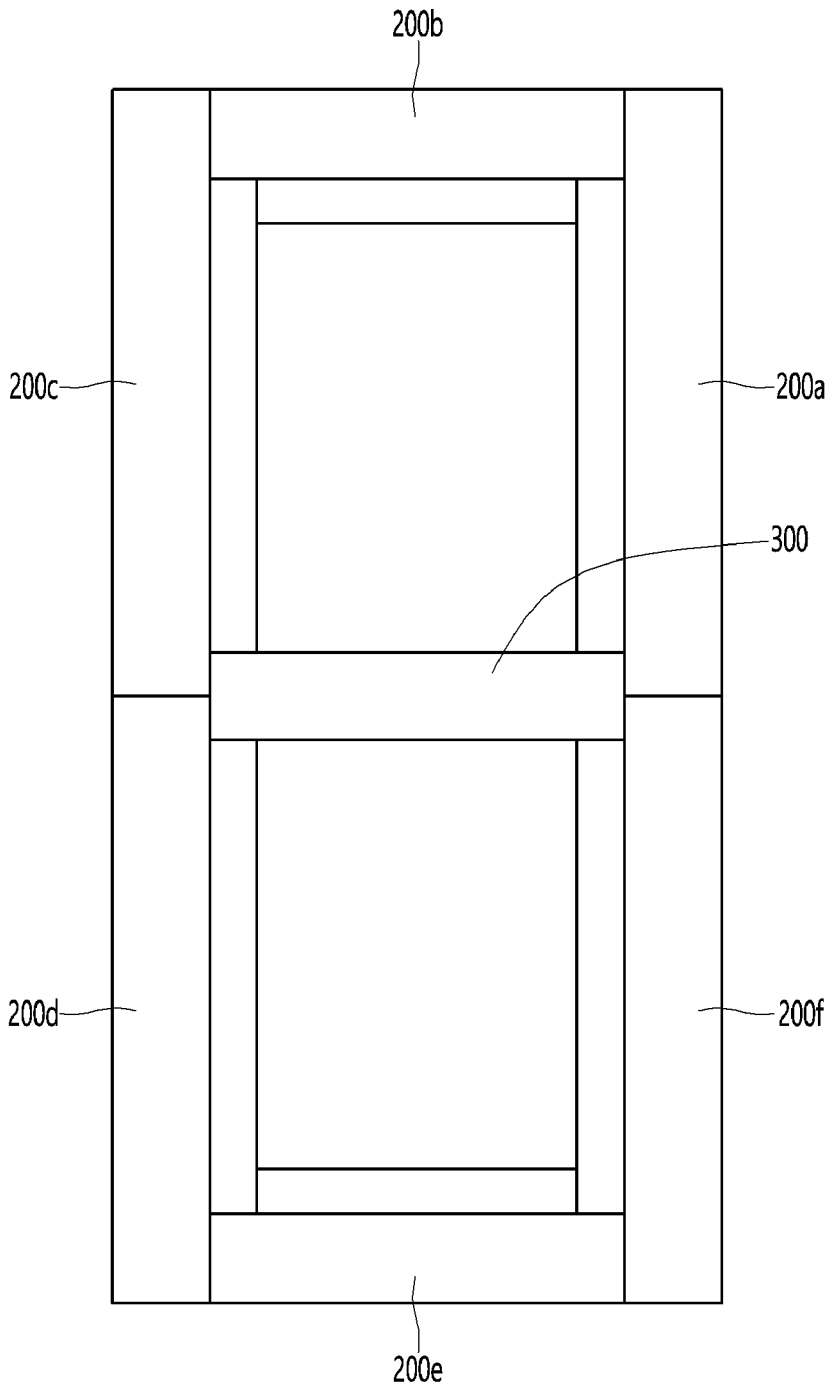
FIGS. 9 and 10 are schematic front views of the main body in a virtual state in which an inner surface is spread.
Figure 10:
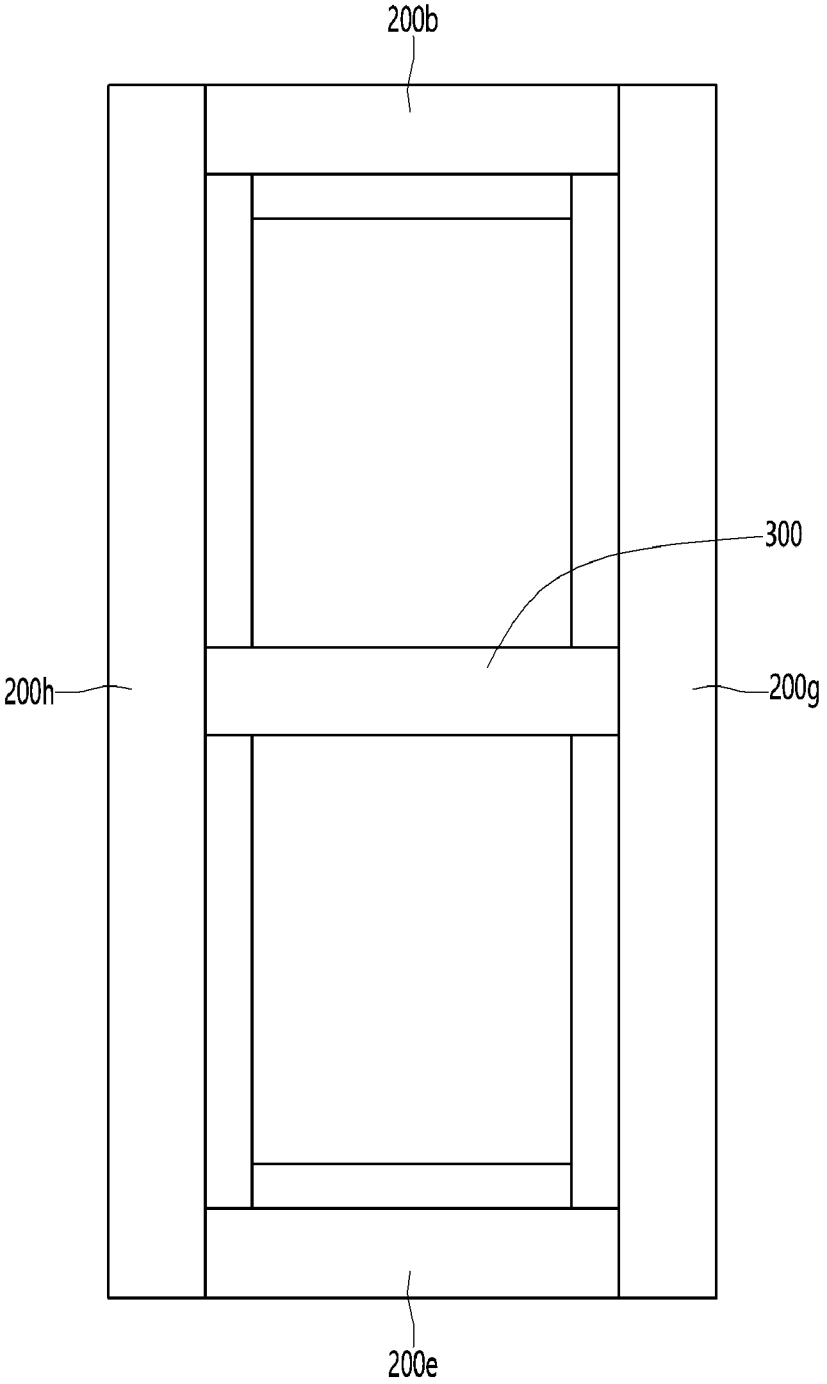

FIGS. 9 and 10 are schematic views of the main body when viewed from the front side. In the drawings, it should be noted that the sealing frame 200 shows a virtual state in which the inner surface 230 is spread in a direction parallel to the side surface 220.

Referring to FIGS. 9 and 10, the sealing frame 200 may include portions 200*b* and 200*e* that respectively seal upper and lower edges of the main body 2. The side edge of the main body 2 may be divided according to whether the spaces within the refrigerator, which are divided on the basis of the mullion 300, are separately (in FIG. 9) or integrally (in FIG. 10) sealed.

When the side edge of the main body 2 is separated as illustrated in FIG. 9, it may be divided into four sealing frames 200*a*, 200*c*, 200*d* and 200*f*. When the side edge of the main body 2 is integrally sealed as illustrated in FIG. 10, it may be divided into two sealing frames 200*g* and 200*c*.

When the side edge of the main body 2 is sealed with the two sealing frames 200*g* and 200*c* as illustrated in FIG. 10, since two coupling operations may be required, the fabrication may be facilitated. However, it is necessary to cope with such a limitation because there is a risk of a loss of cool air.

In the case of sealing the side edge of the main body 2 with the four sealing frames 200*a*, 200*c*, 200*d* and 200*f* as illustrated in FIG. 9, four coupling operations may be required, and thus, the fabrication may be inconvenient. However, the thermal conduction may be interrupted to reduce the heat transfer between the separated storage rooms, thereby reducing the loss of the cool air.

The embodiment of the vacuum adiabatic body illustrated in FIG. 8 may be preferably exemplify the vacuum adiabatic body on the main body. However, it does not exclude that it is provided to the door-side vacuum adiabatic body. Since a gasket is installed on the door 3, the sealing frame 200 may be disposed on the main body-side vacuum adiabatic body. In this case, the side surface 220 of the sealing frame 200 may further have an advantage that the gasket provides a sufficient width for the contact.

In more detail, since the width of the side surface 220 is greater than the adiabatic thickness of the vacuum adiabatic body, that is, the width of the vacuum adiabatic body, an adiabatic width of the gasket may be provided at a sufficiently wide width. For example, when the adiabatic thickness of the vacuum adiabatic body is about 10 mm, there is an advantage that the storage space of the refrigerator is enlarged by providing a large storage space in the cavity. However, there is a problem that the gap of about 10 mm does not provide a sufficient gap for the contact of the gasket. In this case, since the side surface 220 provides a wide gap corresponding to the contact area of the gasket, it is possible to effectively prevent the cool air from being lost through the contact interval between the main body 2 and the door 3. That is, when the contact width of the gasket is about 20 mm, even though the width of the side surface 220 may be about 20 mm or more, the side surface 220 may have a width about 20 mm or more to corresponding to the contact width of the gasket.

It may be understood that the sealing frame 200 performs the shielding of the conductive resistance sheet and the sealing function to prevent the cool air from being lost.

Figure 11:
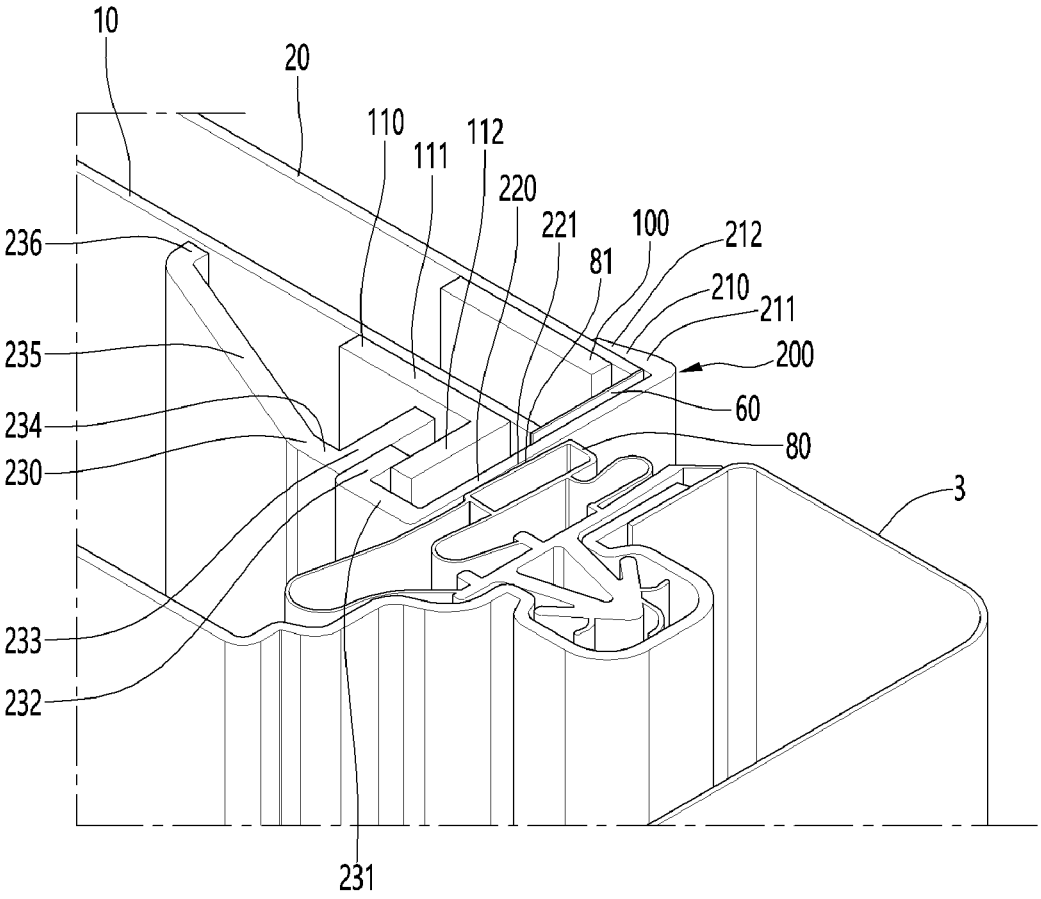
FIG. 11 is a cross-sectional view of a contact portion in a state in which the main body is closed by the door.

FIG. 11 is a cross-sectional view of a contact portion in a state in which the main body is closed by the door.

Referring to FIG. 11, the gasket 80 is disposed between the main body 2 and the door 3. The gasket 80 may be coupled to the door 3 and provided as a portion that is made of a soft deformable material. The gasket 80 includes a magnet as one component. When the magnet approaches by pulling a magnetic body (i.e., a magnetic body of an edge of the main body), a contact surface between the main body 2 and the door 3 may be blocked by the sealing surface having a predetermined width due to the smooth deformation of the gasket 80.

In detail, when a gasket sealing surface 81 of the gasket contacts the side surface 220, a sealing surface 221 of the side surface having a sufficient width may be provided. The sealing surface 221 of the side surface may be defined as a contact surface on the side surface 220 which is in contact with the gasket sealing surface 81 when the gasket 80 contacts the side surface 220.

Thus, it is possible to secure the sealing surfaces 81 and 221 having a sufficient area irrespective of the adiabatic thickness of the vacuum adiabatic body. This is because even if the adiabatic thickness of the vacuum adiabatic body is narrow, and the adiabatic thickness of the vacuum adiabatic body is narrower than the gasket sealing surface 81, if the width of the side surface 220 increases, the sealing surface 221 of the side surface having the sufficient width may be obtained. In addition, the sealing surfaces 81 and 221 having the sufficient area may be ensured irrespective of the deformation of the portion, which may affect the deformation of the contact surface between the main body and the door. This is because it is possible to provide a predetermined clearance in and out of the side surface sealing surface 221 in designing the side surface 220 so that even if the slight deformation occurs between the sealing surfaces 81 and 221, the width and area may be maintained.

In the sealing frame 200, the outer surface 210, the side surface 220, and the inner surface 230 may be provided, and their set positions may be maintained. Briefly, the outer surface 210 and the inner surface 230 may be provided in a shape, i.e., a recessed groove shape that is capable of holding end of the vacuum adiabatic body, more particularly, the plates 10 and 20. Here, it may be understood that the recessed groove has a configuration of a recessed groove as a constitution in which a width between the ends of the outer surface 210 and the inner surface 230 is less than the width of the side surface 220.

The coupling of the sealing frame 200 will be briefly described. First, the side surface 220 and the outer surface 210 rotate in the direction of the second plate 20 in a state in which the inner surface 230 is hooked with the second reinforcement 110. Thus, the sealing frame 200 is elastically deformed, and the outer surface 210 may move inward along the outer surface of the second plate 20 to complete the coupling. When the coupling of the sealing frame is completed, the sealing frame may return to its original shape before being deformed. When the coupling is completed, the installation position may be maintained as described above.

Detailed configuration and operation of the sealing frame 200 will be described.

The outer surface 210 is provided with an extension 211 that extends to the outside of the refrigerator (hereinafter, referred to as an outward extension), which extends inward from an end of the second plate 20 and a contact portion 212 outside the refrigerator (hereinafter, referred to as an outside contact portion), which contacts the outer surface of the second plate 20 at an end of the outside extension 211.

The outward extension 211 may have a predetermined length to prevent the outer surface 210 from being separated by external weak force. That is to say, even though the outer surface 210 is forced to be pulled toward the door due to carelessness of the user, the outer surface 210 may not be completely separated from the second plate 20. However, if it is excessively long, there is difficulty in intentional removal at the time of repair, and it is preferable that the length is limited to a predetermined length because the coupling operation becomes difficult.

The outside contact portion 212 may be provided with a structure in which an end of the outside extension 211 is slightly bent toward the outer surface of the second plate 20. Thus, the sealing due to the contact between the outer surface 210 and the second plate 20 may be completed to prevent foreign substances from being introduced.

The side surface 220 is bent at an angle of about 90 degrees from the outer surface 210 toward the opening of the main body 2 and is provided with a width enough to secure the sufficient width of the side surface sealing surface 221. The side surface 220 may be provided thinner than the inner surface 210 and the outer surface 230. This is for the purpose of permitting the elastic deformation at the time of coupling or removing the sealing frame 200 and the purpose of not permitting a distance to cause magnetic force between the magnet disposed on the gasket 80 and the magnetic body on the side of the main body so that the magnetic force is weakened. The side surface 220 may have a purpose of protecting the conductive resistance sheet 60 and arranging an outer appearance as an exposed portion of the outside. When the adiabatic portion is provided inside the side surface 220, the adiabatic performance of the conductive resistance sheet 60 may be reinforced.

The inner surface 230 extends from the side surface 220 in the direction of the inside of the refrigerator, that is, in the rear surface direction of the main body, at about 90 degrees. The inner surface 230 may perform an operation for fixing the sealing frame 200, an operation for installing components that are necessary for operation of a product to which the vacuum adiabatic body is installed, such as a refrigerator, and an operation for preventing an external inflow of foreign substances.

The operation corresponding to each constituent of the inner surface 230 will be described.

The inner surface 230 is provided with an extension 231 that extends to inside of the refrigerator (hereinafter, referred to as an inward extension), which is bent from an inner end of the side surface 220 to extend and a first portion coupling portion 232 bent from an inner end of the inward extension 231, i.e., toward the inner surface of the first plate 10. The first portion coupling portion 232 may contact a protrusion 112 of the second reinforcement 110 so as to be hooked. The inward extension 231 may provide an interval extending toward the inside of the refrigerator so that the first portion coupling portion 232 is hooked with the inside of the second reinforcement 110.

Since the first portion coupling portion 232 is hooked with the second reinforcement 110, the supporting operation of the sealing frame 200 may be realized. The second reinforcement 110 may further include a base 111 coupled to the first plate 10 and a protrusion 112 bent and extending from the base 111. An inertia moment of the second reinforcement 110 may increase by a structure of the base 111 and the protrusion 112 so that ability to resist the bending strength increases.

The first portion coupling portion 232 and the second portion coupling portion 233 may be coupled to each other. The first and second portion coupling portions 232 and 233 may be provided as separate portions to be coupled to each other or may be provided as a single portion from the design stage.

A gas formation portion 234 that further extends from the inner end of the second portion coupling portion 233 to the inside of the refrigerator may be further provided. The gap formation portion 234 may serve as a portion for providing an interval or space in which components necessary for operation of the appliance such as the refrigerator provided with the vacuum adiabatic body are disposed.

An inclined portion 235 that is inclined to the inside of the refrigerator (hereinafter, referred to as an inward inclined portion) is further provided. The inward inclined portion 235 may be provided so as to be inclined toward the end, that is, toward the first plate 10 toward the inside of the refrigerator. The inward inclined portion 235 may be provided so that a gap between the sealing frame and the first plate becomes smaller inward. Thus, it is possible to secure a space for mounting a component such as a lamp by cooperation with the gap forming portion 234 while minimizing the volume occupying the inner space of the sealing frame 200 as much as possible.

A contact portion 236 within the refrigerator (hereinafter, referred to as an inside contact portion) is disposed on an inner end of the inward inclined portion 235. The inside contact portion 236 may be provided with a structure in which an end of the inward inclined portion 235 is slightly bent toward the inner surface of the second plate 10. Thus, the sealing due to the contact between the inner surface 230 and the second plate 10 may be completed to prevent foreign substances from being introduced.

When an accessory component such as a lamp is installed on the inner surface 230, the inner surface 230 may be divided into two parts to achieve the purpose of the installation convenience of the component. For example, the inner surface 230 may be divided into a first portion for providing the inward extension 231 and the first portion coupling portion 232 and a second portion providing the second portion coupling portion 233, the gap formation portion 234, the inward inclined portion 235, and inside contact portion 236. In a state in which a product such as the lamp is mounted on the second portion, the first portion and the second portion may be coupled to each other in such a manner that the second portion coupling portion 233 is coupled to the first portion coupling portion 232. Alternatively, it does not exclude that the inner surface 230 is provided in more various manners. For example, the inner surface 230 may be provided as a single portion.

Figure 12:
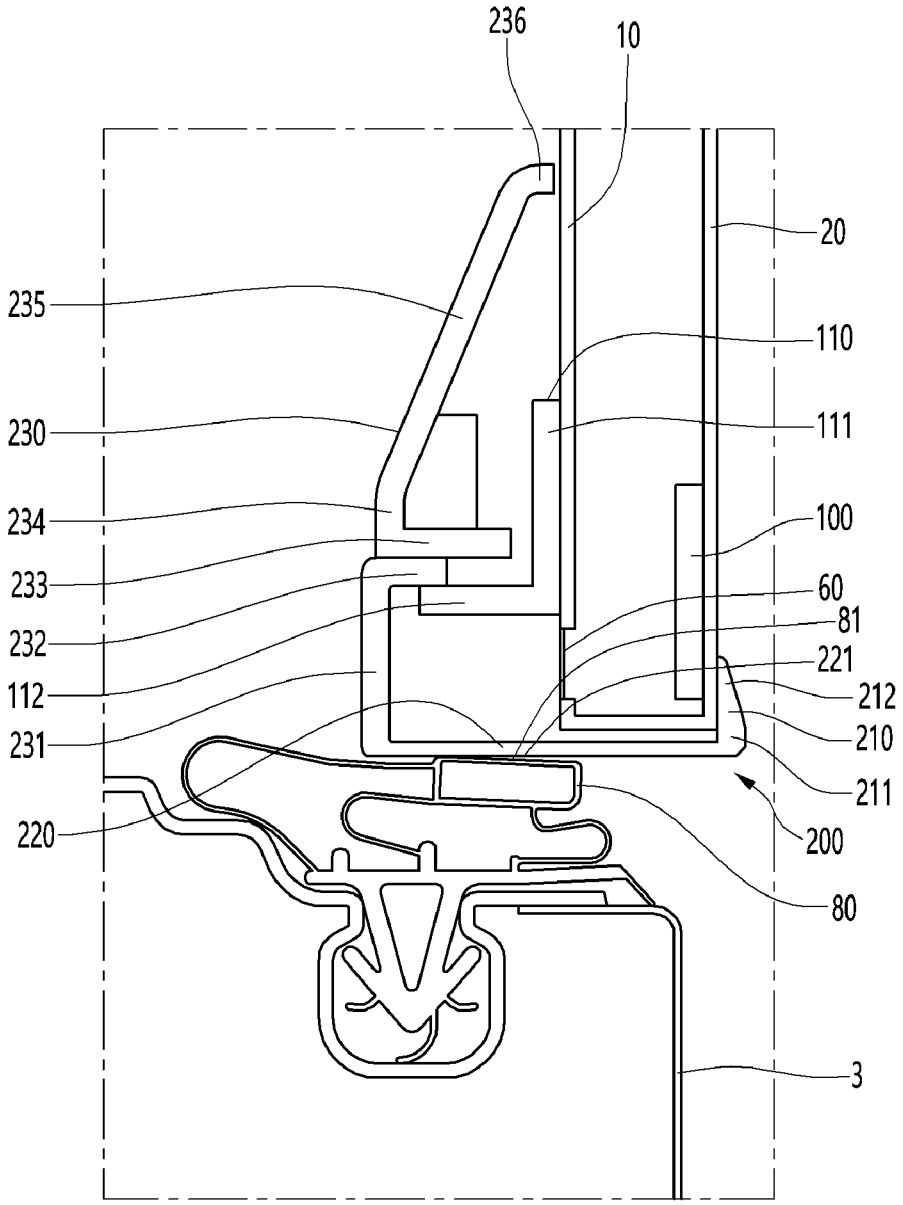
FIG. 12 is a cross-sectional view illustrating a contact portion of a main body and a door according to another embodiment.

FIG. 12 is a cross-sectional view illustrating a contact portion of a main body and a door according to another embodiment. This embodiment is characteristically different in the position of the conductive resistance sheet and accordingly the change of other portions.

Referring to FIG. 12, in this embodiment, the conductive resistance sheet 60 may be provided inside the refrigerator, but not provided on the edge of the end of the vacuum adiabatic body. The second plate 20 may extend over the outside of the refrigerator and the edge of the vacuum adiabatic body. In some cases, the second plate 20 may extend by a predetermined length up to the inside of the refrigerator. In this embodiment, it may be seen that a conductive resistance sheet is provided at a position similar to the conductive resistance sheet of the door-side vacuum adiabatic body illustrated in FIG. 4*b*.

In this case, the second reinforcement 110 may move to the inside of the refrigerator without contacting the conductive resistance sheet 60 in order not to affect the high thermal conductive adiabatic performance of the conductive resistance sheet 60. This is done for achieving a function of a heat bridge of the conductive resistance sheet. Thus, the conductive resistance sheet 60 and the second reinforcement 110 do not contact each other so that the conductive adiabatic performance by the conductive resistance sheet and the strength reinforcement performance of the vacuum adiabatic body by the reinforcement are achieved at the same time.

In this embodiment, it may be applied to the case in which perfect thermal protection and physical protection for the edge of the vacuum adiabatic body are required.

Figure 13:
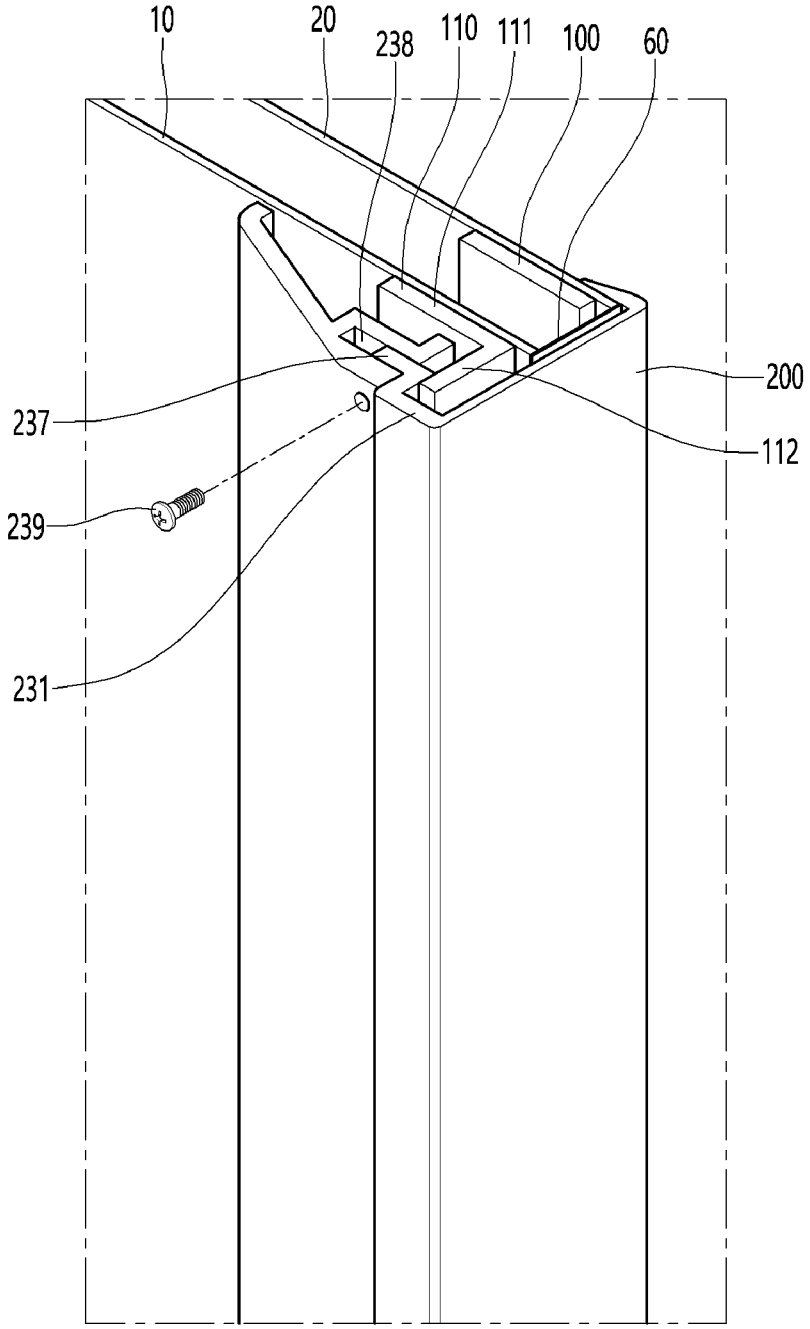
Figure 14:
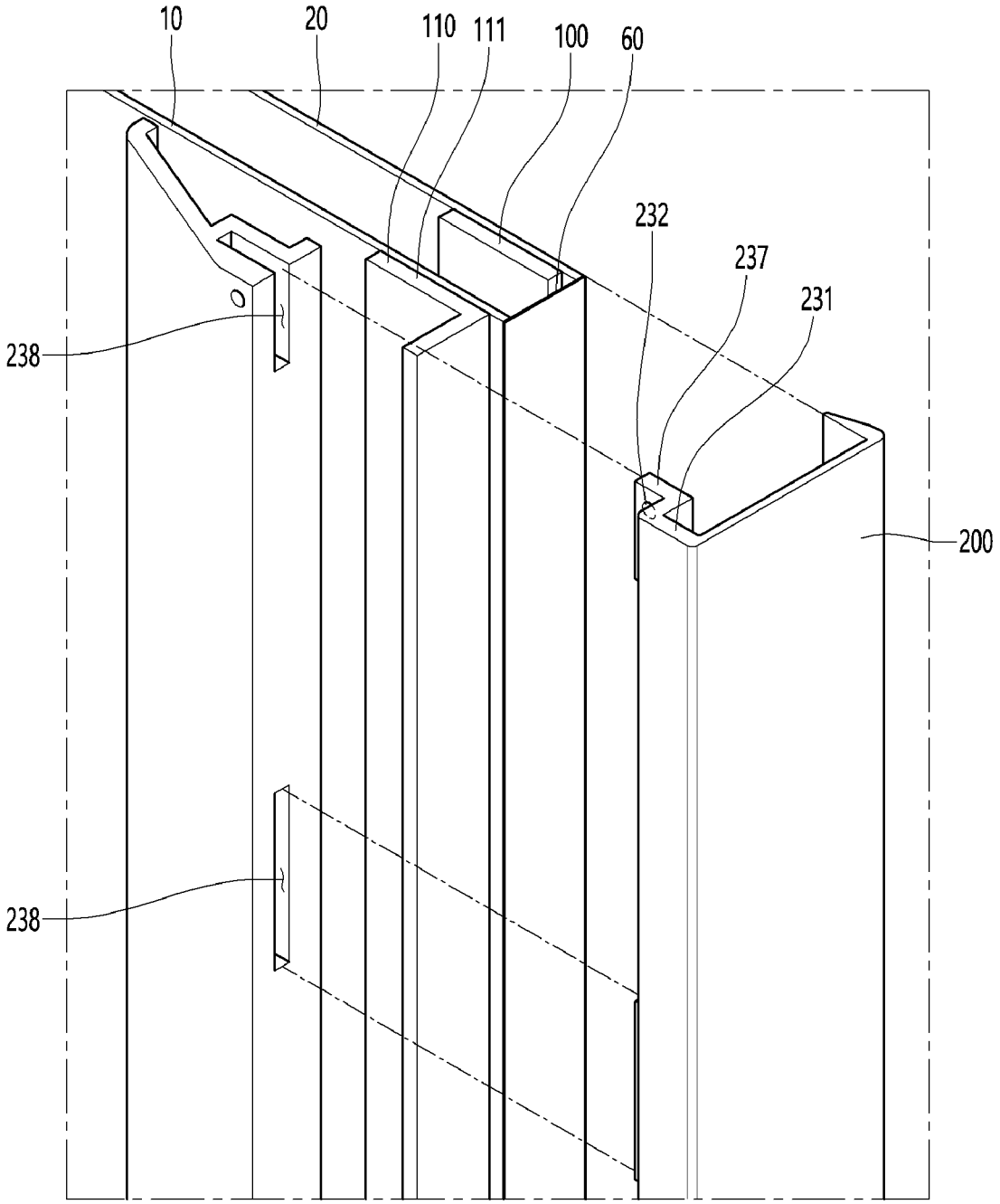

FIGS. 13 and 14 are partial cutaway perspective views illustrating the coupling of the two portions in the embodiment in which the inner surface is divided into two portions, wherein FIG. 13 is a state in which the coupling is completed, and FIG. 14 is a view illustrating the coupling process.

Referring to FIGS. 13 and 14, a first portion coupling portion 232 is hooked with a protrusion 112 of a second reinforcement 110, and an outer surface 210 is supported by a second plate 20. Thus, a sealing frame 200 may be fixed to an edge of the vacuum adiabatic body.

At least one or more first portion insertion portions 237 that is bent to extend to the inside of the refrigerator may be provided at ends of the first portion coupling portion 232. For example, at least one or more first portion insertion portions 237 may be provided for each sealing frame 200 installed in the refrigerator. A second portion insertion recess 238 may be provided in a position corresponding to the first portion insertion portion 237. The first portion insertion portion 237 and the second portion insertion recess 238 may be similar in size and shape to each other. Thus, the first portion insertion portion 237 may be inserted into the second portion insertion recess 238 and then be fitted and fixed.

The coupling of the first portion and the second portion will be described. In the state in which the first portion is coupled to the edge of the vacuum adiabatic body, the second portion may be aligned with respect to the first portion so that the second portion insertion recess 238 corresponds to the first portion insertion portion 237. When the first portion insertion portion 237 is inserted into the second portion insertion recess 238, the two portions may be coupled to each other.

To prevent the coupled second portion from being separated from the first portion, at least a portion of the second portion insertion recess 238 may have a size less than that of the first portion insertion portion 237. Thus, the two portions may be forcibly fitted. To perform an operation of being hooked and supported after the second portion insertion recess 238 and the first portion insertion portion 237 are inserted by a predetermined depth, a protrusion and a groove may be respectively provided on/in any point after the predetermined depth. Here, after the two portions are inserted at a certain depth, the two portions may be inserted further beyond the jaws to allow the two portions to be more firmly fixed. Here, the worker may feel that he/she is correctly inserted through the feeling.

The two portions constituting the inner surface may be fixed at the position and the coupling relation by the structure in which the two portion are inserted and coupled to each other. Alternatively, when a load is large due to the operation of the second portion that fixes a separator component, the first portion and the second portion may be coupled to each other by a separate coupling portion such as an inner coupling tool 239.

Figure 15:
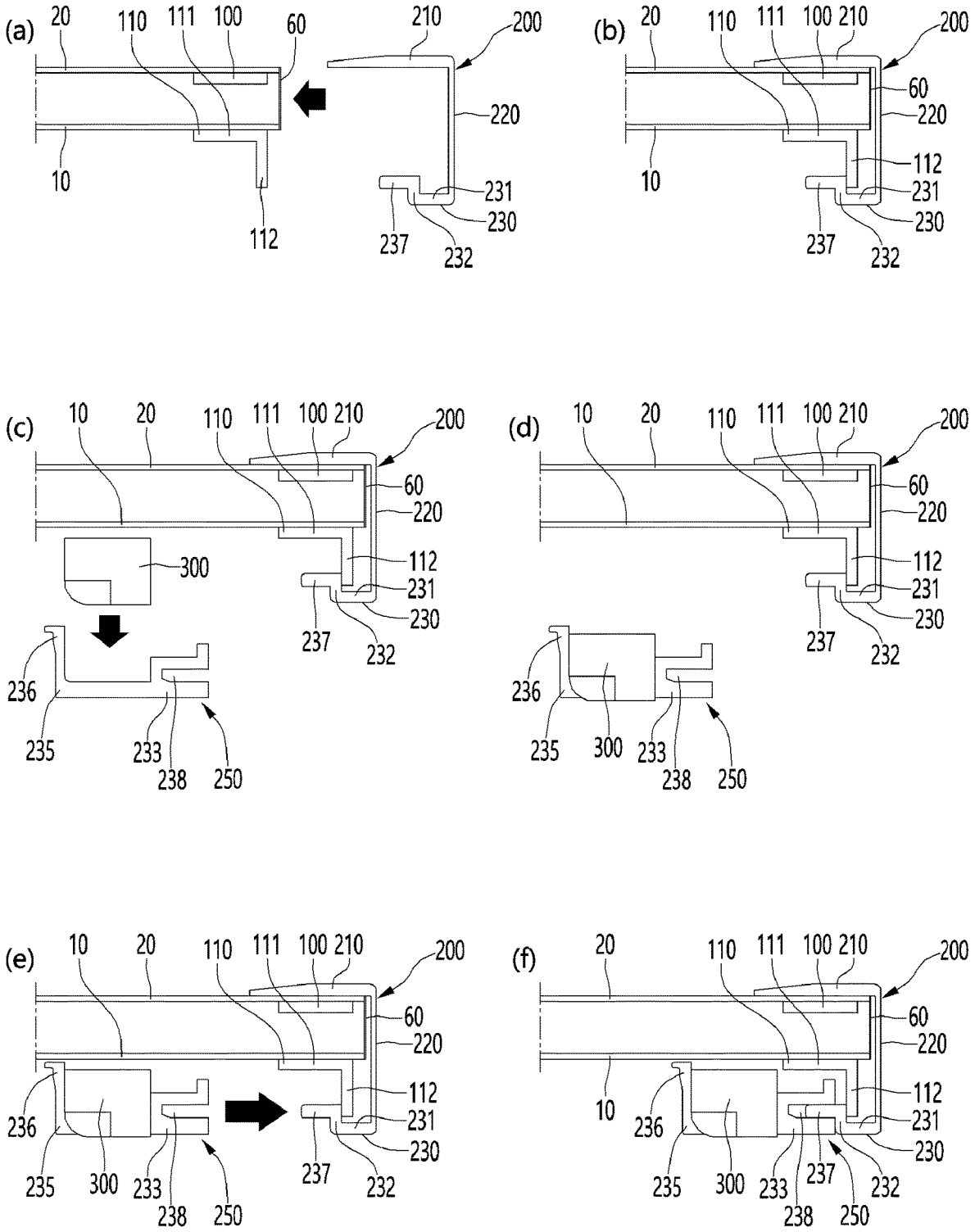
FIG. 15 is a view for sequentially explaining coupling of a sealing frame when the sealing frame is provided as two portions according to an embodiment.

FIG. 15 is a view for sequentially explaining coupling of the sealing frame when the sealing frame is provided in two portions according to an embodiment. Particularly, a case in which a component is installed on the inner surface will be described as an example.

Referring to FIG. 15(*a*), the sealing frame 200 is coupled to the edge of the vacuum adiabatic body. Here, the coupling may be performed by using elastic deformation of the sealing frame 200 and restoring force due to the elastic deformation without a separate portion such as a screw.

For example, in the state in which the inner surface 230 is hooked with the second reinforcement 110, the side surface 220 and the outer surface 210 rotate in the direction of the second plate 20 by using a connection point between the inner surface 230 and the side surface 220 as a rotation center. This operation may cause elastic deformation of the side surface 220.

Thereafter, the outer surface 210 may move inward from the outer surface of the second plate 20 so that the elastic force of the side surface 220 acts on the outer surface 210 and thus lightly coupled. When the coupling of the sealing frame is completed, the sealing frame may be seated in its original position designed in its original shape designed.

Referring to FIG. 15(*b*), a state in which the first portion of the sealing frame 200 is completely coupled is shown. The side surface 220 may be formed with a thin thickness when compared to that of each of the outer surface 210 and the inner surface 230 so that the sealing frame 200 is coupled to the edge of the vacuum adiabatic body by the elastic deformation and the elastic restoring operation of the sealing frame.

Referring to FIG. 15(*c*), a component seating portion 250 as a separate component is provided as the second portion providing the inner surface 230. The component seating portion 250 may be a component on which the component 399 is placed so that its set position is supported, and an additional function that is necessary for the operation of the component 399 may be further performed. For example, in this embodiment, when the component 399 is the lamp, the gap formation portion 234 made of a transparent portion may be disposed on the component seating portion 250. Thus, light irradiated from the lamp may pass through the inner surface 230 and be irradiated into the refrigerator, and the user may identify the article in the refrigerator.

The component seating portion 250 may have a predetermined shape that is capable of being fitted with the component 399 to fix a position of the component 399.

FIG. 15(*d*) illustrates a state in which the component 399 is paced on the component seating portion 250.

Referring to FIG. 15(*e*), the component seating portion 250 on which the component 399 is seated is aligned in a predetermined direction so as to be coupled to the first portion providing the inner surface. In this embodiment, the first portion coupling portion 232 and the second portion insertion recess 238 may be aligned with each other in the extension direction so that the first portion coupling portion 232 is inserted into the second portion insertion recess 238. Alternatively, although not limited in this way, it may be advantageously proposed to enhance the ease of assembly.

To allow the first portion coupling portion 232 and the second portion insertion recess 238 to be forcibly fitted with respect to each other, the first portion coupling portion 232 may be slightly larger than the second portion insertion recess 238 and have a hook structure such as a protrusion and a projection so as to realize easy insertion.

Referring to FIG. 15(*f*), the inner surface in a completely assembled state is illustrated.

Figure 16:
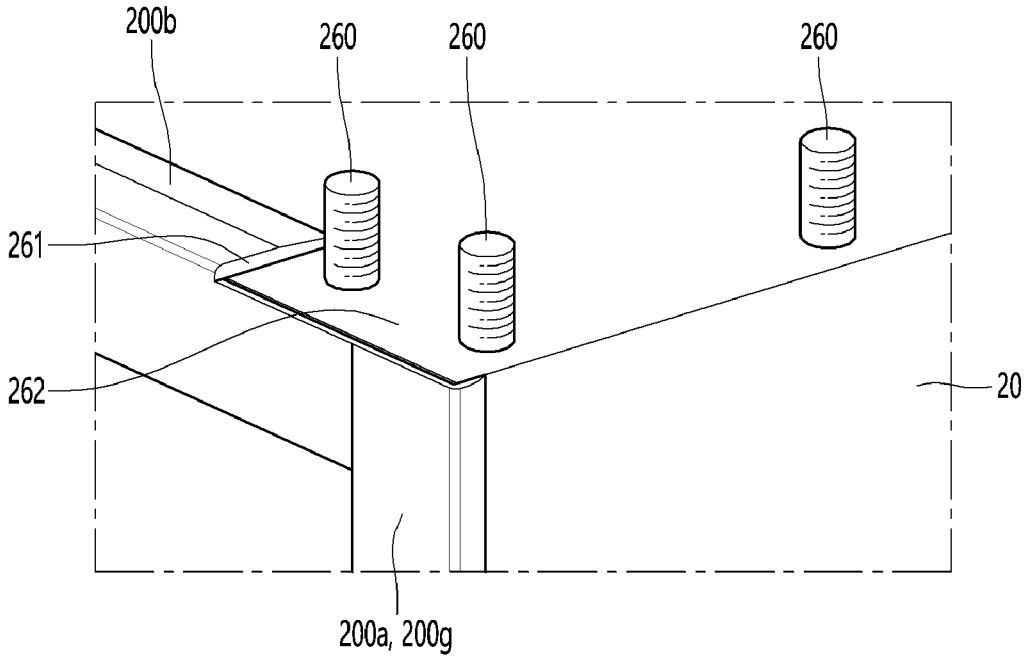
Figure 17:
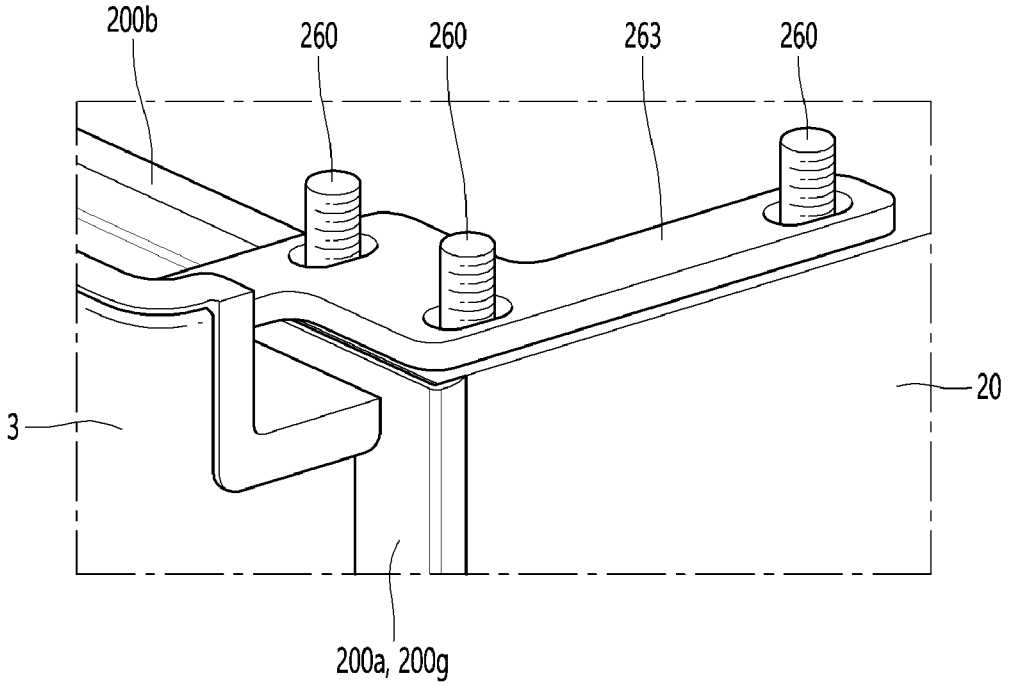

FIGS. 16 and 17 are views illustrating one end of the sealing frame, wherein FIG. 16 illustrates a state before a door hinge is installed, and FIG. 17 illustrates a state in which the door hinge is installed.

In the case of the refrigerator, a door hinge is provided at the connection so that the door-side vacuum adiabatic body is rotatably coupled to the main body-side vacuum adiabatic body. The door hinge has to have predetermined strength and also be capable of preventing drooping of the door due to its own weight in a state in which the door is coupled and preventing the main body from being twisted.

Referring to FIG. 16, to couple the door hinge 263, a door coupling tool 260 is provided on the main body-side vacuum adiabatic body. The door coupling tool 260 may be provided in three. The door coupling tool 260 may be directly or indirectly fixed to the second plate 20 and/or the reinforcements 100 and 110 and/or a separate additional reinforcement (for example, an additional plate further provided on the outer surface of the second plate). Here, the expression 'direct' may be referred to as a fusing method such as welding, and the expression 'indirect' may refer to a coupling method using an auxiliary coupling tool or the like instead of the fusion or the like.

Since the door coupling tool 260 requires high supporting strength, the door coupling tool 260 may be coupled to the second plate 20. For this, the sealing frame 200 may be cut, and the sealing frame 200 to be cut may be the upper sealing frame 200*b* at an upper edge of the main body-side vacuum adiabatic body. Also, the sealing frame 200 may include right sealing frames 200*a*, 200*f*, and 200*g* on a right edge of the main body-side vacuum adiabatic body, and a lower side sealing frame 200*e* on a lower edge of the main body-side vacuum adiabatic body. If the door installation direction is different, the left sealing frames 200*a*, 200*f*, and 200*g* at the left edge of the main body-side vacuum adiabatic body may be used.

The sealing frame 200 to be cut may have a cutoff surface 261, and the second plate 20 may have a door coupling tool seating surface 262 to which the door coupling tool 260 is coupled. Thus, the sealing frame 220 may be cut to be exposed to the outside of the door coupling tool seating surface 262, and an additional plate may be further inserted into the door coupling tool seating surface 262.

As described in the drawings, the end of the sealing frame 200 may not be entirely removed, but a portion of the sealing frame 200 may be removed only at a portion at which the door coupling tool 260 is provided. However, it may be more preferable that all the ends of the sealing frame 200 are removed to facilitate the fabrication and to allow the door hinge 263 to contact the vacuum adiabatic body so as to be firmly coupled to the vacuum adiabatic body.

Figure 18:
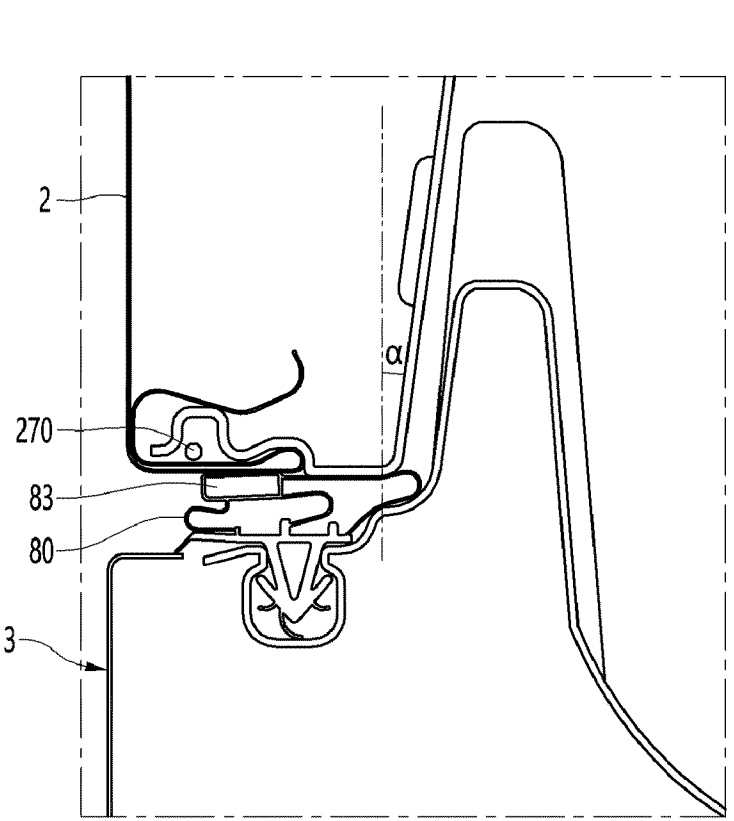
FIG. 18 is a view for explaining an effect of the sealing frame according to an embodiment in comparison with the technique according to the related art, wherein FIG. 18(*a*) is a cross-sectional view of a contact portion of a main body-side vacuum adiabatic body and a door according to an embodiment, and FIG. 18(*b*) is a cross-sectional view of a main body and a door according to the related art.
Figure 18:
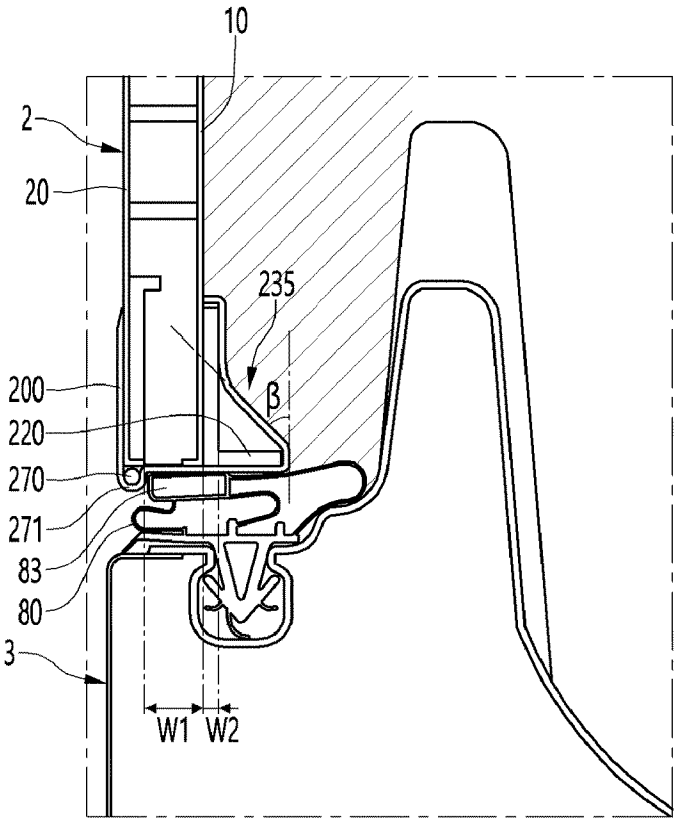

FIG. 18 is a view for explaining an effect of the sealing frame according to an embodiment in comparison with the technique according to the related art, wherein FIG. 18(*a*) is a cross-sectional view of the contact portion of the main body-side vacuum adiabatic body and the door according to an embodiment, and FIG. 18(*b*) is a cross-sectional view of the main body and the door according to the related art.

Referring to FIG. 18, in the refrigerator, a hot line may be provided at the contact portion between the door and the main body to prevent dew formation due to sharp temperature change. As the hot line is closer to the outer surface and the edge of the main body, the dew condensation may be removed even with small heat capacity.

According to an embodiment, the hot line 270 may be disposed in an inner space of a gap between the second plate 20 and the sealing frame 200. A hot line accommodation portion 271 in which the hot line 270 is disposed may be further provided in the sealing frame 200. Since the hot line 270 is placed outside the conductive resistance sheet 60, an amount of heat transferred to the inside of the refrigerator is small. Thus, the dew condensation on the main body and the door contact portion may be prevented by using smaller heat capacity. In addition, the hot line 270 may be disposed on a relative outside of the refrigerator, i.e., a bent portion between the edge of the main body and the outer surface of the main body to prevent heat from being introduced into the inner space of the refrigerator.

In this embodiment, the side surface 220 of the sealing frame 200 may have a portion w1 that is aligned with the gasket 80 and the vacuum space 50 and a portion w2 that is not aligned with the vacuum space 50 but aligned with the gasket 80 and the inner space of the refrigerator. This is a portion provided by the side surface 220 to ensure sufficient cool air interruption by the magnet. Thus, the sealing effect by the gasket 80 may be sufficiently achieved by the sealing frame 200.

In this embodiment, the inward inclined portion 235 is provided to be inclined toward the inner surface of the first plate 10 at a predetermined angle β. This makes it possible to give the effect in which the capacity within the refrigerator increases so that the narrow space within the refrigerator is more widely used. That is to say, like the related art, the inward inclined portion may be inclined to a direction opposite to the predetermined angle β toward the inner space of the refrigerator to widely utilize a space that is close to the door. For example, more foods may be accommodated in the door, and more space for accommodating various components that are necessary for operation of the device may be defined.

Hereinafter, various examples in which the sealing frame 200 is installed will be described with reference to FIGS. 19 to 24.

Figure 19:
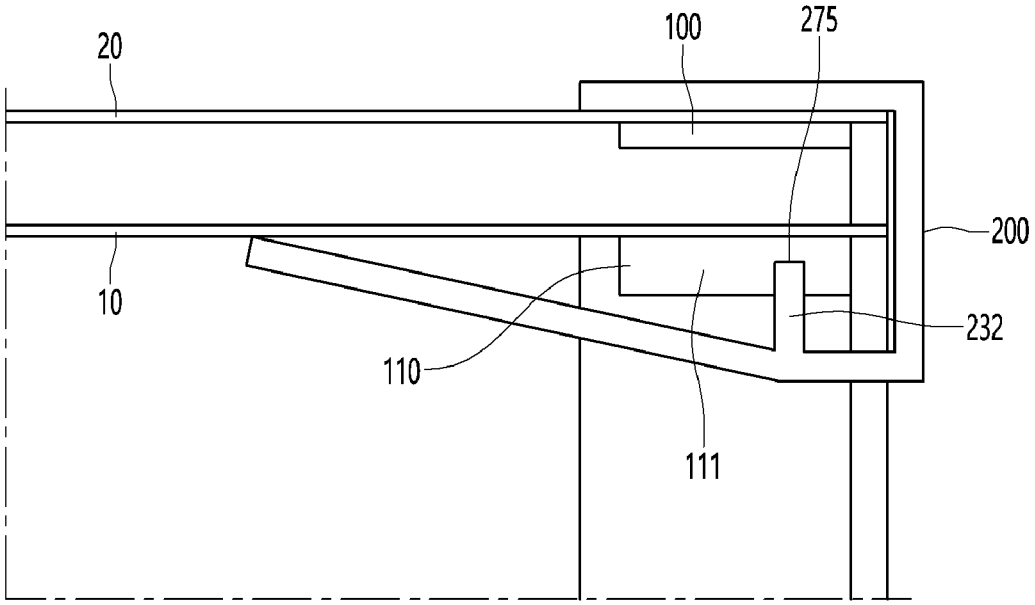
FIGS. 19 to 24 are views illustrating various examples in which the sealing frame is installed.

Referring to FIG. 19, the second reinforcement 110 may include only a base 111 but do not include a protrusion 112. In this case, a groove 275 may be provided in the base 111. An end of the first portion coupling portion 232 may be inserted into the groove 275. In this embodiment, it may be applied in a case of an article which provides sufficient strength without providing the protrusion 112 on the second reinforcement 110.

In this embodiment, the sealing frame 200 may be coupled to the end of the vacuum adiabatic body by aligning the first portion coupling portion 232 to be inserted into the groove 275 when the sealing frame 200 is coupled.

According to the coupling operation of the groove 275 and the first portion coupling portion 232, the movement of the sealing frame 200 in the y-axis direction may be stopped through only the coupling of the inner surface 230 of the sealing frame 200 and the second reinforcement 110.

Figure 20:
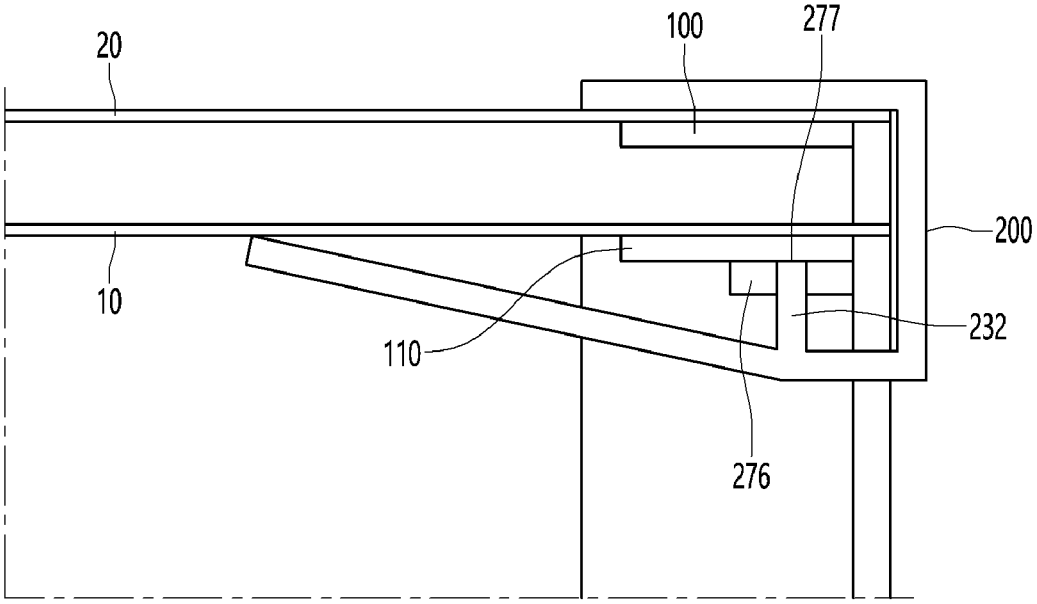

Referring to FIG. 20, this embodiment is different from the above-described embodiment of FIG. 19 except that the base 111 is further provided with a reinforcement base 276. A groove 277 may be further provided in the reinforcement base 276 so that an end of the first portion coupling portion 232 is inserted. In this embodiment, even though the second reinforcement 110 is not provided with the protrusion 112 because of an insufficient space or interference with the installation space, it may be applied when it is necessary to reinforce the strength to a predetermined level. That is to say, it may be applied when the strength reinforcement of the main body-side vacuum adiabatic body is provided at a level of strength reinforcement which is obtained by further providing a reinforcement base 276 at the outer end of the base 111.

A groove 277 is provided in the reinforcement base 276, and an end of the first portion coupling portion 232 is inserted into the groove part 277 to align the sealing frame 200 with the vacuum adiabatic body. Thus, the sealing frame 200 may be coupled to the end of the vacuum adiabatic body.

According to the coupling operation of the groove 277 and the first portion coupling portion 232, the movement of the sealing frame 200 in the y-axis direction may be stopped through only the coupling of the inner surface 230 of the sealing frame 200 and the second reinforcement 110.

Figure 21:
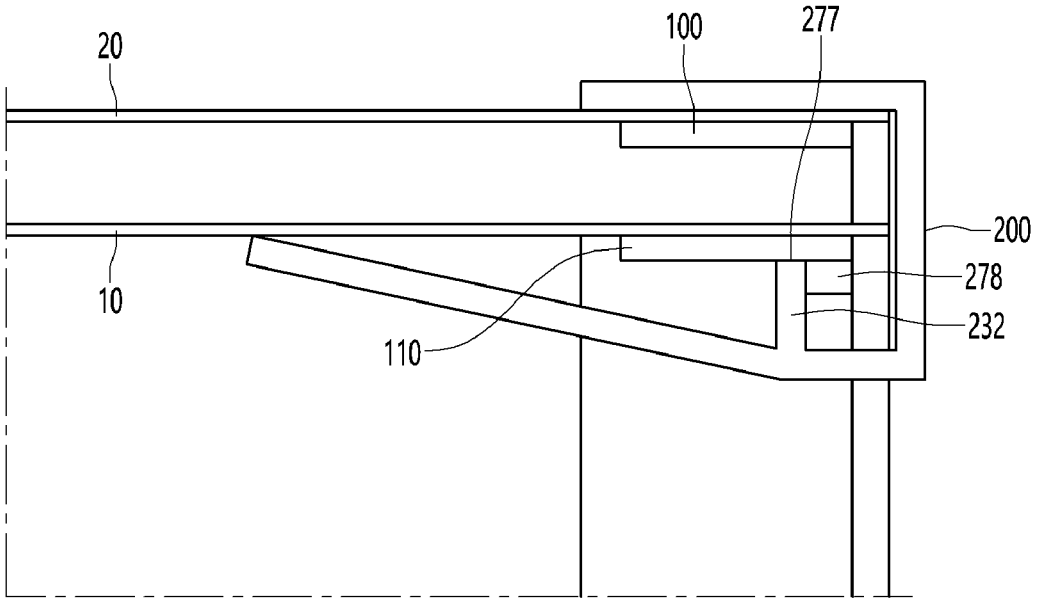

Referring to FIG. 21, this embodiment is different from the above-described embodiment of FIG. 19 except that the base 111 is further provided with a reinforcement protrusion 278. The end of the first portion coupling portion 232 may be hooked on the reinforcement protrusion 278. In this embodiment, even though the second reinforcement 110 is not provided with the protrusion 112 or the reinforcement base 276 because of an insufficient space or interference with the installation space, it may be applied when it is necessary to reinforce the strength to a predetermined level and to allow the first portion coupling portion 232 to be hooked. That is to say, the reinforcement protrusion 278 may be further disposed on an outer end of the base 111 to obtain a strength reinforcement effect of the main body-side vacuum adiabatic body. Also, the reinforcement protrusion 278 may be applied because it provides a hook operation of the first portion coupling portion 232.

The first portion coupling portion 232 may be hooked to be supported by the reinforcement protrusion 278 so that the sealing frame 200 is coupled to the end of the vacuum adiabatic body.

The embodiment proposed in FIGS. 19 to 21 illustrates a case in which the inner surface 230 is not dived into the first portion and the second portion but is provided as a single product to be coupled to the vacuum adiabatic body. However, this embodiment is not limited thereto. For example, the sealing frame 200 may be divided into the two portions.

Although the second reinforcement 110 is provided in the above embodiment, a case in which the sealing frame 200 is coupled when a separate reinforcement is not provided inside the first plate 10 will be described in the following embodiment.

Figure 22:
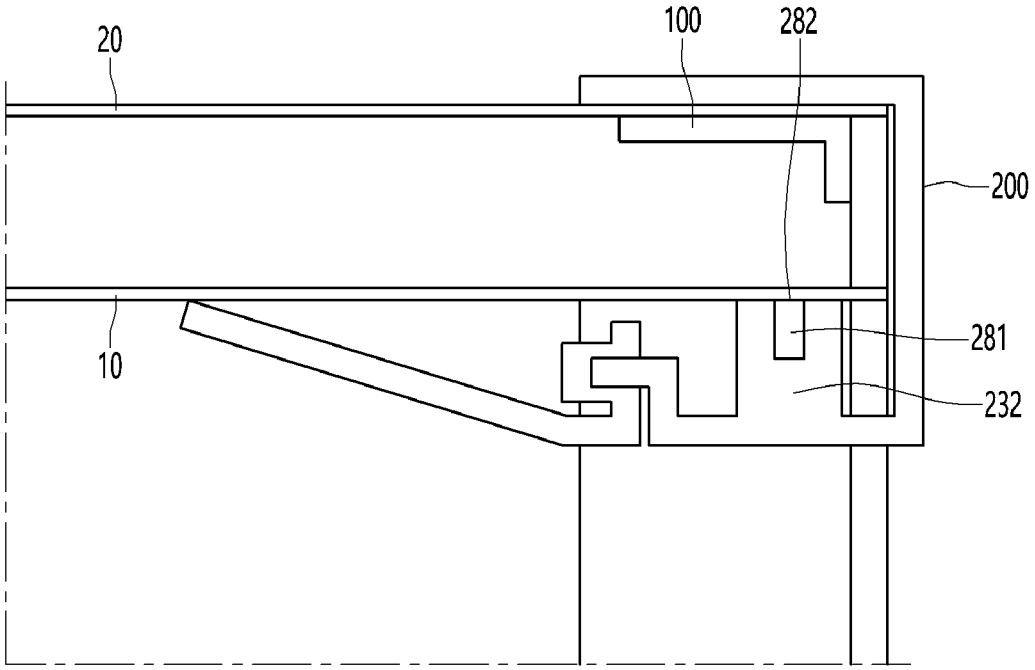

Referring to FIG. 22, although the first reinforcement 100 is provided to reinforce the strength of the vacuum adiabatic body, the second reinforcement 110 is not provided separately. In this case, an inner protrusion 281 may be provided on the inner surface of the first plate 10 so that the sealing frame 200 is coupled. The inner protrusion 281 may be coupled to the first plate 10 by welding or fitting. This embodiment may be applied to a case in which the sufficient strength of the main body-side vacuum adiabatic body is obtained only by the reinforcement provided in the first reinforcement 100, that is, the inside of the vacuum space 50, and the reinforcement is installed on a side of the second plate 20.

The first portion coupling groove 282 may be provided in the first portion coupling portion 232 so as to be inserted and fixed to the inner protrusion 281. The inner protrusion 281 may be inserted into the first portion coupling groove 282 so that a coupled position of the sealing frame 200 is fixed.

Figure 23:
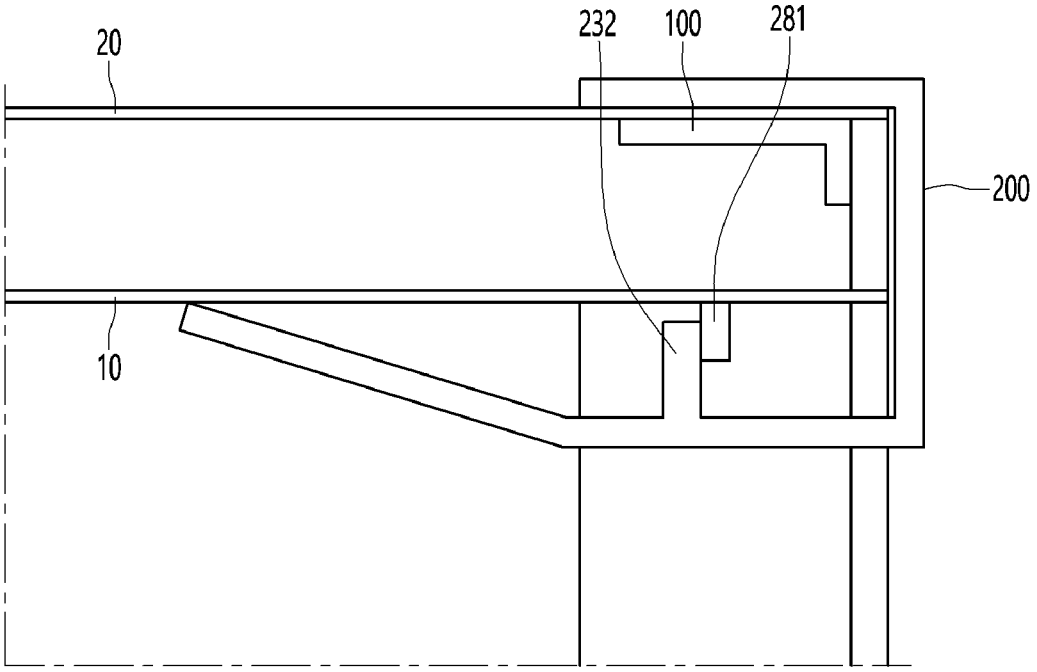

Referring to FIG. 23, it is characteristically different that the first portion coupling groove 282 is not provided as compared with the embodiment illustrated in FIG. 22. According to this embodiment, one end of the first portion coupling portion 232 may be supported by the inner protrusion 281 so that the position of the sealing frame 200 is supported.

When compared to the embodiment proposed in FIG. 22, this embodiment may have a disadvantage in that the movement of the sealing frame 200 is stopped in only one direction, instead that the movement of the sealing frame 200 in the y-axis direction is stopped by the inner protrusion 281 and the first portion coupling groove 282 in both directions. However, an advantage that the worker conveniently works when the sealing frame 200 is coupled may be expected.

In the embodiment proposed in FIGS. 19 to 23, a side of the first plate 10 is fixed, and a side of the second plate 20 is provided with a constituent in which the movement such as sliding or the like is allowed. That is to say, the second plate 20 and the outer surface 210 are allowed to be relatively slidable, and relative movement of the first plate 10 and the inner surface 230 is not allowed. Such the constituent may be configured opposite to each other. Hereinafter, such the constituent will be proposed.

Figure 24:
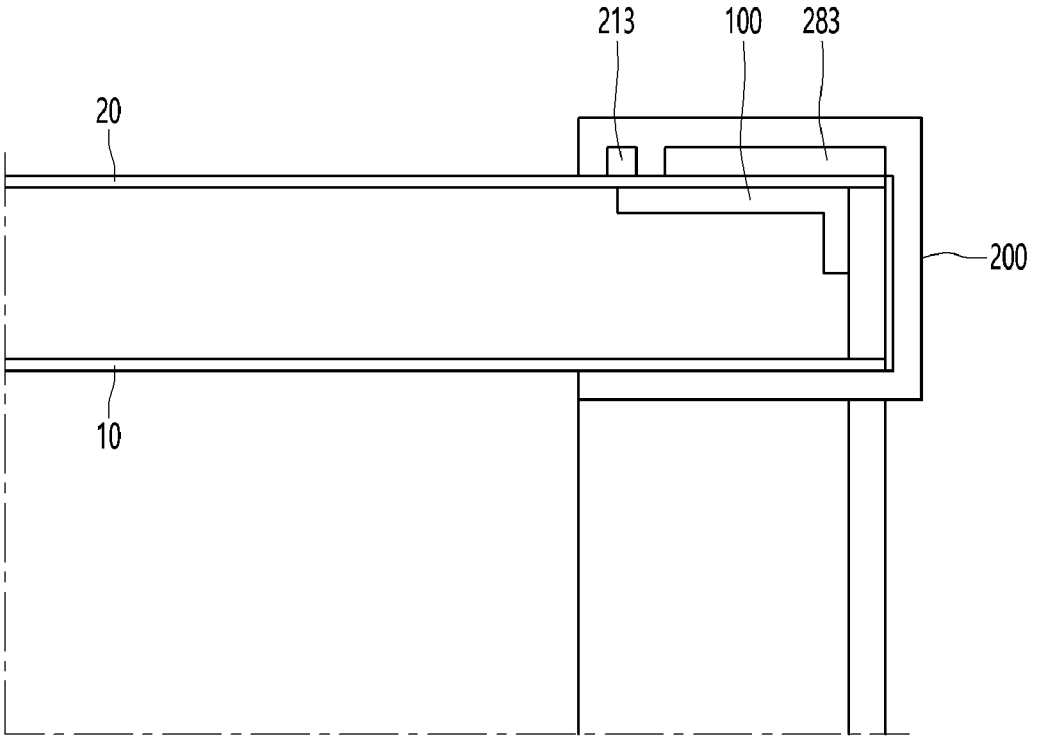

Referring to FIG. 24, an outer protrusion 283 may be provided on the outer surface of the second plate 20, and an outer hook 213 may be provided on the outer surface 210 of the sealing frame 200. The outer hook 213 may be hooked to be supported by the outer protrusion 283.

In case of this embodiment, the inner surface 230 of the sealing frame 200 may be allowed to move with respect to the inner surface of the first plate 10 such as the sliding or the like. In this embodiment, mounting and fixing of the sealing frame 200 are different only in the direction, and the same description may be applied.

Various embodiments may be further proposed in addition to the embodiment related to FIG. 24. For example, the reinforcement 100 and 110 may be further provided on the second plate 20, and various structures of FIGS. 19 to 21 may be provided for the reinforcement. Also, the outer hook 213 may be provided as a groove structure as illustrated in FIG. 22.

In the above embodiment, the sealing frame 200 is made of a resin and is coupled to the edge of the vacuum adiabatic body. When the sealing frame has sufficient strength and thickness, the sealing frame may act for strength reinforcement and protection. However, due to the nature of the resin material, deterioration of the product due to a long period of use, damage during handling, and interference with the resin material may cause a decrease in adhesion between the door magnet and the refrigerator body.

Examples for solving these limitations are described below.

In the following embodiment, since a portion corresponding to the sealing frame 200 is provided in a form in which at least two separate components are coupled, it may be referred to as a cover assembly.

Figure 25:
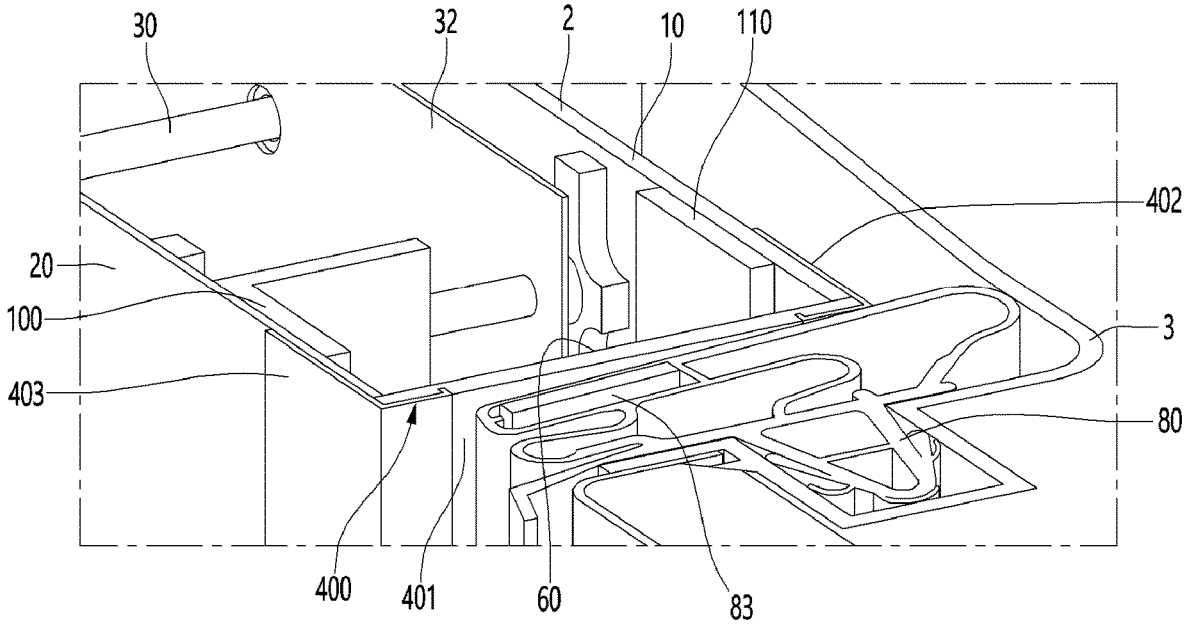
FIG. 25 is a cutaway perspective view illustrating a contact portion of a refrigerator and a door according to an embodiment.

FIG. 25 is a cutaway perspective view illustrating a contact portion of a refrigerator and a door according to an embodiment. Here, at least the main body uses a vacuum adiabatic body.

Referring to FIG. 25, the main body 2 and the door 3 are attached to each other. Here, attachment force of the two portions is generated by attraction force between a magnet 83 installed on a gasket 80 of the door 3 and a magnetic portion provided on the main body 2. It is preferable for a magnetic body such as iron to be provided at a position that is close to the magnet 83 to generate larger adhesion.

A cover assembly 400 is provided on an edge of the vacuum adiabatic body to obtain larger magnetism. The cover assembly may include a cover adiabatic material 401 provided at a position corresponding to a side surface of the sealing frame and made of a resin that is a nonmetal and arms 402 and 403 provided at positions corresponding to inner and outer surfaces of the sealing frame and made of a magnetic material such as iron.

Since attractive force acts in a narrow gap between the magnet 83 and the magnetic body disposed on the main body by the arms 402 and 403, adhesion between the door and the main body may increase. In this case, even if strength of the vibration adiabatic body increases by increasing in thickness of the cover adiabatic material 401, a decrease in adhesion may not occur.

The cover adiabatic material 401 may increase in thickness to protect the conductive resistance sheet 60 and perform an adiabatic operation to reduce a heat loss.

Since the arms 402 and 403 are made of a metal, there is no limitation such as breakage even if elastic deformation occurs when the cover adiabatic material 401 is mounted. When stainless is used as the material, even if it is used for a long time, damage and deterioration may not occur.

The arms 402 and 403 may protect an edge of the main body due to a thin and elastic configuration thereof when compared to other examples in which the arms are made of a resin.

The first reinforcement 100 and the second reinforcement 110 for reinforcing strength of the vacuum adiabatic body, the radiation resistance sheet 32 for reducing heat transfer, and the support 30 may be provided as the same as the original embodiment. Needless to say, other portions may be applied together between embodiments within a range in which the portions are not contradicted with each other.

Figure 26:
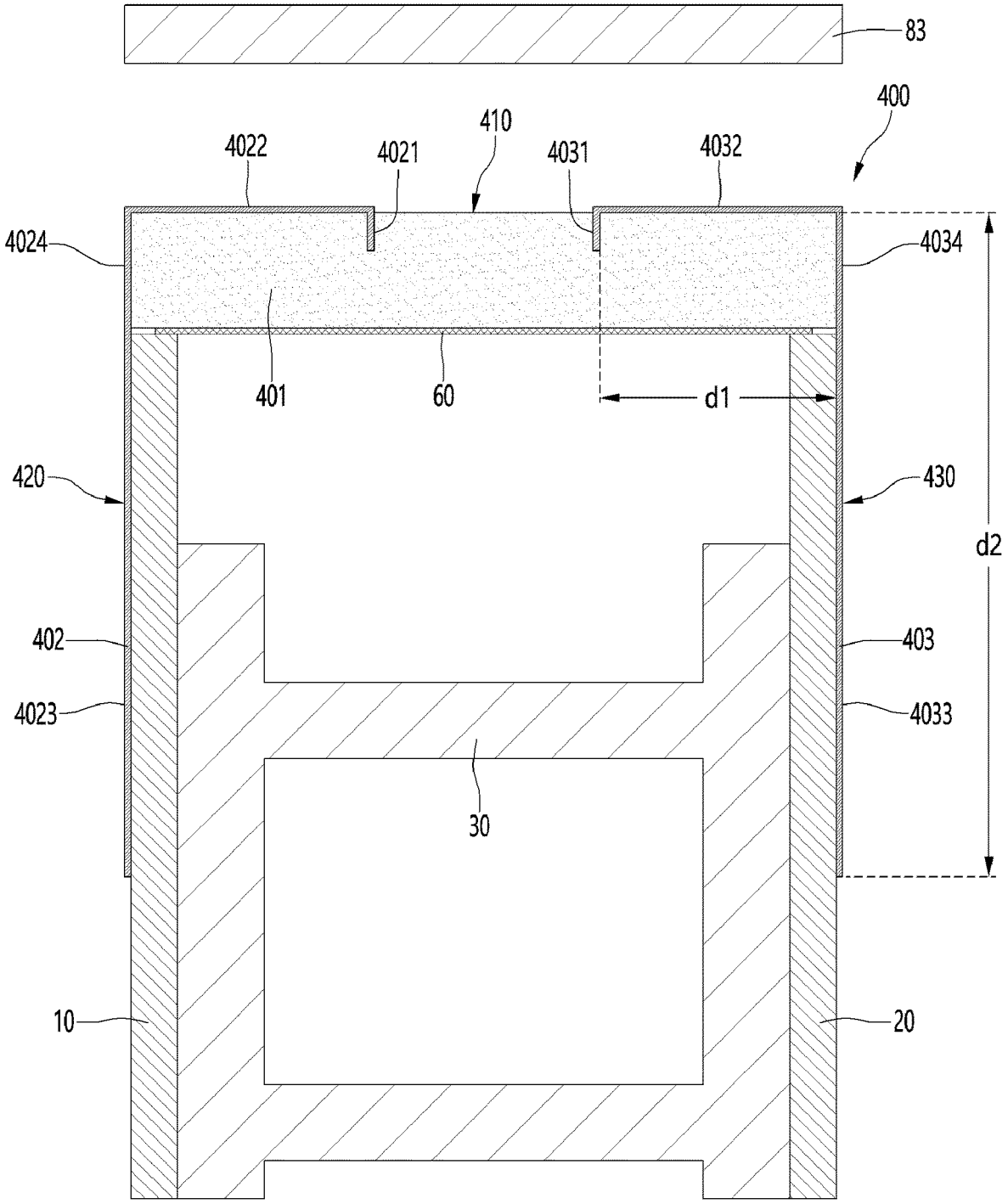
FIG. 26 is a cross-sectional view illustrating an edge of a vacuum adiabatic body to explain a cover assembly.

FIG. 26 is a cross-sectional view of the edge of the vacuum adiabatic body and may be displayed with its shape highlighted according to portions.

The configuration and operation of the cover assembly will be described in more detail with reference to FIG. 26. First, as described above, the cover assembly 400 is provided outside the conductive resistance sheet 60. The cover assembly 400 is provided with a cover adiabatic material 401 having a rectangular cross-section and made of a resin and an inner arm 402 and an outer arm 403, which are made of a magnetic material.

The inner arm 402 and the outer arm 402 may include coupling portions 4021 and 4031 coupled to the cover heat adiabatic material 401, shoulders extending along an outer surface of at least a portion of the cover heat adiabatic material 401, and arms 4023 and 4033 further extending along the plates 10 and 20.

Even if at least one of the inner arm or the outer arm is made of the resin material, it may be able to provide adhesion force to the magnet 83.

The coupling portions 4021 and 4031 and the cover adiabatic material 401 may be coupled to each other by various methods such as bonding, mechanical bonding, insert injection, and press-fitting. In an embodiment of FIG. 26, the insert injection method may be applied.

A length of each of the first shoulders 4022 and 4032 may be provided below about 25% of the total length of the cover adiabatic material so as not to affect an adiabatic effect of the cover adiabatic material. Each of the second shoulders 4024 and 4034 may be provided to about 20 mm or less for convenience of installation. The cover adiabatic material may have a thickness of about 3 mm or less.

When the cover assembly 400 is mounted on the vacuum adiabatic body, the arms 4023 and 4033 may perform an unfolding operation to a predetermined rotation angle. The arms 4023 and 4033 may hold the plates 10 and 20 to fix the position of the cover assembly 400. Here, the meaning of the holding may mean that the arm presses a surface of the plate with elastic force to increase in frictional force between contact surfaces, thereby preventing the arm from being separated.

The shoulders 4022, 4024, 4032, and 4034 are interposed between the arms 4023 and 4033 and the coupling portions 4021 and 4031 to assist the gripping of the arm and protect and reinforce the cover assembly 400. Particularly, portions to which the first shoulders 4022 and 4032 and the second shoulders 4024 and 4034 are connected may be portions that are vulnerable to an external impact, and thus a reinforcement effect by the protection of the metal material may be obtained. The connection portions 4021 and 4031, and the shoulders 4022, 4024, 4032, and 4034 may extend by bending their connecting portions.

The constituents of the cover assembly may be divided for each portion.

The cover assembly 400 may be divided into a front cover that further extends from the ends of the plates 10 and 20 to protect a front side of the vacuum adiabatic body 410 and inner and outer covers 420 and 430 that protect inner and outer sides at the end of the vacuum adiabatic body, respectively.

The front cover 410 may be disposed outside the conductive resistance sheet and be provided to have a thickness greater than the thickness of each of the plates 10 and 20. Accordingly, dew generated on the periphery of the conductive resistance sheet may be reduced.

A heat transfer amount of the cover assembly will be described. A heat transfer amount of each of the inner and outer covers 420 and 430 may be greater than an amount of heat transfer passing through the front cover 410. The reason is that the arms 402 and 403 with high conductivity are spaced apart from each other by the resin of the cover adiabatic material. Thus, the front cover 410 may perform an operation of reducing the heat transfer through the cover assembly.

To further reduce an amount of thermal conduction through the front cover 410 and increase in the structural stability of the mechanism structure, the thickness of each portion of the cover assembly may be proposed as follows.

First condition: conductive resistance sheet 60≤inner and outer covers 420 and 430, Second condition: inner and outer covers 420 and 430≤plates 10 and 20, Third condition: plates 10 and 20≤front cover 410, Fourth condition: inner and outer covers 420 and 430× 3≤front cover.

Accordingly, the amount of thermal conduction through the front cover 410 may be more reduced. As a result, the amount of heat transfer through the cover assembly together with structural reinforcement, that is, the amount of heat passing through the inside and outside may be further reduced.

On the other hand, to reinforce the structural strength of the vacuum adiabatic body and to further reliably block the vacuum leakage, the ends of the inner and outer arms 4023 and 4033 and the ends of the plates 10 and 20 are mutually welded to each other. The welded portion may be provided in a closed curve structure for sealing. Of course, if sealing is possible, other coupling methods may be applied in addition to the welding. Also, various methods such as the coupling and the like may be applied if the sealing is not strictly requested.

As described above, the door and the main body providing the refrigerator may be conveniently attached to each other by the magnet. For this, the front cover 410 may be placed on a position at which at least a portion of the magnet 83 overlaps, and a magnetic body may be disposed on at least a portion of the front cover 410 or at a front or rear side of the front cover 410.

Although the magnetic body is disposed at the front side in this embodiment, it is not limited thereto. For example, a portion of the arm that is the magnetic body may be disposed inside the front cover, a portion of the arm that is the magnetic body may be disposed on at least one surface of a front surface and a rear surface of the front cover, at least a portion of the plate that is the magnetic body may be disposed behind the front cover, or at least a portion of the conductive resistance sheet that is made of a magnetic material may be disposed behind the front cover.

The front cover 410 and the inner and outer covers 420 and 430 may be provided to have conditions of strength, yield strength, and elastic modulus as follows so that the edge of the cover assembly and the vacuum adiabatic body are conveniently coupled and is reinforced in strength.

First condition: the front cover 410 has an elastic modulus (N/m) greater than that of each of the inner and outer covers 420 and 430.

Second condition: the front cover 410 has yield strength ($N/m^2$) less than that of each of the inner and outer covers 420, 430.

Third condition: the front cover 410 has a thickness greater than that of each of the inner and outer covers 420 and 430.

According to the above conditions, the edge and corner of the vacuum adiabatic body may be protected and increase in strength. In addition, the cover assembly may be easily coupled.

The inner and outer covers 420 and 430 may be provided in a lattice structure to decrease in elastic modulus of each of the inner and outer covers 420 and 430.

Another embodiment is proposed in which various conditions described above are satisfied in various aspects. In the following description of another embodiments, the portions that are different based on FIG. 26 are specifically described, and the same portion will be cited from the description of FIG. 26.

First, FIGS. 27 to 31 illustrate another example in which the shoulders 4022, 4024, 4032, and 4034 and the coupling portions 4021 are 4031 are changed.

Figure 27:
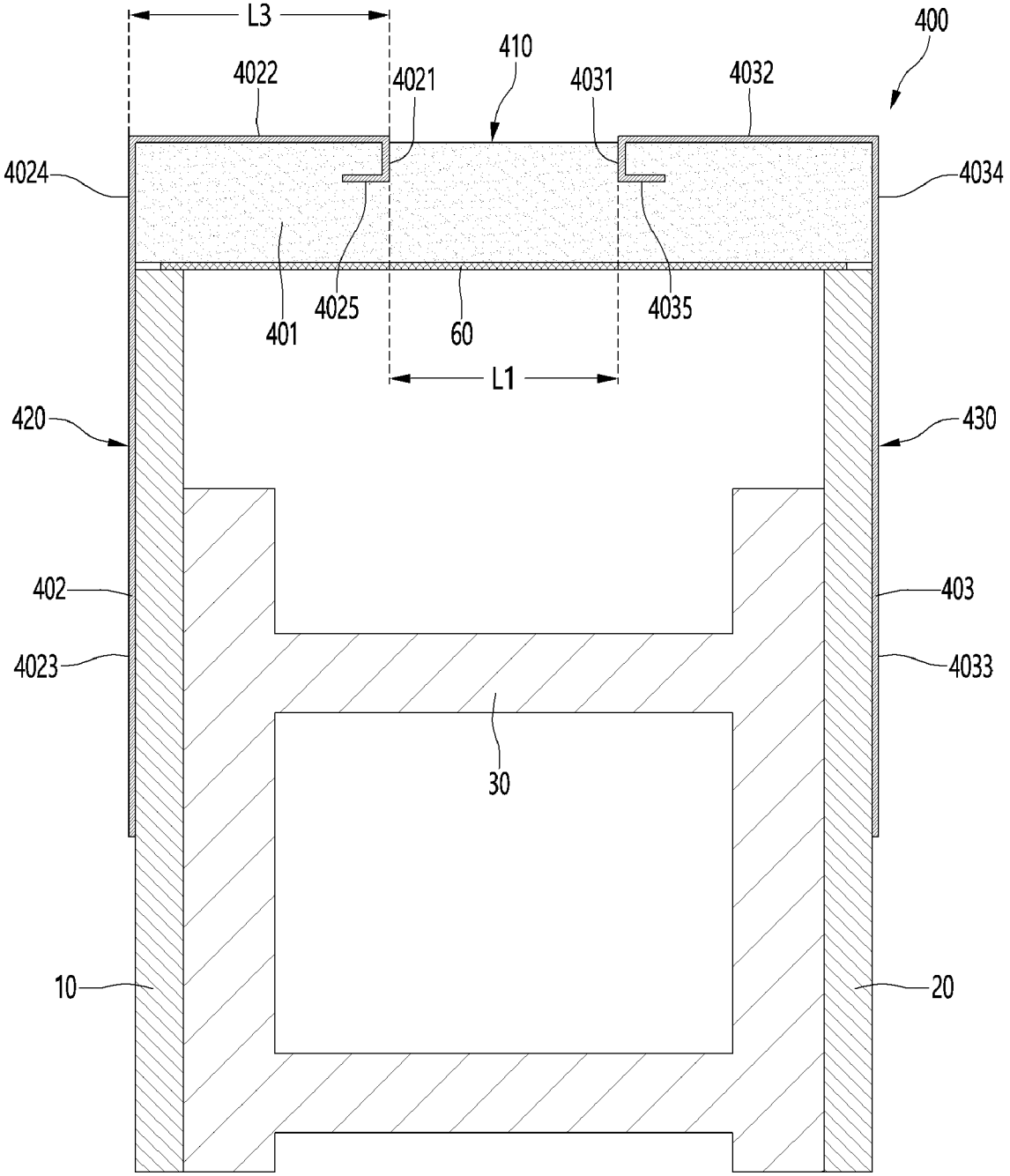
FIGS. 27 to 31 are cross-sectional views illustrating a modified example of a shoulder and an arm of the cover assembly.

Referring to FIG. 27, according to this embodiment, it is seen that an end of the coupling portion is bent to further have bent portions 4025 and 4035, and a distance L1 between the coupling portions and a length L3 of each of first shoulders 4022 and 4032 are maintained. In this embodiment, coupling force between the inner and outer arms 402 and 403 and the cover adiabatic material 401 increases, and reducing power of the thermal conduction through the front cover 410 may be maintained. The arm may be fixed to the cover adiabatic material by insert injection and press-fitting.

Figure 28:
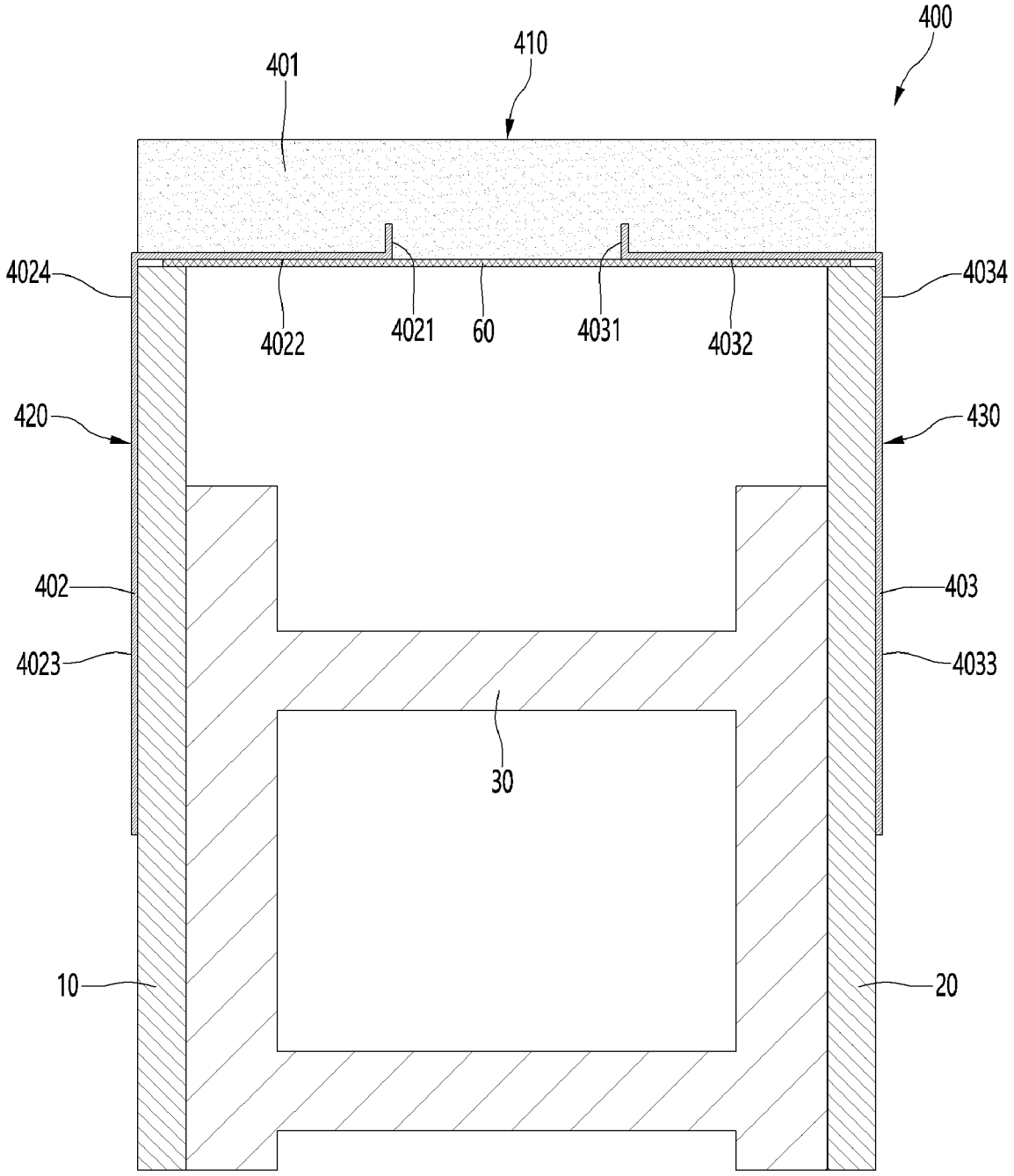

Referring to FIG. 28, the second shoulders 4024 and 4034 are not separately provided, and the first shoulders 4022 and 4032 are provided on the inner surface of the cover adiabatic material 401. According to this embodiment, the function of the conductive resistance sheet may be deteriorated, but the deterioration may be implemented by a method such as interposing of another material between the sheet and the arm.

Figure 29:
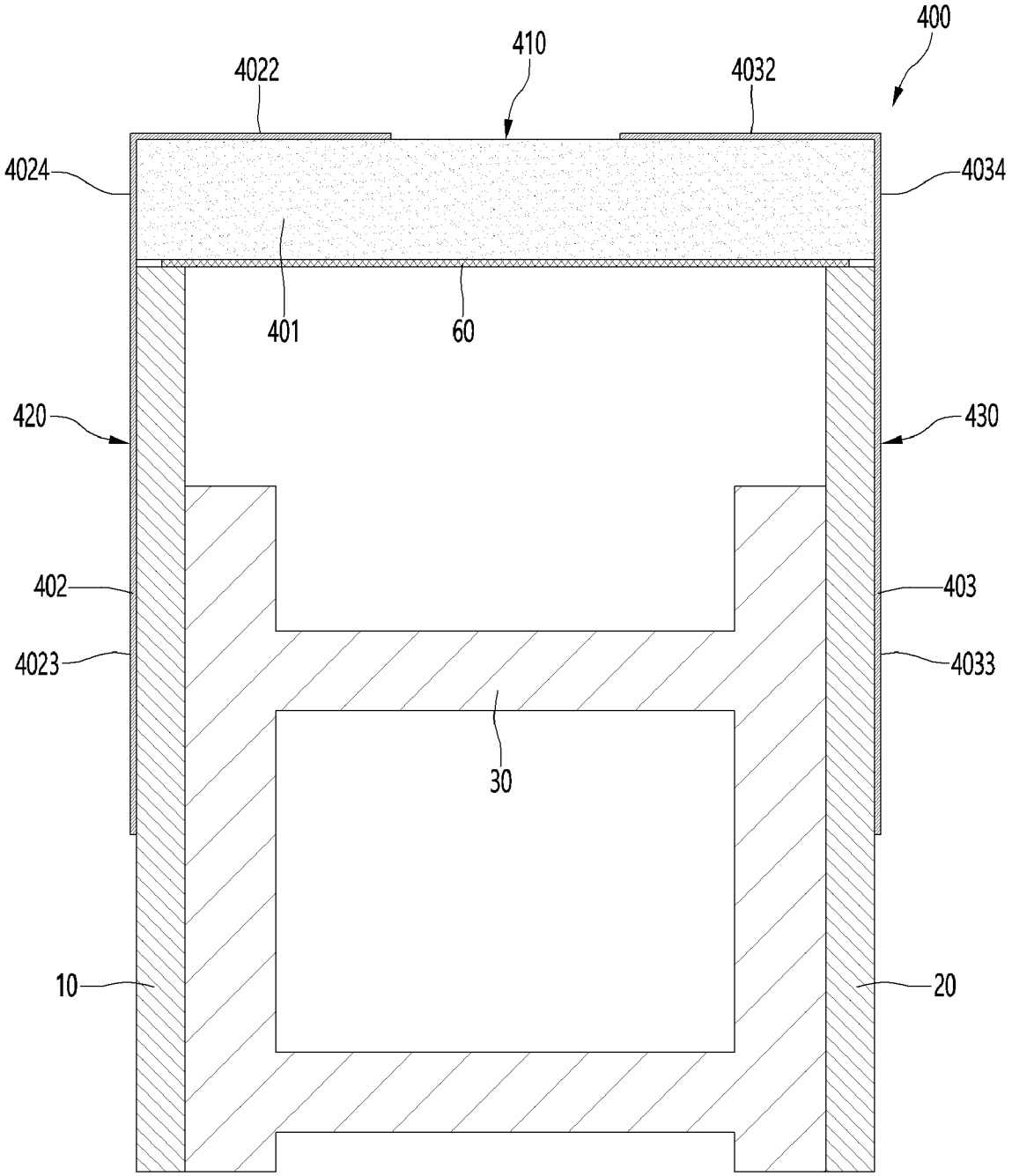

Referring to FIG. 29, the coupling portions 4021 and 4031 are not provided. This embodiment is intended to improve convenience of the coupling operation. The shoulder may be directly coupled to the cover adiabatic material due to the strong bonding or mechanical coupling operation.

Although not shown, an embodiment in which only the first shoulder is not provided, and only the second shoulder is provided may be considered.

Figure 30:
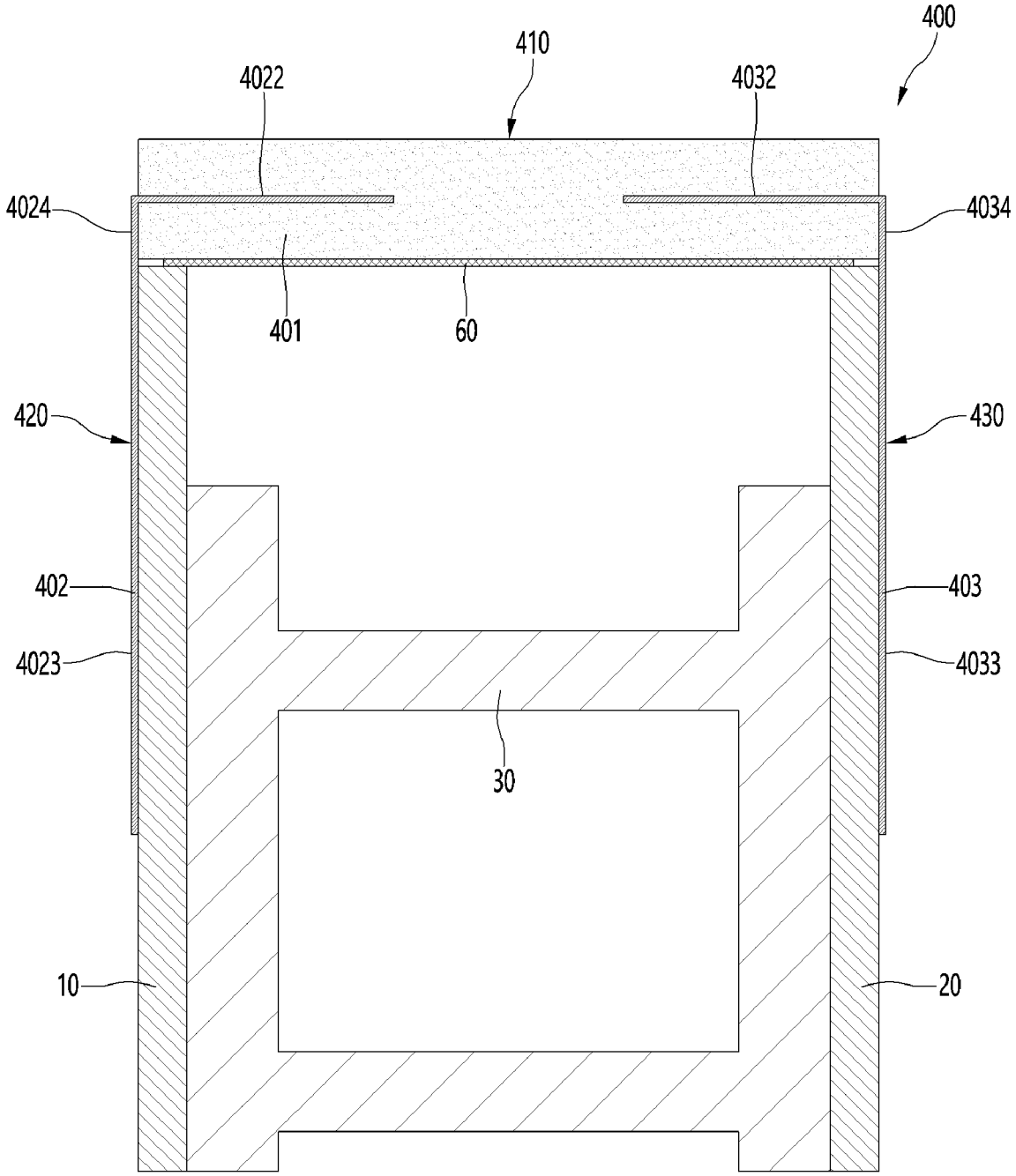

Referring to FIG. 30, the first shoulders 4022 and 4032 may be provided inside the cover adiabatic material 401. In this case, a separate coupling portion may not be provided.

Figure 31:
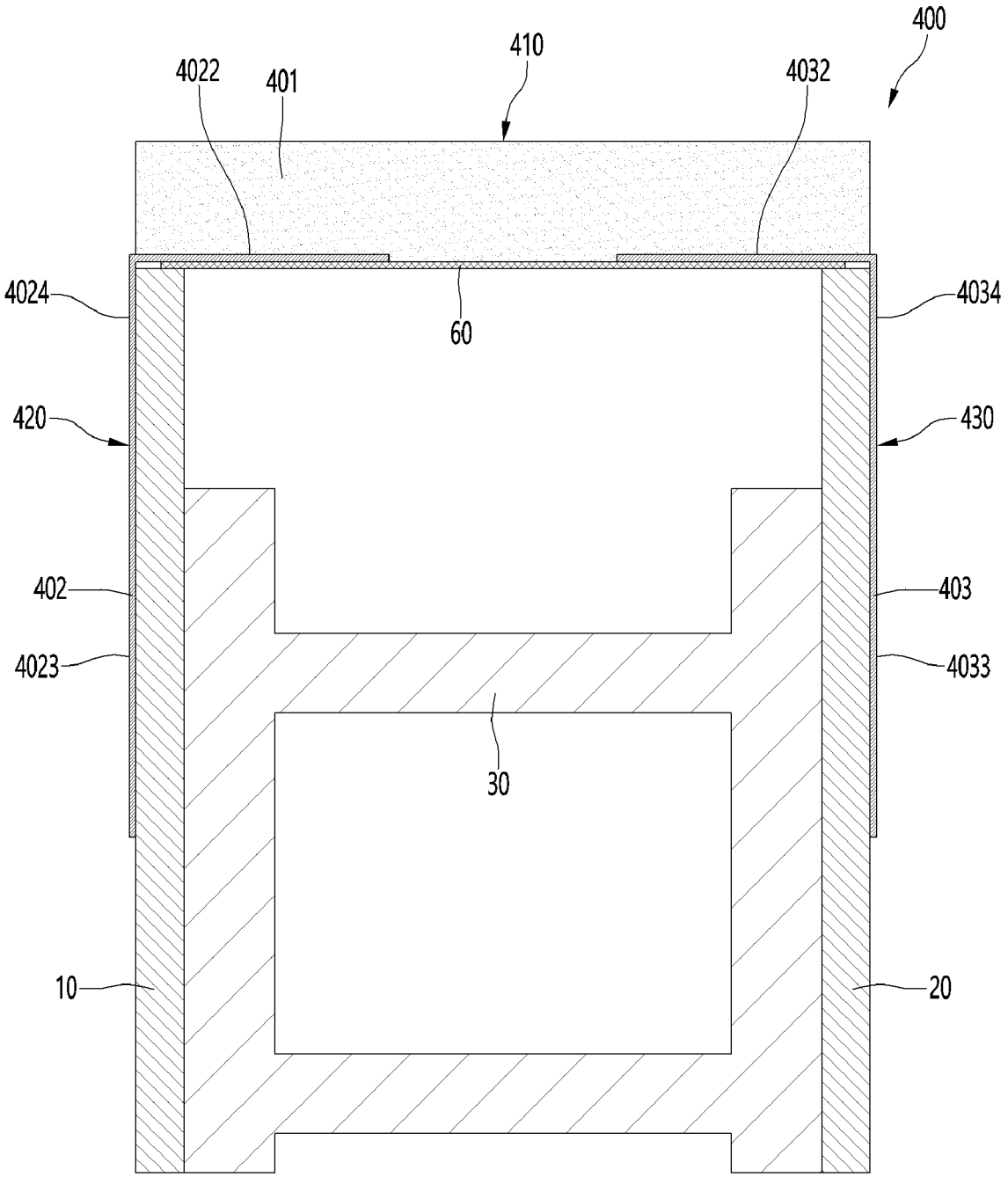

Referring to FIG. 31, the coupling portions 4021 and 4031 and the second shoulders 4024 and 4034 are not provided, and the first shoulders 4022 and 4032 may function as the coupling portions 4021 and 4031 and the second shoulders 4024 and 4034. The first shoulders 4022 and 4032 are provided on the inner surface of the cover adiabatic material, and also, the coupling method and an additional adiabatic material as described above may be applied.

In FIGS. 32 to 43, a distance between the arms 402 and 403 may increase so as to be further contributed to the conduction resistance by the conductive resistance sheet. Accordingly, the thermal conduction passing through the front cover 410 may be further reduced. As in the previous embodiment, the same description is assumed to be applied as it is.

Figure 32:
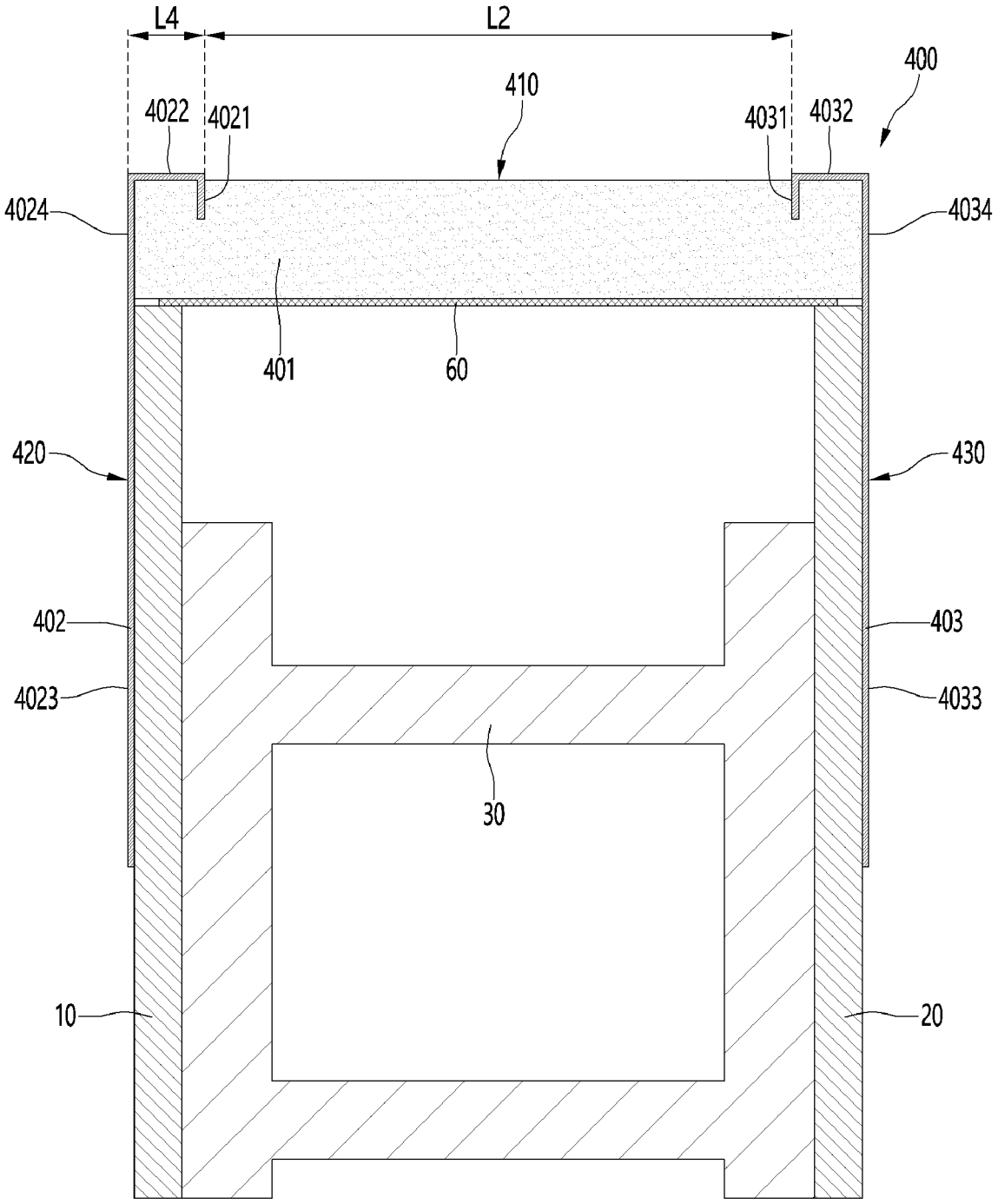
FIGS. 32 to 43 are cross-sectional views illustrating a modified example in which a distance between arms further increases.

Referring to FIG. 32, it is seen that the length L4 of each of the first shoulders 4022 and 4032 is less than that of the shoulder according to other embodiments. Accordingly, an advantage, in which a distance between the ends of the arms 402 and 403 becomes longer, and an adiabatic distance L2 by the cover adiabatic material 401 becomes longer to further improve the adiabatic operation by the front cover 410, may be achieved.

Figure 33:
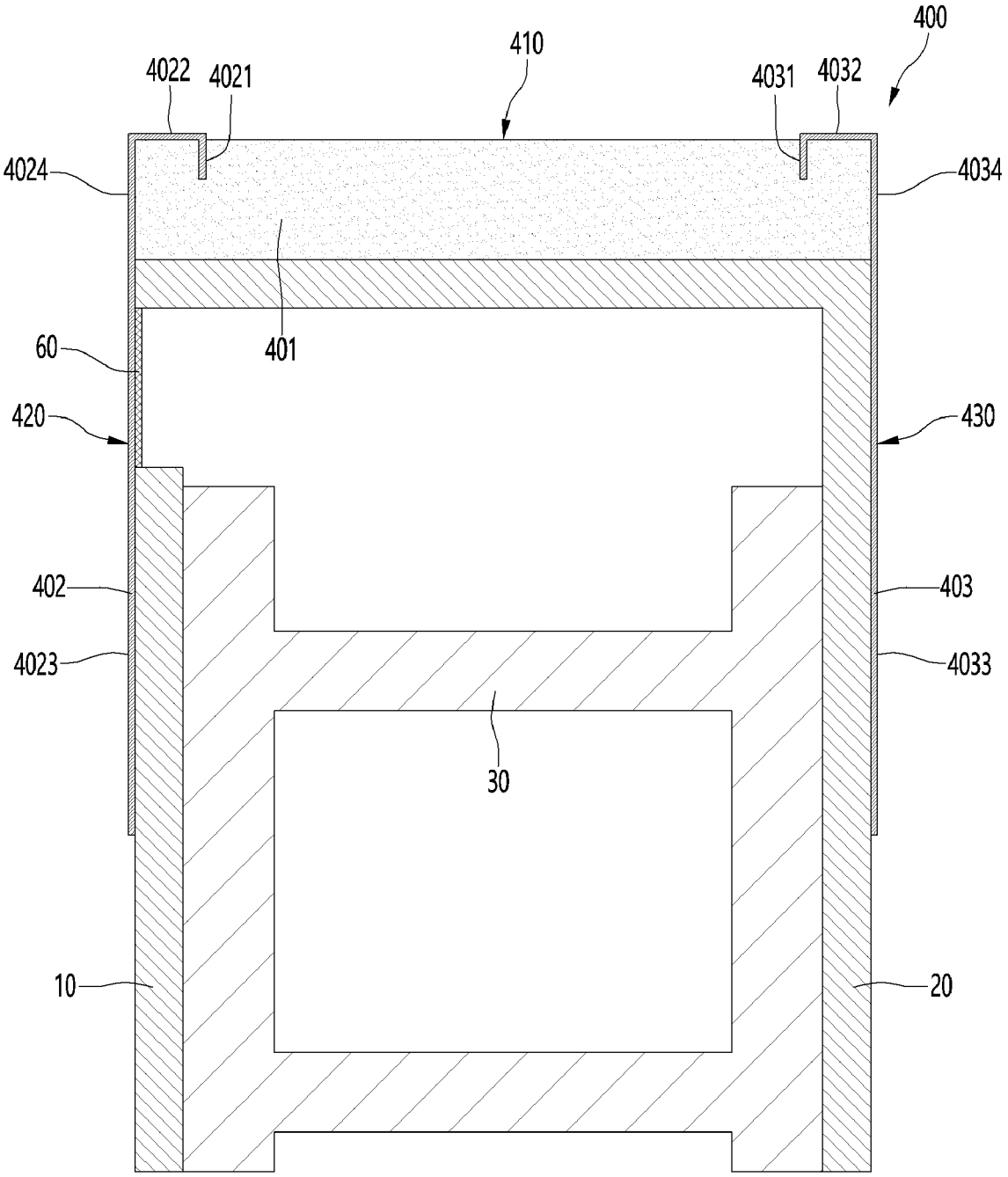

Referring to FIG. 33, when compared to the embodiment of FIG. 32, it is characteristically different that the position of the conductive resistance sheet 60 is changed to the lateral side rather than the front side. In the drawings, it is shown to be provided in the inside. This embodiment may be applied to a case in which it is difficult to install the conductive resistance sheet as a small-sized vacuum adiabatic body.

Figure 34:
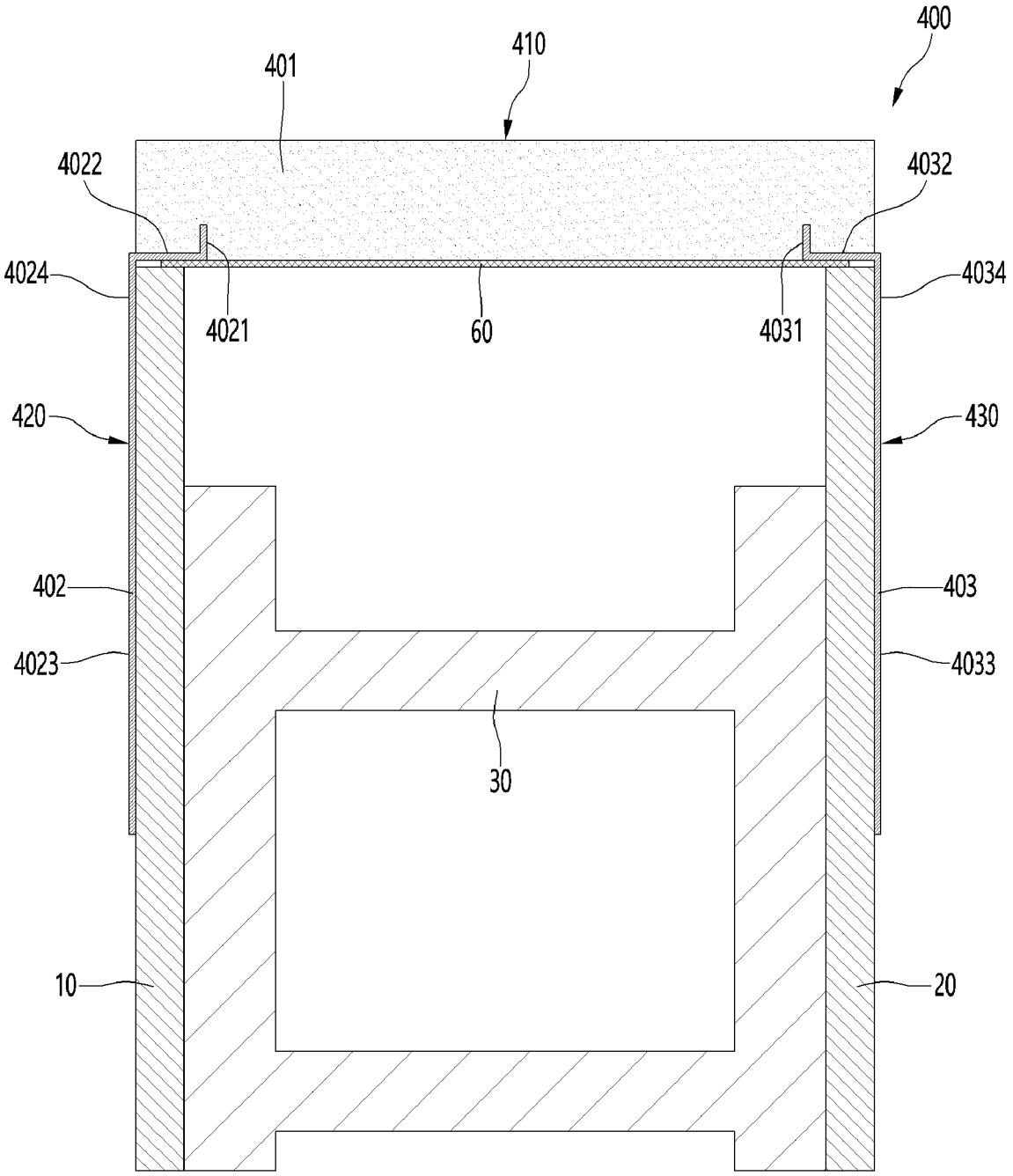

Referring to FIG. 34, in addition to the length L4 of each of the first shoulders 4022 and 4032, which is less than that of the shoulder according to other embodiments as illustrated in FIG. 33, the second shoulders 4024 and 4034 are not separately provided as illustrated in FIG. 28, and the first shoulders 4022 and 4032 are provided on the inner surface of the cover adiabatic material 401.

That is, modified ideas of FIGS. 28 and 33 are added together to the idea of FIG. 26. Accordingly, features of each modification may be implemented together to obtain an advantage corresponding to the individual configuration of the modified example.

Figure 35:
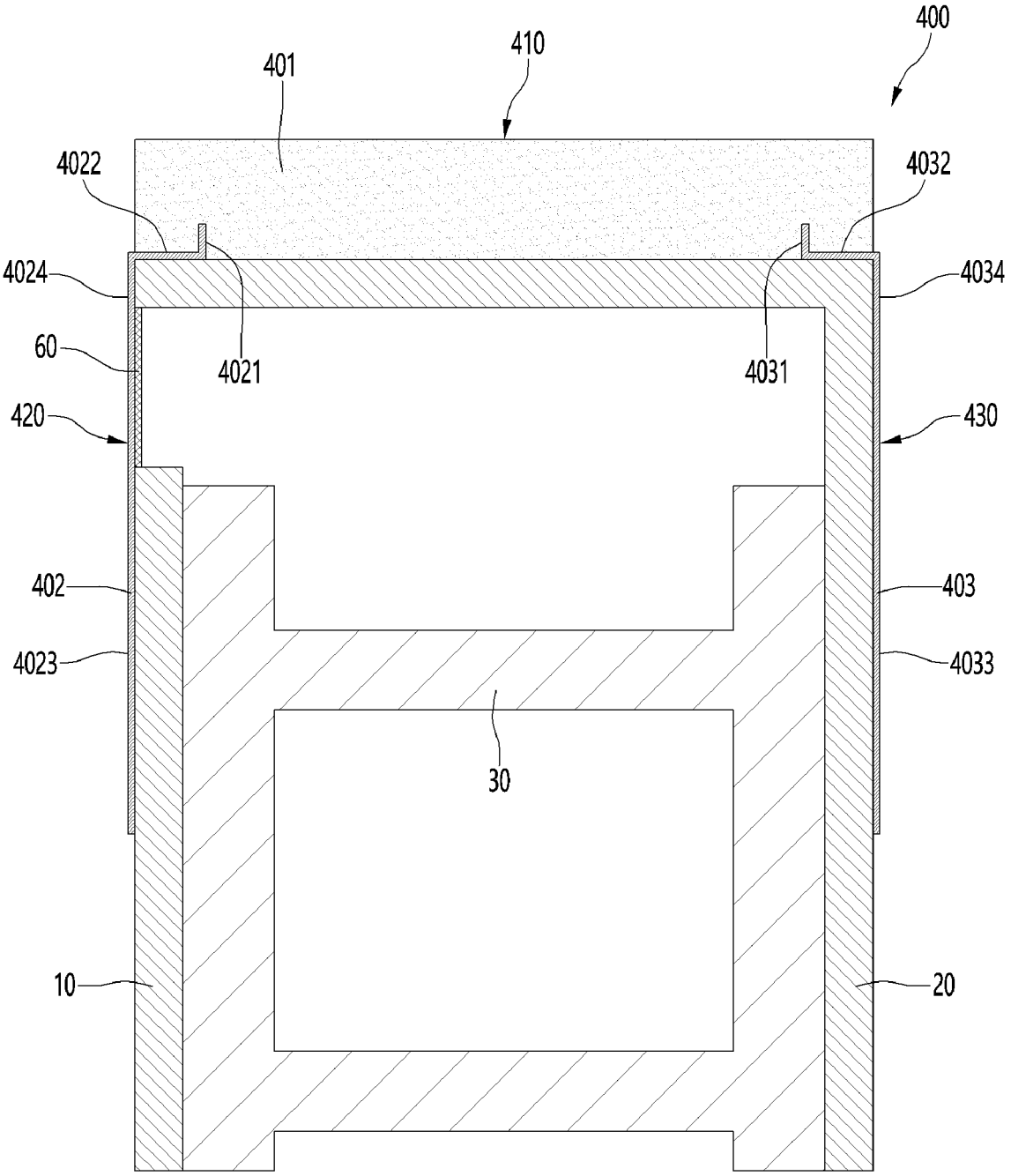

An embodiment of FIG. 35 is characteristically different in that the position of the conductive resistance sheet 60 is changed to the lateral side rather than the front side when compared to the embodiment of FIG. 34.

Figure 36:
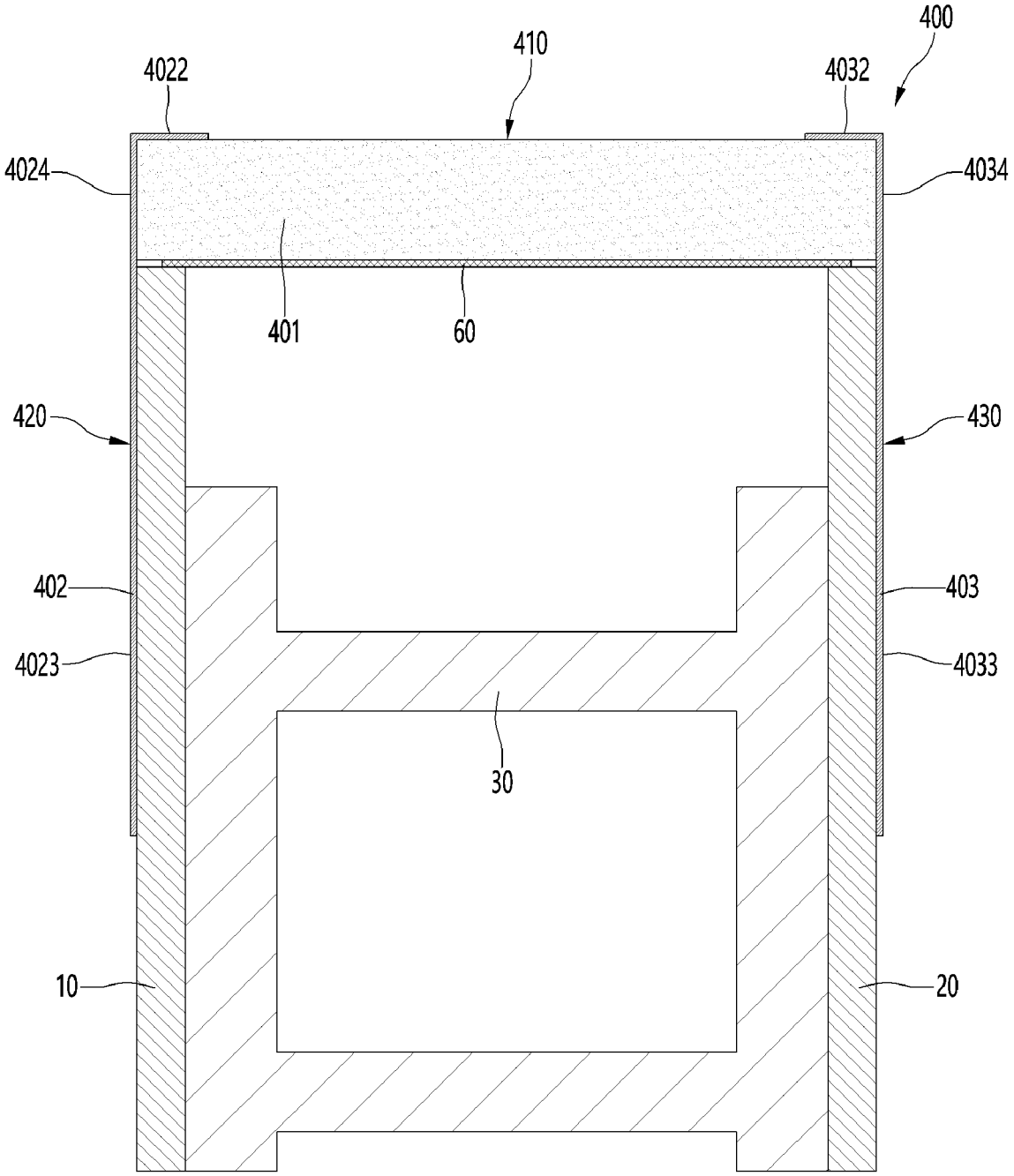

Referring to FIG. 36, modified ideas of FIGS. 29 and 33 are added together to the idea of FIG. 26. Accordingly, the features of each modified example may be implemented together.

Figure 37:
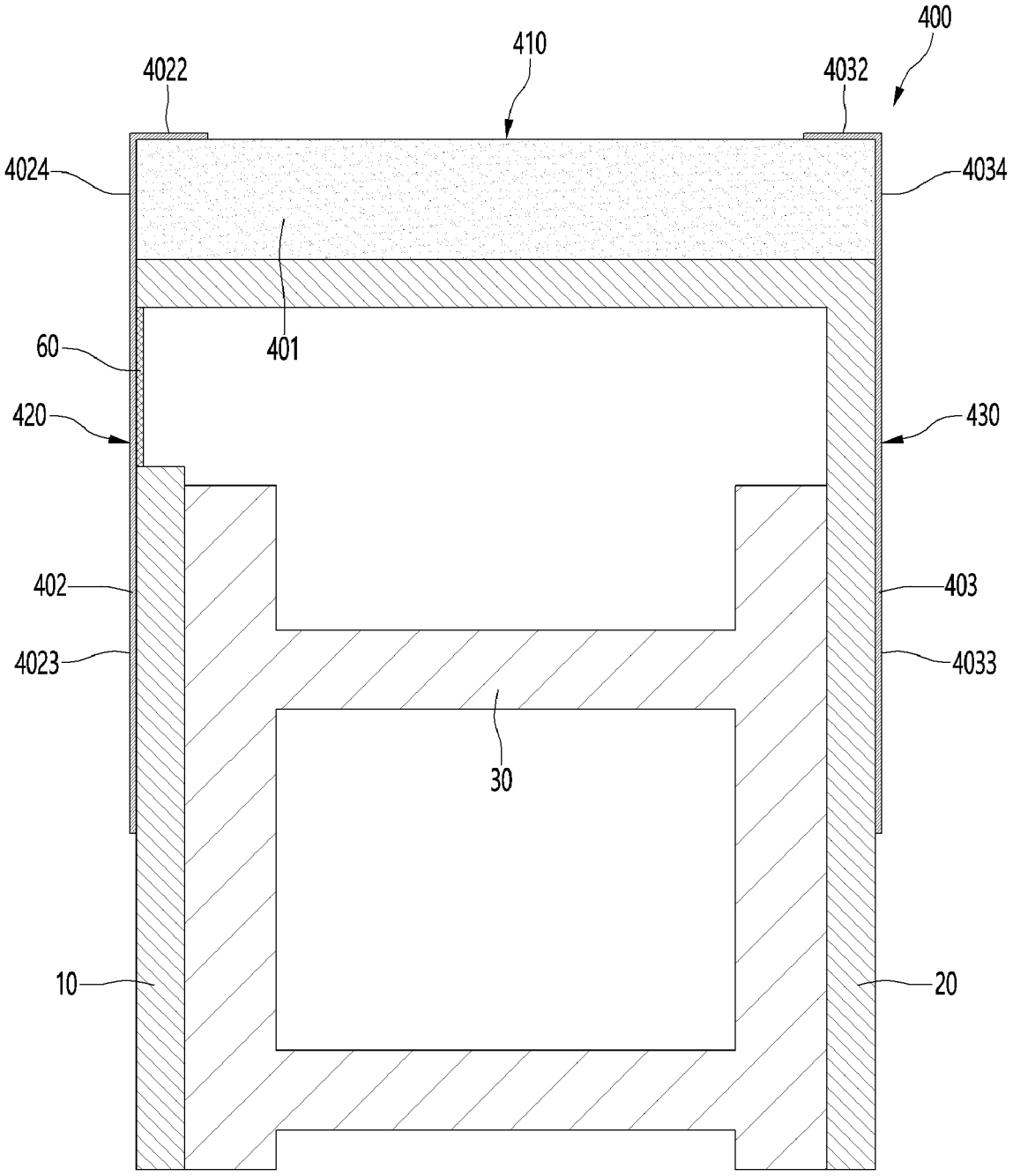

An embodiment of FIG. 37 is characteristically different in that the position of the conductive resistance sheet 60 is changed to the lateral side rather than the front side when compared to the embodiment of FIG. 36.

Figure 38:
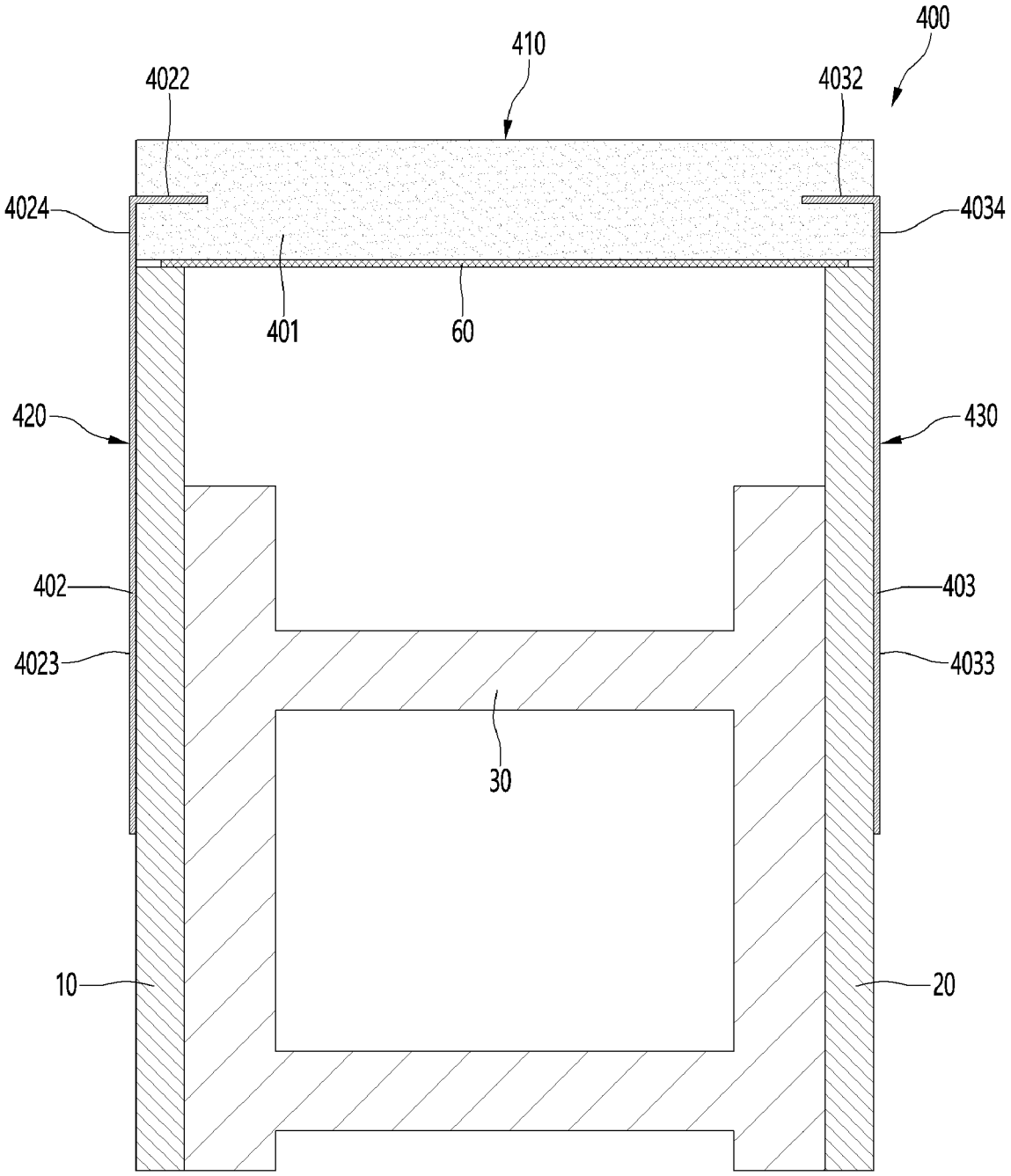

Referring to FIG. 38, modified ideas of FIGS. 30 and 33 are added together to the idea of FIG. 26. Accordingly, the features of each modified example may be implemented together.

Figure 39:
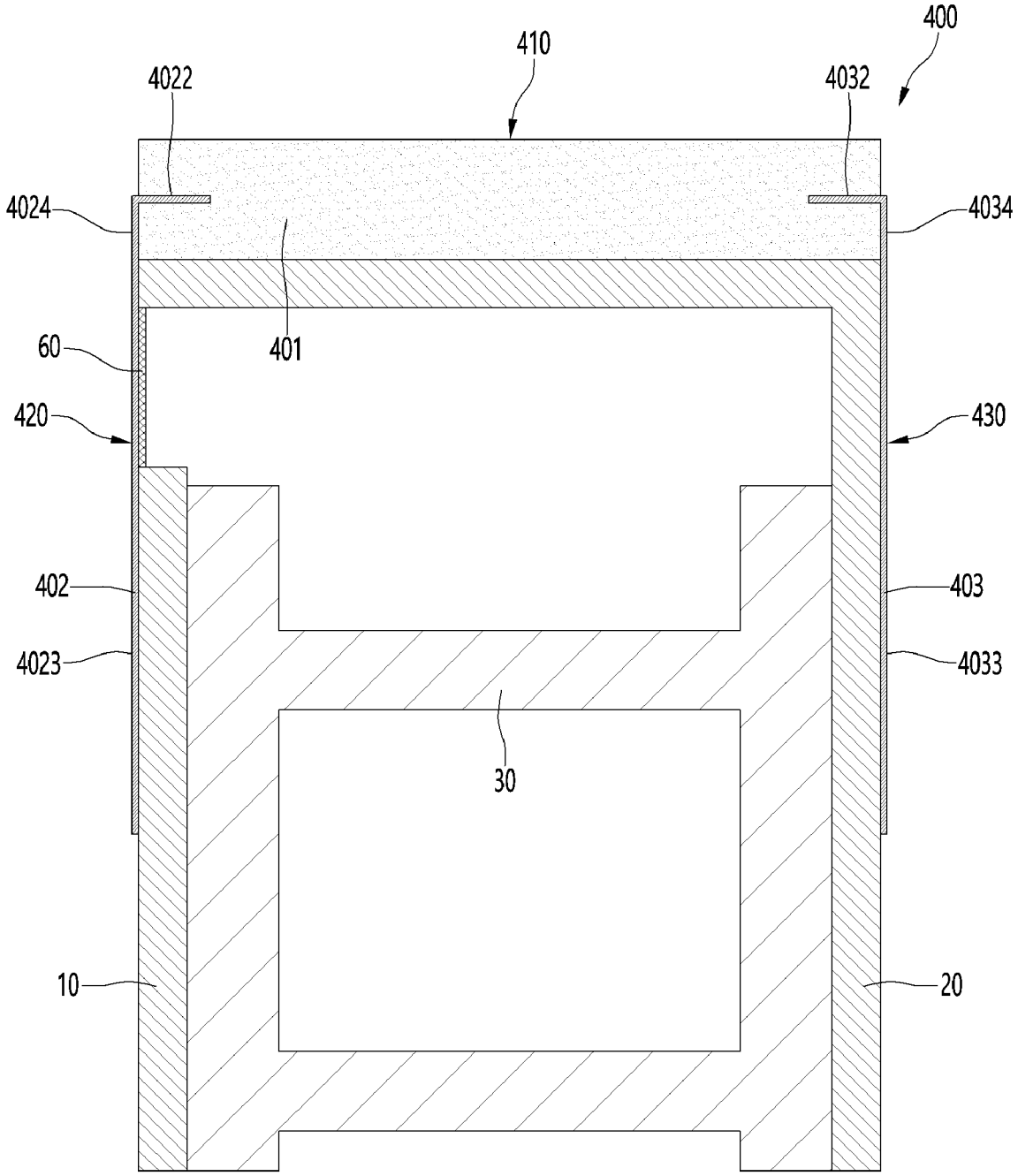

An embodiment of FIG. 39 is characteristically different in that the position of the conductive resistance sheet 60 is changed to the lateral side rather than the front side when compared to the embodiment of FIG. 38.

Figure 40:
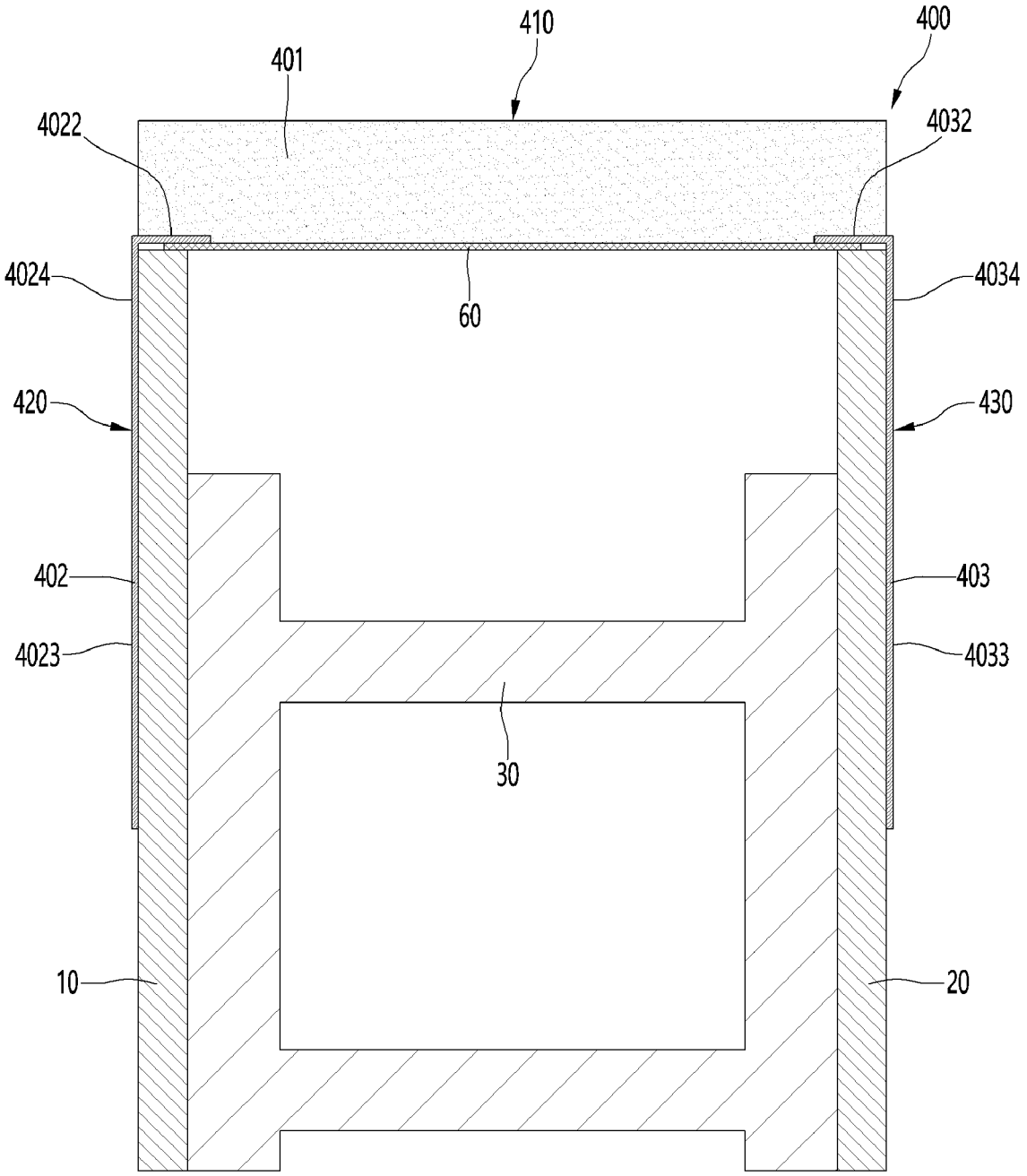

Referring to FIG. 40, modified ideas of FIGS. 31 and 33 are added together to the idea of FIG. 26. Accordingly, the features of each modified example may be implemented together.

Figure 41:
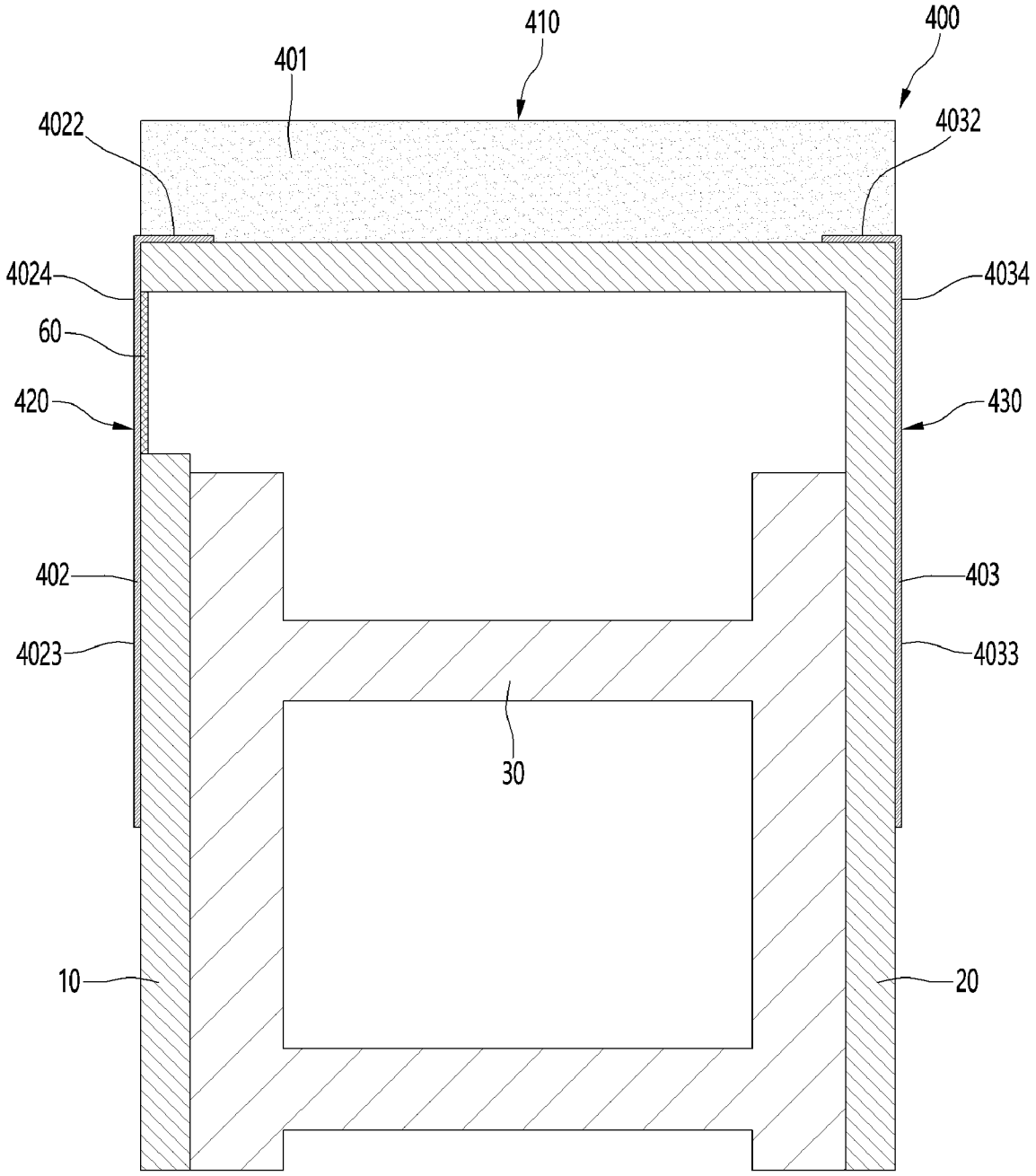

An embodiment of FIG. 41 is characteristically different in that the position of the conductive resistance sheet 60 is changed to the lateral side rather than the front side when compared to the embodiment of FIG. 40.

Figure 42:
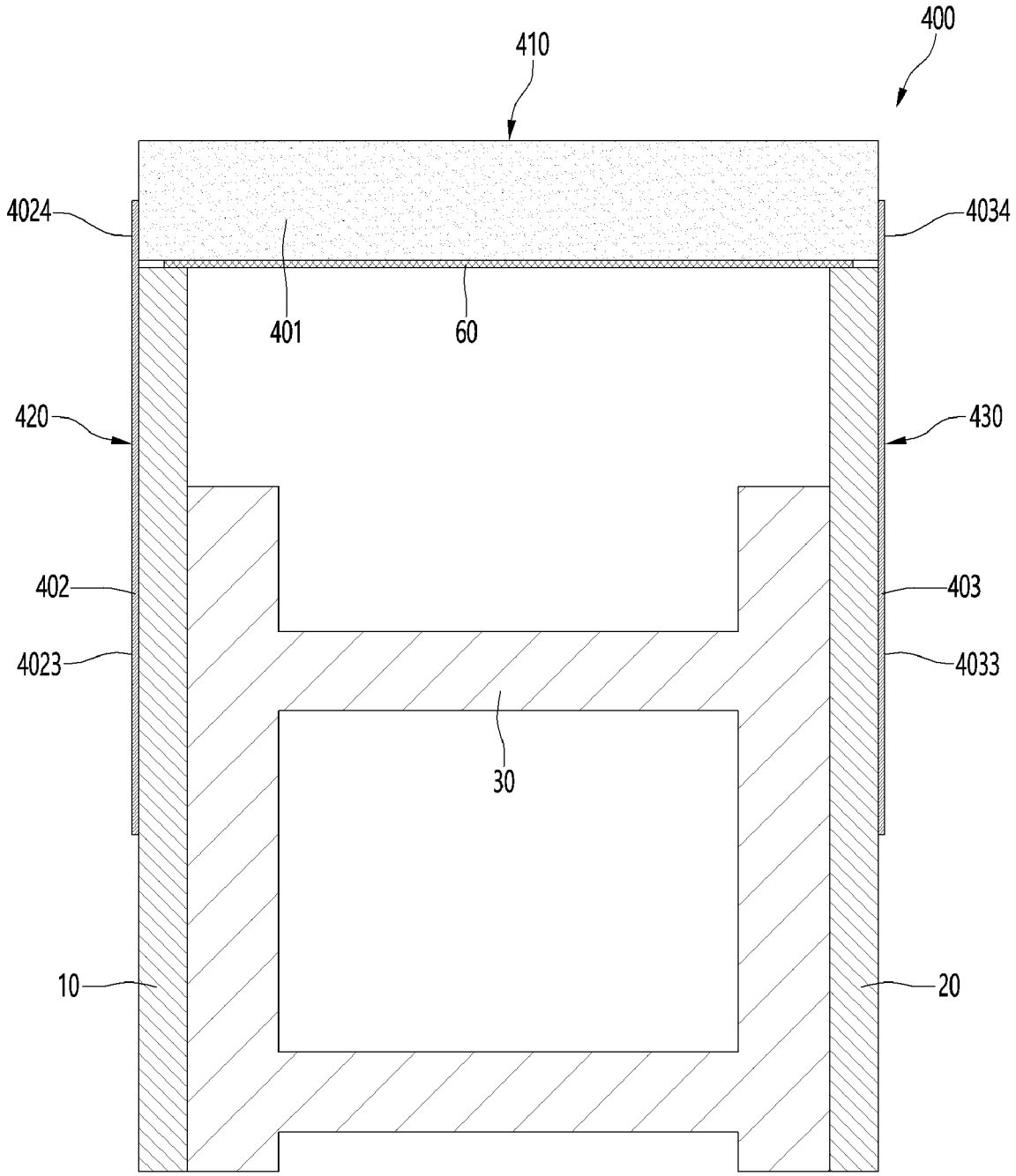

Referring to FIG. 42, all of the first shoulders 4022 and 4032 and the coupling portions 4021 and 4031 are removed, and at least a portion of the second shoulders 4024 and 4034 functions as the coupling portions and the first shoulders.

Figure 43:
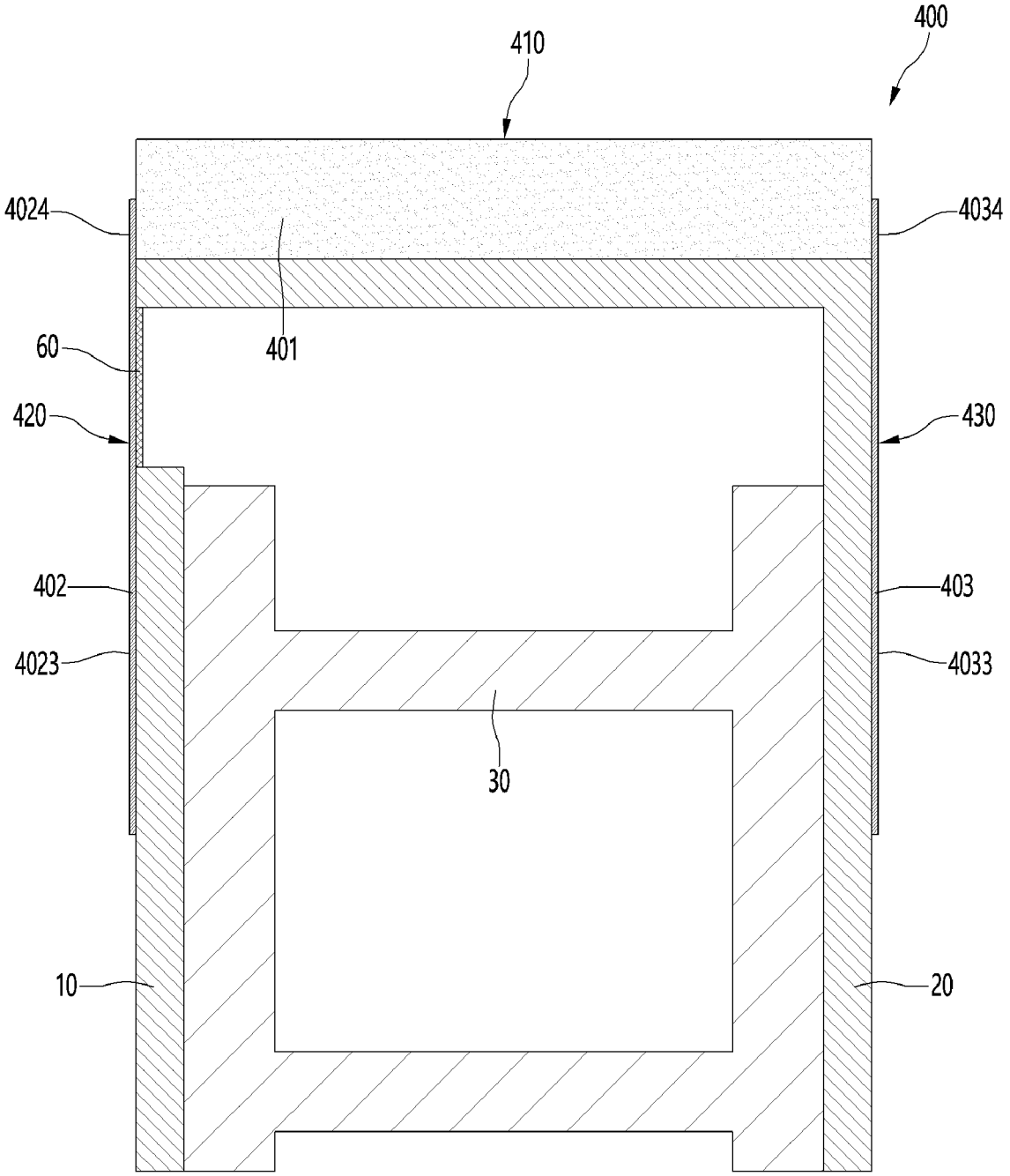

An embodiment of FIG. 43 is characteristically different in that the position of the conductive resistance sheet 60 is changed to the lateral side rather than the front side when compared to the embodiment of FIG. 42.

It is seen that the cover assembly is implemented in various ways according to the various embodiments and the modified examples described above.

Hereinafter, further another embodiment in which a cover adiabatic material 401 is divided into two portions will be described. When the cover adiabatic material is separated, components are unified according to the structure of the vacuum adiabatic body, and thus, a stock and cost thereof may be reduced.

Figure 44:
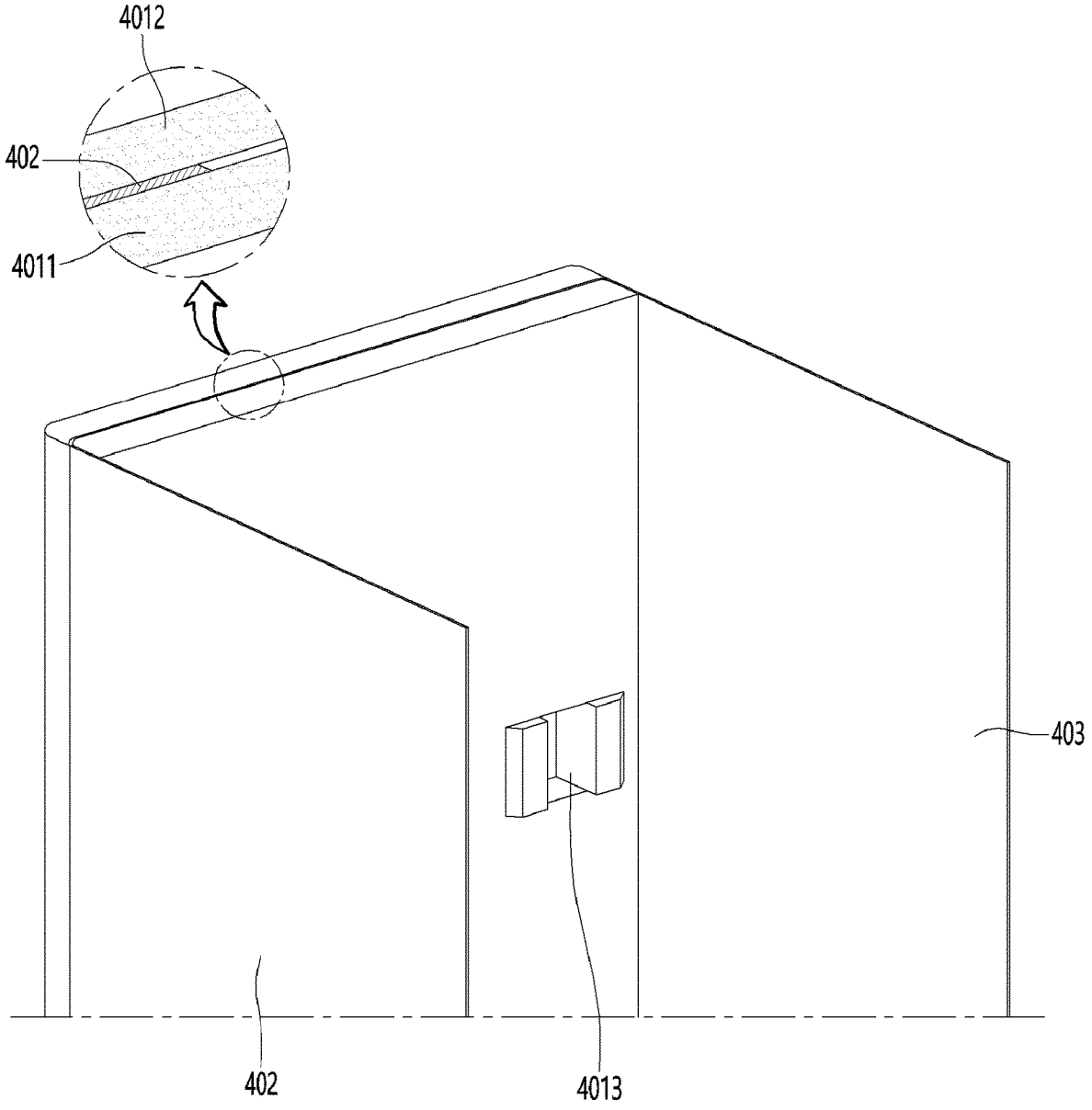
FIG. 44 is a cutaway perspective view illustrating an edge of a vacuum adiabatic body according to another embodiment.
Figure 45:
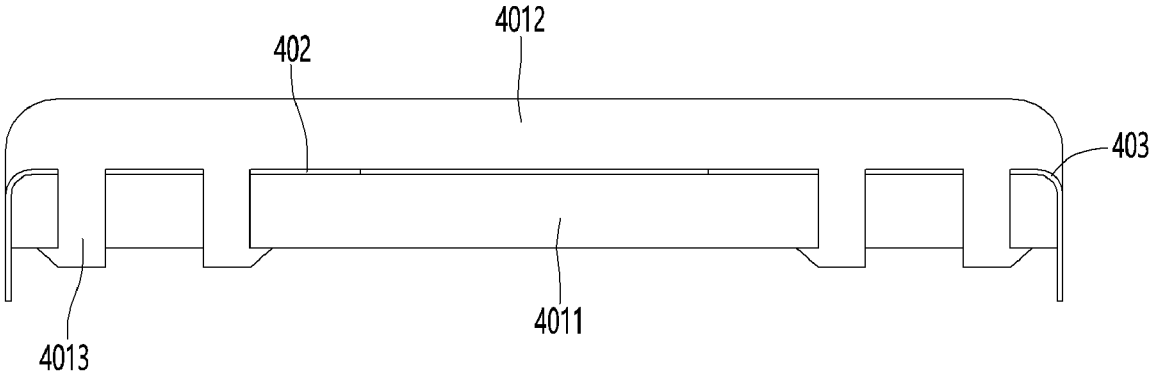
FIG. 45 is a cross-sectional view illustrating the edge of the vacuum adiabatic body according to another embodiment.

FIG. 44 is a cutaway perspective view of an edge of a vacuum adiabatic body according to further another embodiment, and FIG. 45 is a cross-sectional view of an edge.

Referring to FIGS. 44 and 45, a first cover adiabatic material 4011 facing the inside of a vacuum adiabatic body and a second cover adiabatic material 4012 facing the outside of the vacuum adiabatic body are provided. The two cover adiabatic materials may be coupled to each other by a cover coupling portion 4013.

The cover coupling portion 4013 is illustrated as a structure of a groove and hook, but is not limited thereto. The cover coupling portion 4013 may be coupled in various ways such as attachment, screw coupling, and fitting.

Inner and outer arms 402 and 403 may be fitted between the first cover adiabatic material 4011 and the second cover adiabatic material 4012.

Although not shown, an opening is provided in each of the inner and outer arms 402 and 403, and the cover coupling portion 4013 may be inserted into the opening. According to this structure, a structure in which the cover coupling portion 4013 holds the inner and outer arms 402 and 403 is possible, and thus, an advantage, in which coupling force between the inner and outer arms 402 and 403 becomes stronger and is firmed, may be expected.

According to this embodiment, it is possible to reduce the stock of components and implement the cover assembly in various ways so as to correspond to an edge of the vacuum adiabatic body having various structures.

INDUSTRIAL APPLICABILITY

According to the embodiments, the protection of the sealed portion between the main body and the door of the apparatus to which the vacuum adiabatic body is applied, the prevention of the heat loss due to the close contact with the magnet provided to the door, and the stability of the adiabatic operation may be improved to be contributed to the commercialization using the vacuum adiabatic body.

According to the embodiments, the vulnerability of conductive resistance sheet, which occurs when the vacuum adiabatic body is applied to the apparatus, may be supplemented in various aspects such as strength, external interference, and installation of accessories. Therefore, in the aspect of the maintenance in vacuum required for the apparatus to which the vacuum adiabatic body is applied, the operational reliability of the apparatus such as the refrigerator may be secured without causing the side effects. It may be said that industrial application is greatly expected due to the above advantages.

The invention claimed is:

1. A vacuum adiabatic body comprising:
a first plate;
a second plate;
a sheet configured to seal the first plate and the second plate so as to provide a vacuum space between the first plate and the second plate; and
a cover assembly configured to cover the sheet,
wherein the cover assembly includes:
an inner cover provided at an inner side of the vacuum adiabatic body,
an outer cover provided at an outer side of the vacuum adiabatic body, and
a front cover provided at a front side of the vacuum adiabatic body,
wherein the front cover is disposed outside the sheet and includes a cover adiabatic material made of a resin material and having a thickness greater than that of each of the first plate and the second plate so that generation of dew on a periphery of the sheet is reduced, and
wherein the front cover further includes a pair of arms made of a metal material and spaced apart from each other by the cover adiabatic material so that a heat transfer amount between the inner cover and the outer cover is greater than that between an inside and an outside of the front cover.

2. The vacuum adiabatic body according to claim 1, wherein the sheet has a thickness equal to or less than that of each of the outer cover and the inner cover, and
the inner cover has a thickness equal to or less than that of the first plate.

3. The vacuum adiabatic body according to claim 1, wherein three times a thickness of the inner cover or the outer cover is equal to or less than a thickness of the front cover.

4. The vacuum adiabatic body according to claim 1, wherein the inner cover and the outer cover are sealed on to the first plate and the second plate.

5. The vacuum adiabatic body according to claim 1, wherein
at least a portion of a magnetic body is provided inside the front cover,
at least a portion of the magnetic body is provided on at least one of a front surface or a rear surface of the front cover,
at least a portion of the magnetic body is provided behind the front cover, or
at least a portion of the sheet is made of a magnetic material and is provided behind the front cover.

6. The vacuum adiabatic body according to claim 1, wherein the front cover has an elastic modulus (N/m) greater than that of the inner cover or the outer cover.

7. The vacuum adiabatic body according to claim 1, wherein the front cover has yield strength ($N/m^2$) less than that of the inner cover or the outer cover.

8. The vacuum adiabatic body according to claim 1, wherein the pair of arms extend from the front cover to provide at least a portion of at least one of the inner cover or the outer cover.

9. The vacuum adiabatic body according to claim 8, wherein the pair of arms are spaced a predetermined distance from each other.

10. A refrigerator comprising:
a main body having an opening with respect to an accommodation space;
a door configured to open and close the opening of the main body;
a gasket installed on the door and configured to seal between the door and the main body around the opening;
a magnet provided on the gasket; and
a cover assembly provided on the main body around the opening,
wherein the cover assembly includes:
a front cover including a nonmetal material, the front cover being configured to cover a front of the main body at the opening; and
at least one of an inner cover including a metal material and that extends from the front cover and along an inner surface of the main body, or an outer cover including a metal material and that extends from the front cover and along an outer surface of the main body,
wherein the front cover includes a cover adiabatic material made of a resin material, and a pair of arms made of a metal material and coupled to the cover adiabatic material, and
wherein at least one of the pair of arms includes a coupling portion coupled to the cover adiabatic material, and a shoulder bent from the coupling portion and extending along an outer surface of the cover adiabatic material.

11. The refrigerator according to claim 10, wherein the front cover includes a magnetic body.

12. The refrigerator according to claim 10, wherein the front cover has a thickness greater than that of each of the inner cover and the outer cover.

13. The refrigerator according to claim 10, wherein
the main body includes a vacuum adiabatic body,
the vacuum adiabatic body includes:
a first plate configured to define at least a portion of the accommodation space;
a second plate separated from the first plate, and
a sheet configured to seal the first plate and the second plate so as to provide a vacuum space between the first plate and the second plate, and
the front cover is configured to cover the sheet.

14. The refrigerator according to claim 13, wherein at least one of the inner cover or the outer cover is sealed to the main body.

15. The refrigerator according to claim 13, wherein at least a portion of one or more of the first or second plates is positioned behind the front cover.

16. A vacuum adiabatic body comprising:
a first plate;
a second plate;
a sheet configured to seal the first plate and the second plate so as to provide a vacuum space; and
a cover assembly configured to cover the sheet,
wherein the cover assembly includes:
a cover adiabatic material that includes resin material and is configured to thermally insulate the sheet;
at least one of a first arm that includes a metal material and extends from the cover adiabatic material and along the first plate, or a second arm that includes a metal material and extends from the cover adiabatic material and along the second plate; and
a shoulder extending from the at least one of a first arm or the second arm, and
wherein the shoulder is provided on an inner surface of the cover adiabatic material and between the sheet and the cover adiabatic material.

17. The refrigerator vacuum adiabatic body according to claim 16, wherein the cover adiabatic material includes:

a first cover adiabatic material provided at an inner side facing the vacuum space;

a second cover adiabatic material provided at an outer side facing an outside of the refrigerator; and a cover coupling configured to couple the first cover adiabatic material to the second cover adiabatic material.

18. The vacuum adiabatic body according to claim 17, wherein the cover coupling holds at least one of the first arm or the second arm.

* * * * *